US007705782B2

(12) United States Patent
Lee

(10) Patent No.: US 7,705,782 B2
(45) Date of Patent: Apr. 27, 2010

(54) MICROSTRIP ARRAY ANTENNA

(75) Inventor: Choon Sae Lee, Dallas, TX (US)

(73) Assignee: Southern Methodist University, Dallas, TX (US)

( * ) Notice: Subject to any disclaimer, the term of this patent is extended or adjusted under 35 U.S.C. 154(b) by 0 days.

(21) Appl. No.: 10/278,252

(22) Filed: Oct. 23, 2002

(65) Prior Publication Data

US 2004/0080455 A1 Apr. 29, 2004

(51) Int. Cl.
*H01Q 1/38* (2006.01)

(52) U.S. Cl. ..... 343/700 MS; 333/116

(58) Field of Classification Search ..... 343/700 MS, 343/853; 333/116
See application file for complete search history.

(56) References Cited

U.S. PATENT DOCUMENTS 3,921,177 A * 11/1975 Munson ..... 343/846
3,987,455 A 10/1976 Olyphant, Jr. et al.
3,995,277 A * 11/1976 Olyphant, Jr. ..... 343/846
4,063,245 A * 12/1977 James et al. ..... 343/700 MS
4,063,246 A * 12/1977 Greiser ..... 343/700 MS
4,173,019 A * 10/1979 Williams ..... 343/700 MS
4,180,817 A 12/1979 Sanford
4,605,931 A 8/1986 Mead et al.
4,899,163 A 2/1990 Daniel et al.
5,233,361 A 8/1993 Boguais
5,367,307 A 11/1994 Dupuis et al.
5,703,601 A 12/1997 Nalbadian et al.
5,777,531 A 7/1998 Tran et al.
5,818,391 A * 10/1998 Lee ..... 343/700 MS
6,005,520 A 12/1999 Nalbadian et al.
6,031,491 A * 2/2000 Daniel et al. ..... 343/700 MS
6,133,878 A 10/2000 Lee
6,166,692 A 12/2000 Nalbadian et al.
6,285,325 B1 9/2001 Nalbadian et al.
6,362,785 B1 3/2002 Nalbadian et al.
6,693,595 B2 2/2004 Lee
6,839,028 B2 1/2005 Lee (Continued)

FOREIGN PATENT DOCUMENTS

EP 1154516 A1 11/2001

(Continued)

OTHER PUBLICATIONS

Hsieh, Tung-hung, "Double-Layer Microstrip Array Antenna," a dissertation presented to the graduate faculty of School of Applied Science and Engineering, Southern Methodist University, Dec. 1996, Dallas, Texas U.S.A.

(Continued)

*Primary Examiner*—Michael C Wimer
(74) *Attorney, Agent, or Firm*—Carr LLP

(57) ABSTRACT

A microstrip antenna has a single dielectric layer with a conductive ground plane disposed on one side, and an array of spaced apart radiating patches disposed on the other side of the dielectric layer. The radiating patches are interconnected with a feed terminal via stripline elements. Responsive to electromagnetic energy, a high-order standing wave is induced in the antenna and a directed beam is transmitted from and/or received into the antenna. A dual-mode embodiment is configured such that standing wave nodes occur at the intersection of orthogonally situated striplines to minimize cross-polarization levels of the signals and the cross-talk between the two modes of operation.

68 Claims, 20 Drawing Sheets

U.S. PATENT DOCUMENTS

| | | | | |
|---|---|---|---|---|
| 6,917,332 | B2 * | 7/2005 | Aikawa et al. | 343/700 MS |
| 7,079,077 | B2 | 7/2006 | Lee | |
| 7,205,944 | B2 | 4/2007 | Lee | |
| 7,250,908 | B2 | 7/2007 | Lee | |
| 2003/0034920 | A1 | 2/2003 | Lee | |
| 2003/0201937 | A1 | 10/2003 | Lee | |
| 2004/0080455 | A1 | 4/2004 | Lee | |
| 2005/0168383 | A1 | 8/2005 | Lee | |
| 2005/0253764 | A1 | 11/2005 | Lee | |
| 2006/0092080 | A1 | 5/2006 | Lee | |

FOREIGN PATENT DOCUMENTS

| | | | |
|---|---|---|---|
| FR | 2799580 | A | 4/2001 |

OTHER PUBLICATIONS

Lee et al., "Linear Microstrip Array Antenna With a Single Feed Network," *Microwave and Optical Technology Letters*, Oct. 1999, pp. 25-27, vol. 23, No. 1, John Wiley & Sons, Inc., U.S.A.

Lee et al, "Planar Dual-Band Microstrip Antenna," *IEEE Transactions on Antennas and Propagation*, Aug. 1995, pp. 892-895, vol. 43, No. 8.

Lee, Choon Sae, "Cylindrical Double Layer Microstrip Array Antenna," U.S. Appl. No. 10/131,990, filed Apr. 25, 2002.

Daniel, J. P. et al: "Antennes Impremees: Reseaux Plans et Technologie", Toute L'Electronique, Societe des Editions Radio. Paris FR, No. 549, Dec. 1, 1989, pp. 32-37 (XP000080039).

Legay, H. et al: "Planar Resonant Series-Fed Arrays", IEEE Proceedings: Microwaves, Antennas and Propagation, IEEE, Stevenage, Herts, GB, vol. 144 No. 2, Apr. 11, 1997, pp. 67-72 (XP006008752).

Shun-Shi Zhong, et al: "Corner-Fed Microstrip Antenna Element and Arrays for Dual-Polarization Operation", IEEE Transactions on Antennas and Propagation, IEEE Inc., New York US, vol. 10 No. 50, Oct. 2002, pp. 1473-1480 (XP001141171; ISSN: 0018-926X); section III: dual-polarized corner-fed microstrip arrays.

Daniel, J. P. et al: "Antennes Impremees: Reseaux Plans et Technologie", Toute L'Electronique, Societe des Editions Radio. Paris FR, No. 549, Dec. 1, 1989, pp. 32-37 (XP000080039).

Wight, J.S.; "A Microstrip and Stripline Crossover Structure"; IEEE Transactions on Microwave Theory and Techniques, vol. MTT-24, No. 5, May 1976; Piscataway, New York.

Daniel, J.P. et al; "Printed Antenna Arrays: Examples of Commercial Applications"; Antennas and Propagation for Wireless Communications, 1998; 1998 IEEE-APS Conference on Waltham, MA, USA Nov. 1-4, 1998, New York, NY USA, IEEE, US, Nov. 1, 1998.

Japanese Patent Application No. 2007-509429; Translation of Official Action; Feb. 27, 2009.

Korean Patent Application No. 10-2006-7024003; Notice of Preliminary Rejection (English Translation); Mar. 17, 2009.

* cited by examiner

MICROSTRIP ARRAY ANTENNA

TECHNICAL FIELD

A single dielectric layer multipatch, microstrip array antenna design contained in a leaky cavity, to distribute EM (electromagnetic) power between radiating patches and a feed source.

BACKGROUND

The invention relates generally to antennas and, more particularly, to microstrip array antennas.

The number of direct satellite broadcast services has substantially increased worldwide and, as it has, the worldwide demand for antennas having the capacity for receiving such broadcast services has also increased. This increased demand has typically been met by reflector, or "dish," antennas, which are well known in the art. Reflector antennas are commonly used in residential environments for receiving broadcast services, such as the transmission of television channel signals, from geostationary, or equatorial, satellites. Reflector antennas have several drawbacks, though. For example, they are bulky and relatively expensive for residential use. Furthermore, inherent in reflector antennas are feed spillover and aperture blockage by a feed assembly, which significantly reduces the aperture efficiency of a reflector antenna, typically resulting in an aperture efficiency of only about 55%.

An alternative antenna, such as a microstrip antenna, overcomes many of the disadvantages associated with reflector antennas. Microstrip antennas, for example, require less space, are simpler and less expensive to manufacture, and are more compatible than reflector antennas with printed-circuit technology. Microstrip array antennas, i.e., microstrip antennas having an array of microstrips, may be used with applications requiring high directivity. Microstrip array antennas, however, typically require a complex microstrip feed network which contributes significant feed loss to the overall antenna loss. Furthermore, many microstrip array antennas are limited to single polarization and to transmitting or receiving only a linearly polarized beam. Such a drawback is particularly significant in many parts of the world where broadcast services are provided using only circularly polarized beams. In such instances, the recipients of the services must resort to less efficient and more expensive, bulky reflector antennas, or microstrip array antennas which utilize a polarizer. A polarizer, however, introduces additional power loss to the antenna and produces a relatively poor quality radiation pattern. Moreover, when dual polarization is needed, two antennas of single polarization are required.

What is needed, then, is a low-cost, simple to manufacture and compact antenna having a high aperture efficiency, and which does not require a complex feed network, and which may be readily adapted for transmitting and/or receiving either linearly polarized or circularly polarized beams of single or dual polarization.

SUMMARY OF THE INVENTION

The present invention, accordingly, provides for a low-cost, compact antenna having a high aperture efficiency, and which does not require a complex feed network, which can be readily adapted for transmitting and/or receiving either linearly polarized or circularly polarized beams, and which has a dual-polarization capability. To this end, a microstrip antenna of the present invention includes a single dielectric layer with a conductive ground plane disposed on one side, and an array of spaced apart radiating patches disposed on the other side of the dielectric layer to form a leaky cavity. Responsive to electromagnetic energy, a directed beam is transmitted from and/or received into the antenna.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
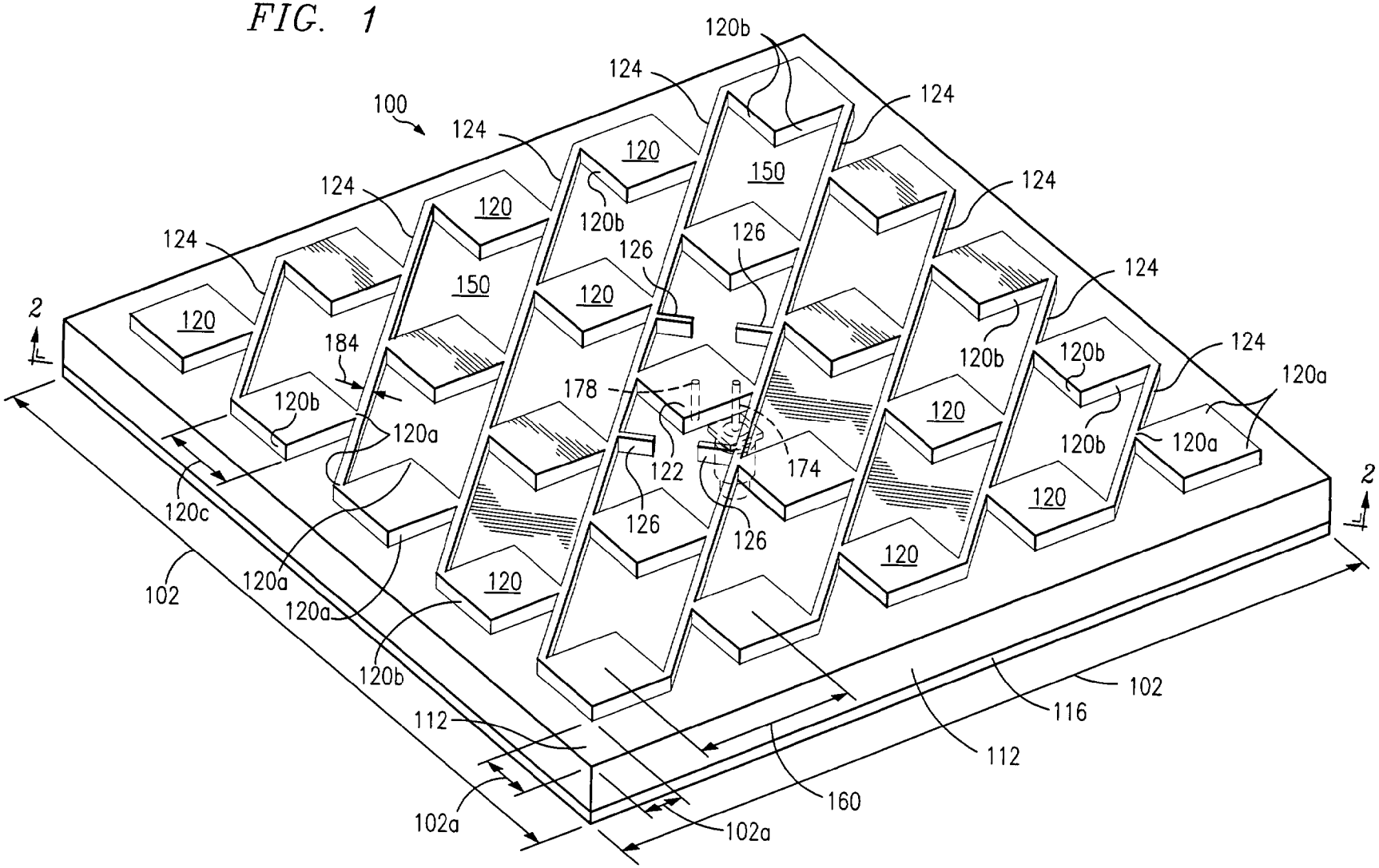
FIG. 1 is a perspective view of a planar array antenna.

In the following discussion of the drawings, certain depicted elements are, for the sake of clarity, not necessarily shown to scale, and like or similar elements are designated by the same reference numeral through the several views.

Two types of antennas are described hereinafter. One is a linearly polarized antenna that has one feed for a single-mode operation. In this embodiment, crisscrossing or intersecting stripline conductors are not required and the structure is simpler. The other is a dual-mode antenna with two input feeds that are operational independently each other and has crisscrossing or intersecting stripline conductors connecting the patches to the feed connectors.

In the dual mode configuration, the antenna acts as two antennas superimposed. Such an antenna may use two feed terminals with the stripline conductors of one terminal being orthogonal to the stripline conductors of the other terminal. Each of the patches in the antenna are connected at one corner, or other point at which two orthogonal modes can be excited, of a patch to a stripline conductor of a first orientation and at an adjacent corner or point to a stripline conductor of a second directional (orthogonal) orientation. In this embodiment, the placement of the patches and the stripline conductors are such that nodes of the standing wave are coincident with the stripline intersections to reduce the cross-polarization level and cross talking. The occurrence of the standing wave nodes at each of the stripline conductors produces a predetermined or predefined desirable field distribution.

For a maximum directivity of the antenna, the design would be such to provide uniform distribution of power among the radiating patches. When configured for a uniform field distribution, all the patches may be the same physical size and all the interconnecting striplines may retain the same dimensions, thus greatly simplifying the design process and manufacturing tolerances. This is in contrast to prior art designs requiring a number of different parameters for the striplines interconnecting the radiating patch elements to obtain a relatively uniform field distribution among the radiating patches for maximum directivity.

On the other hand, in some applications, a tapered distribution across the radiating patches is preferred to reduce sidelobes despite the fact that the directivity may have to be reduced from an optimum value.

A dual-mode antenna, as presented herein, can produce two orthogonal linearly polarized radiations or, with some modifications in the feed area, two orthogonal circularly polarized (i.e., right-handed and left-handed) radiations. It will be realized that the dual-mode antenna can be used for a single-mode operation simply by not using the other port. It should also be realized that for optimum results, in a dual mode antenna, the radiating patches should have two-fold symmetry.

The stripline conductors, alternatively just striplines in the art, form part of the surface of the leaky cavity and thus influence the resonant frequency of the cavity while facilitating the power flow among the radiating patch elements. The striplines act to guide the power flow properly so that the leaked power is channeled in the desired direction, namely radiation, while minimizing other factors to maximize the antenna efficiency. In prior art antennas, the striplines serve as a conductive path by which the traveling wave is transferred from the feed to the radiating patches. In the present context, the stripline serves as a channel to bridge the patches and the feed such that energy flows back and forth, thus resulting in some form of standing wave on the channel bridge. As used hereinafter in this document, the word stripline is intended to apply to any conductive material, other than the radiating patches, that further encloses the cavity and exists on the surface of the dielectric opposite the ground plane, that is used to guide the power flow in the form of a traveling wave, standing wave or combination of the two.

In view of the multiple embodiments possible in such a single-dielectric layer antenna using both standing and traveling waves, a plurality of configurations from simple to complex are illustrated and discussed in the following paragraphs.

It is noted that, unless specified otherwise, $\lambda_o$ is understood to be the wavelength of a beam of EM energy in free space (i.e., $\lambda_o$=c/f, where c is the speed of light in free space, and f is the frequency of the beam), and that $\lambda_\epsilon$ is understood to be the wavelength of a beam of EM energy in a dielectric medium (i.e., $\lambda_\epsilon$=v/f, where v is the speed of light in the dielectric medium). It is further understood that, as used herein, elements referred to as "strips," "patches," "striplines," "stubs," and "transmission lines" constitute conductive microstrips, which preferably have a thickness of approximately 1 mil (0.001 inch). Ground planes and edge conductors, preferably, also have a thickness of approximately 1 mil, but may be thicker (e.g., 0.125 inches), if desired, for providing structural support to a respective antenna. It is understood that thickness is generally measured in a direction perpendicular to the surface of dielectric to which the microstrips, ground planes, or edge conductors are respectively bonded.

It is further noted that, unless specified otherwise, dielectric material used in accordance with the present invention (in other than cables) is preferably fabricated from a mechanically stable material having a relatively low dielectric constant. A dielectric layer may be suitably multilayered to provide a desired dielectric constant. The single dielectric layer, whether or not composite, preferably, has a thickness of between $0.003\lambda_\epsilon$ and $0.050\lambda_\epsilon$, although it may have a greater thickness for greater bandwidths.

It is further noted that reference to a high-order standing wave, as used herein, comprises one of the high-order standing waves defining modes other than a fundamental mode.

It is still further noted that, as used herein (unless indicated otherwise), ground planes, edge conductors, microstrips (e.g., strips and patches), and the like, preferably comprise conductive materials such as copper, aluminum, silver, and/or gold. Reference made herein to the bonding of such conductive materials to a dielectric material may, preferably, be achieved using conventional printed-circuit, metallizing, decal transfer, monolithic microwave integrated circuit (MMIC) techniques, chemical etching techniques, or any other suitable technique. For example, in accordance with a chemical etching technique, a dielectric layer may be clad to one of the aforementioned conductive materials. The conductive material may then be selectively etched away from the dielectric layer using conventional chemical etching techniques, to thereby define any of the microstrip patterns described herein. Where applicable, a second dielectric layer may be bonded to the surface of the aforementioned dielectric having the conductive material, using any suitable technique, such as by creating a bond with very thin (e.g., 1.5 mil) thermal bonding film.

It is still further noted that reference is made in the following description of the present invention to the use of calculations and analyses, such as the cavity model and the moment method, discussed, for example, by C. S. Lee, V. Nalbandian, and F. Schwering in an article entitled "Planar dual-band microstrip antenna", published in the *IEEE Transactions on Antennas and Propagation*, Vol. 43, pp. 892-895, Aug. 1995, and by T. H. Hsieh, "Double-layer Microstrip Antenna", published as a Ph.D. dissertation in the Electrical Engineering Department at Southern Methodist University in 1998. Both of these articles are hereby incorporated in their entirety by reference, and will together be referred to hereinafter as "Lee and Hsieh".

Medium-Gain Antenna Applications (for Base-Station Antennas)

FIGS. 1-3

Figure 2:
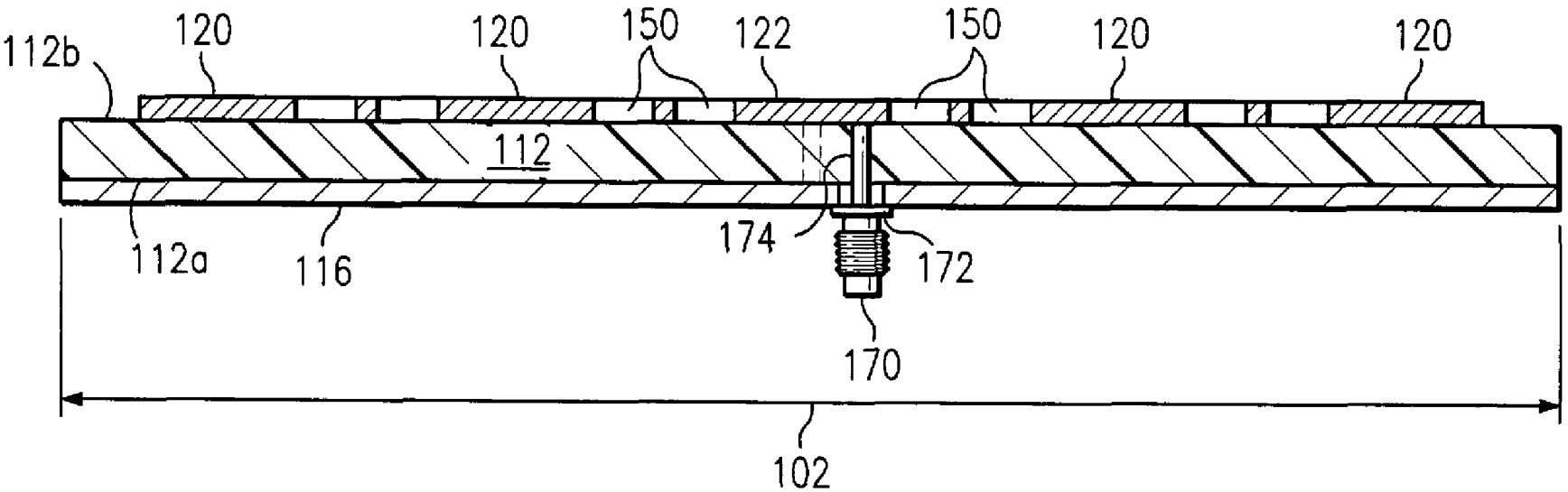
FIG. 2 is an elevation cross-sectional view of the antenna of FIG. 1 taken along the line 2-2 of FIG. 1.

Referring to FIGS. 1 and 2, the reference numeral 100 designates, in general, a planar microstrip array antenna embodying features of the present invention for transmitting and receiving beams. The antenna 100 preferably includes a generally square, dielectric layer 112. The width 102 and length 102 of the layer 112 are determined by the number and spacing of patches used, discussed below, and, preferably, extends a width and length 102*a* of at least $0.50\lambda_\epsilon$ beyond the outer edges of patches 120.

As shown most clearly in FIG. 2, the dielectric layer 112 defines a bottom side 112*a* to which a conductive ground plane 116 is bonded, and a top side 112*b* to which an array of conductive radiating patches 120 and a center radiating patch 122 are bonded for forming a radiating cavity within the dielectric layer 112, between the patches 120, 122, the striplines 124 and the ground plane 116. Referring back to FIG. 1, the patches 120 and 122 are generally square in shape, each having four corners 120*a* and four radiating edges 120*b*, each edge preferably having a length 120*c* of about $0.50\lambda_\epsilon$. The patches 120 and 122 are electrically interconnected via either one corner 120*a* or two diametrically opposed corners 120*a* to an array of substantially parallel conductive striplines 124. Four tuning stubs 126 extend perpendicularly from two striplines 124. The patches 120 and 122 are preferably spaced apart by a center-to-center distance 160 of approximately $1.0\lambda_\epsilon$. The patches 120 and 122 are preferably arranged in a square array on the top surface 112*b* preferably having an equal number of rows and columns of patches 120 and 122, exemplified in FIG. 1 as a square array having five rows and columns of patches 120 and 122 for a total of twenty-five patches 120 and 122 that constitute the antenna 100. The width 184 of each stripline 124 and the width and length of each stub 126 is preferably determined assuming a characteristic impedance of about 50 to 200 ohms. A shortening pin 178 is preferably disposed in the antenna 100 electrically connecting the ground plane 116 to the center patch 122 to suppress unwanted mode excitations. Additional shortening pins (not shown) may also be disposed in the antenna 100 connecting the ground plane 116 to patches 120 to further suppress unwanted mode excitations. Alternatively, in some instances, it may be preferable to omit one or all shortening pins 28 from the antenna 100.

For optimal performance at a particular frequency, the dimensions of the patches 120 and 122, the striplines 124, the stubs 126, the apertures 150, and the center-to-center spacing 160, are individually calculated so that a high-order standing wave is generated in the antenna cavity formed within the dielectric 112, and so that fields radiated from the radiating edges 120*b* interfere constructively with one another to give desired antenna characteristics, such as a high directivity. The number of patches 120 and 122 determines not only the overall size, but also the directivity, of the antenna 100. The sidelobe levels of the antenna 100 are determined by the field distribution among the radiating elements 120. Therefore, antenna characteristics, such as directivity and sidelobe levels, are controlled by the size and the position of each of the patches 120 and 122 and the feeding scheme. To achieve high directivity, the field distribution among the radiating elements is assumed to be as uniform as possible. The foregoing calculations and analysis utilize techniques, such as the cavity-model method and the moment method, discussed, for example, by Lee and Hsieh and will, therefore, not be discussed in further detail herein.

A conventional SMA (SubMinature type A) probe 170 is provided for transmitting or receiving beams. Each SMA probe 170 includes, for delivering EM energy to and/or from the antenna 100, an outer conductor 172 which is electrically connected to the ground plane 116, and an inner (or feed) conductor 174 which is electrically connected to the center patch 122. The probe 170 is positioned along a diagonal of the patch 122 proximate to the stripline 124 to optimize the impedance matching of the antenna 100. While it is preferable that the probes 170 be SMA probes, any suitable coaxial probe and/or connection arrangement may be used to implement the foregoing connections. For example, a conductive adhesive (not shown) may be used to bond and maintain contact between the inner conductor 174 and the center patch 122, and an appropriate seal (not shown) may be provided where the SMA probe 170 passes through the ground plane 116 to hermetically seal the connection. It is understood that the other end of the SMA probe 170, not connected to the antenna 100, is connectable via a cable (not shown) to a signal generator or to a receiver, such as a satellite signal decoder used with television signals.

In operation, the antenna 100 may be used for receiving or transmitting linearly polarized (LP) EM beams. To exemplify how the antenna 100 may be used to receive a beam, the antenna 100 may be positioned in a residential home and directed for receiving from a geostationary, or equatorial, satellite a beam carrying a television signal within a predetermined frequency band or channel. The antenna 100 is so directed by orienting the top surface 112*b* toward the source of the beam so that it is generally perpendicular to the direction of the beam. Assuming that the elements of the antenna 100 are correctly sized for receiving the beam, then the beam will pass through the apertures 150 and induce a standing wave, which will resonate within the dielectric layer 112. A standing wave induced in the resonant cavity defined by the dielectric layer 112 is communicated through the SMA probe 170 to a receiver, such as a decoder (not shown). It is well known that antennas transmit and receive signals reciprocally. It can be appreciated, therefore, that operation of the antenna 100 for transmitting signals is reciprocally identical to that of the antenna for receiving signals. The transmission of signals by the antenna 100 will, therefore, not be further described herein.

It is understood that the present invention can take many forms and embodiments. The embodiments described with respect to FIGS. 1 and 2 are intended to illustrate rather than to limit the invention. Accordingly, several variations may be made in the foregoing without departing from the spirit or the scope of the invention. For example, additional patches 120 may be provided for narrowing a beam, or fewer patches 120 may be utilized to reduce the physical space required for the antenna 100 of the present invention. The embodiments of FIGS. 1 and 2 may be configured in a triangular structure for use in a telecom cell. The stubs 126 may be reconfigured to form alternate embodiments, one of which is exemplified and discussed in greater detail below with respect to FIG. 3.

Figure 3:
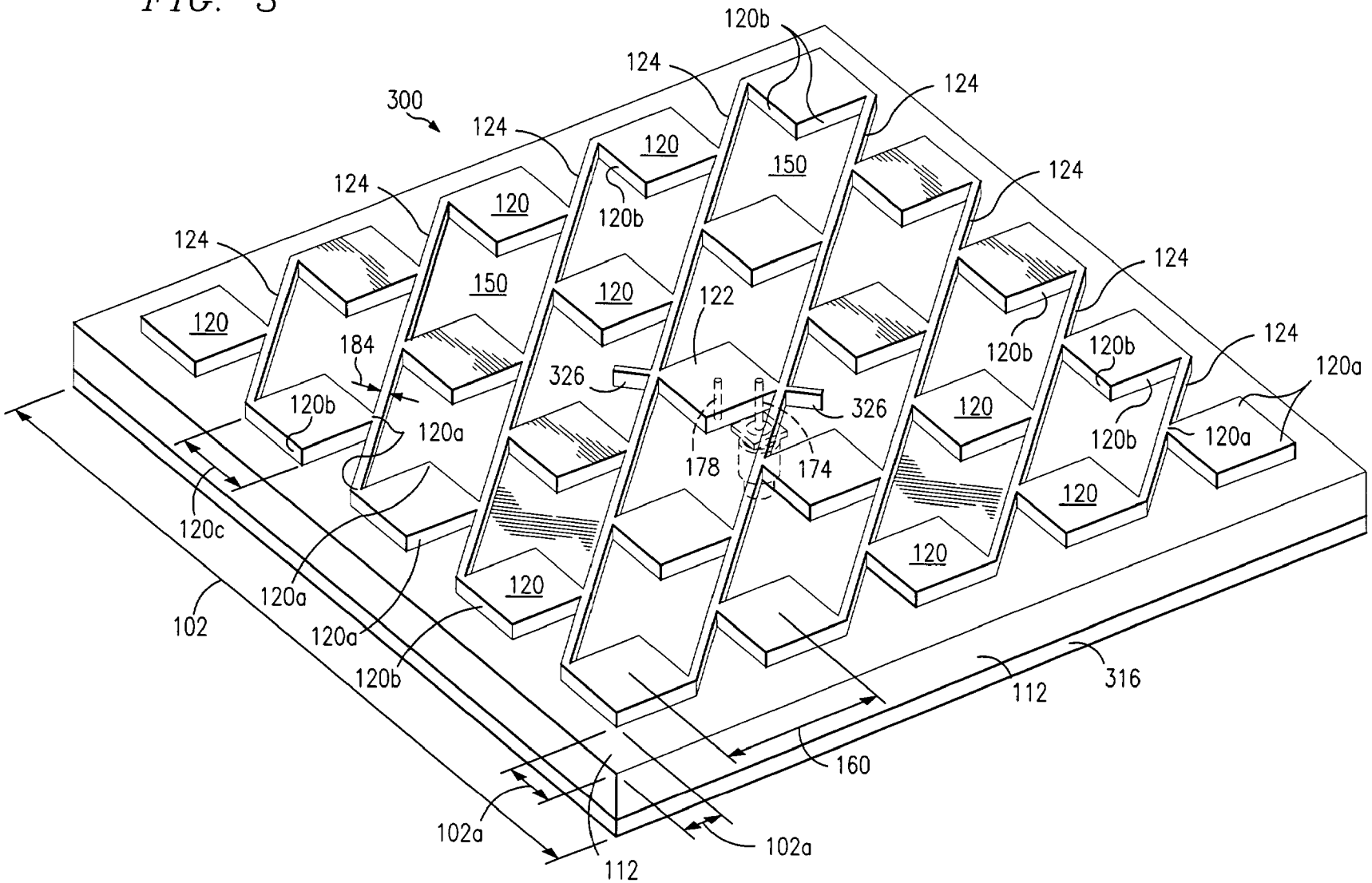
FIG. 3 is a perspective view of an alternate embodiment of the planar array antenna of FIG. 1.

FIG. 3 depicts the details of a single mode antenna 300 according to an alternate embodiment of the present invention. Since the antenna 300 contains many elements that are identical to those of the antenna 100, these elements are referred to by the same reference numerals and will not be described in any further detail. According to the embodiment of FIG. 3, and in contrast to the embodiment of FIG. 1, the four stubs 126 are replaced by two stubs 326 which extend outwardly along a line extending diagonally across the center patch 122. Operation of the antenna 300 depicted in FIG. 3 is otherwise substantially similar to the operation of the antenna 100 depicted in FIG. 1.

FIGS. 4-7

Figure 4:
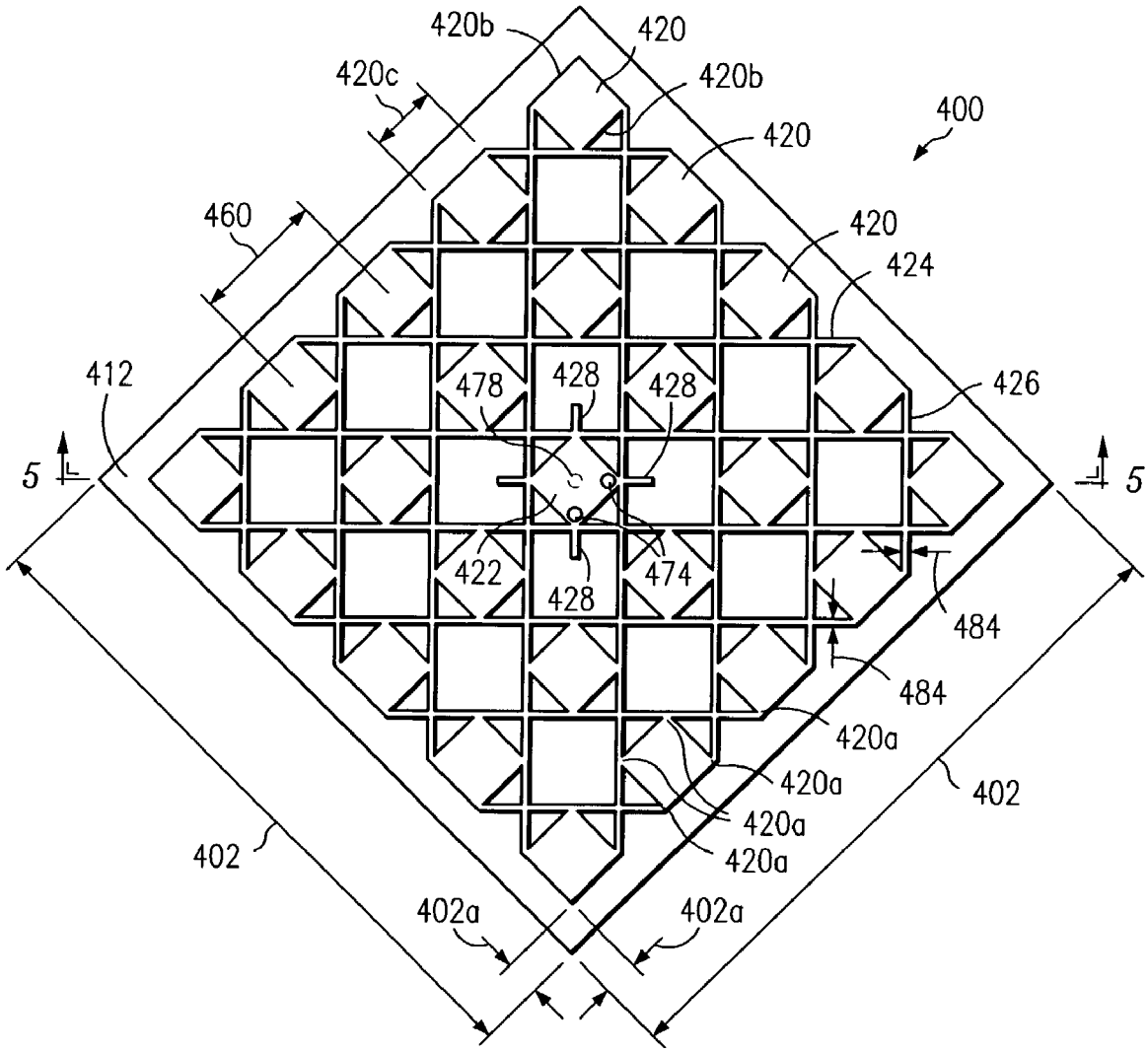
FIG. 4 is a plan view of a planar array antenna.
Figure 5:
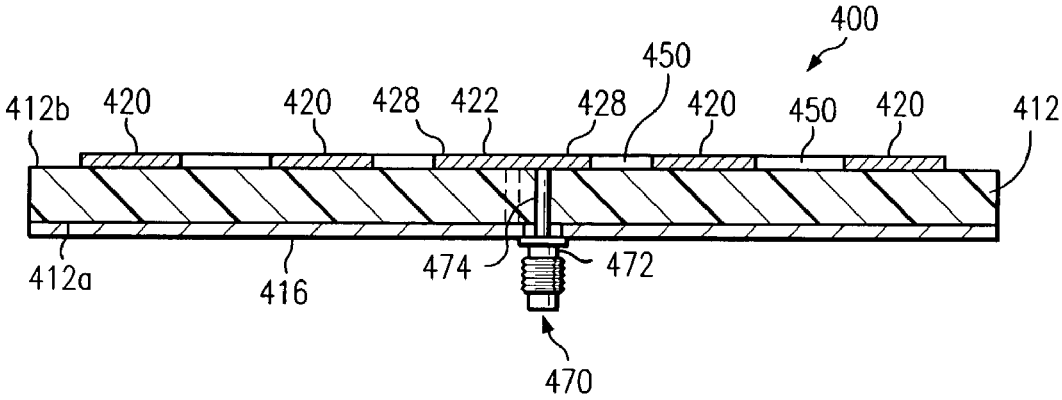
FIG. 5 is an elevation cross-sectional view of the antenna of FIG. 4 taken along the line 5-5 of FIG. 4.

Referring to FIGS. 4 and 5, the reference numeral 400 designates, in general, a planar microstrip array antenna embodying features of the present invention for dual-mode operation, such as transmitting and/or receiving EM beams. The antenna 400 preferably includes a generally square, dielectric layer 412. The width 402 and length 402 of the layer 412 is determined by the number of patches used, discussed below, and, preferably, extends a width and length 402*a* of at least $0.50\lambda_\epsilon$ beyond the outer edges of patches 420.

As shown most clearly in FIG. 5, the dielectric layer 412 defines a bottom side 412*a* to which a conductive ground plane 416 is bonded, and a top side 412*b* to which an array of conductive radiating patches 420 and a center radiating patch 422 are bonded for forming a resonant cavity within the dielectric layer 412 between the patches 420 and 422, striplines 424 and 424, and the ground plane 416. Referring back to FIG. 4, the patches 420 and 422 are generally square in shape, each having four corners 420*a* and four radiating edges 420*b*, each having a length 420*c* of about $0.50\lambda_\epsilon$. As viewed in FIG. 4, the patches 420 and 422 are electrically interconnected via corners 420*a* to an array of substantially parallel horizontal conductive striplines 424 and an array of substantially parallel vertical conductive striplines 426 bonded to the dielectric layer 412. Four tuning stubs 428 extend diagonally outwardly from the corners 420*a* of the center patch 422 and from the horizontal striplines 424 and vertical striplines 426, and are also bonded to the dielectric layer 412. The patches 420 and 422 are preferably spaced apart by a center-to-center distance 460 of slightly less than $1.0\lambda_\epsilon$. The patches 420 and 422 are preferably arranged in a square array on the top surface 412*b* having an equal odd number of rows and columns (viewed at 45° angles to horizontal in FIG. 4) of patches 420 and 422, exemplified in FIG. 4 as a square array having five rows and five columns of patches 420 and 422 for a total of twenty-five patches 420 and 422 that constitute the antenna 400. The width 484 (FIG. 4) of each stripline 424 and 426 and the width of each stub 428 are preferably determined assuming a characteristic impedance of about 50 to 200 ohms. A shortening pin 478 is preferably disposed in the antenna 400 electrically connecting the ground plane 416 to the center patch 422 to suppress unwanted mode excitations. Additional shortening pins (not shown) may also be disposed in the antenna 400 connecting the ground plane 416 to patches 420 to further suppress unwanted mode excitations. Alternatively, in some instances, it may be preferable to omit one or all shortening pins 478 from the antenna 400.

For optimal performance at a particular frequency, the dimensions of the patches 420 and 422, the striplines 424 and 426, the stubs 428, the apertures 450, and the center-to-center spacing 460 are individually calculated so that a high-order standing wave is generated in the antenna cavity formed within the dielectric 412, and so that fields radiated from the radiating edges 420*b* interfere constructively with one another.

The number of patches 420 and 422 determines not only the overall size, but also the directivity, of the antenna 400. The sidelobe levels of the antenna 400 are determined by the field distribution among the radiating elements 420. Therefore, antenna characteristics, such as directivity and sidelobe levels, are controlled by the size and the position of each of the patches 420 and 422 and the feeding scheme. To achieve high directivity, the field distribution among the radiating elements 420 is assumed to be as uniform as possible. There are electric field null points in the dielectric layer 412 within the patches 420 and 422 and the connecting striplines 424 and 426. The foregoing calculations and analysis utilize techniques, such as the cavity model, discussed, for example, by Lee and Hsieh, and the moment method, discussed, for example, in the software Ensemble™ available from Ansoft Corp located in Pittsburgh, Pa., and will, therefore, not be discussed in further detail herein.

Preferably, two conventional SMA probes 470 are provided for dual mode operation, such as transmitting or receiving beams. Each SMA probe 470 includes, for delivering EM energy to and/or from the antenna 400, an outer conductor 472 which is electrically connected to the ground plane 416, and an inner (or feed) conductor 474 which is electrically connected to the center patch 422. The probe 470 is positioned along a diagonal of the patch 422 proximate to the striplines 424 and 426 to optimize the impedance matching of the antenna 400, and reduce cross-talking and cross-polarization. While it is preferable that the probes 470 be SMA probes, any suitable coaxial probe and/or connection arrangement may be used to implement the foregoing connections. For example, a conductive adhesive (not shown) may be used to bond and maintain contact between the inner conductor 474 and the center patch 422, and an appropriate seal (not shown) may be provided where the SMA probe 470 passes through the ground plane 416 to hermetically seal the connection. It is understood that the other end of the SMA probe 470, not connected to the antenna 400, is connectable via a cable (not shown) to a signal generator or to a receiver, such as a satellite signal decoder used with television signals.

In operation, the antenna 400 may be used for receiving or transmitting linearly polarized (LP) EM beams. To exemplify how the antenna 400 may be used to receive a beam, the antenna 400 may be positioned in a residential home and directed for receiving from a geostationary, or equatorial, satellite a beam carrying a television signal within a predetermined frequency band or channel. The antenna 400 is so directed by orienting the top surface 412*b* toward the source of the beam so that it is generally perpendicular to the direction of the beam. Assuming that the elements of the antenna 400 are correctly sized for receiving the beam, then the beam will pass through the apertures 450 and induce a standing wave, which will resonate within the dielectric layer 412. A standing wave induced in the resonant cavity defined by the dielectric layer 412 is communicated through the SMA probe 470 to a receiver such as a decoder (not shown).

In the antenna 400, the vertical modal excitation becomes orthogonal to that of the horizontal mode so that the cross talk between the two input signals will be minimized. In other words, two orthogonal vertical and horizontal modes can be excited independently.

It is well known that antennas transmit and receive signals reciprocally. It can be appreciated, therefore, that operation of the antenna 400 for transmitting signals is reciprocally identical to that of the antenna for receiving signals. The transmission of signals by the antenna 400 will, therefore, not be further described herein.

Figure 6:
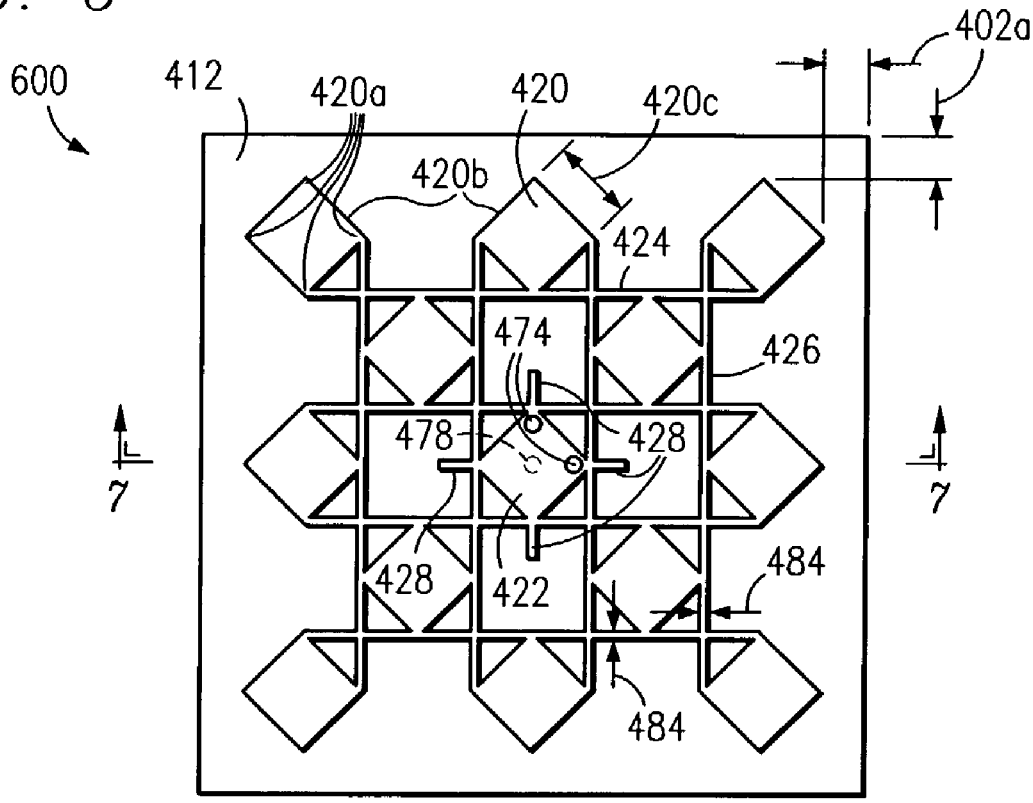
FIG. 6 is a plan view of a planar array antenna.
Figure 7:
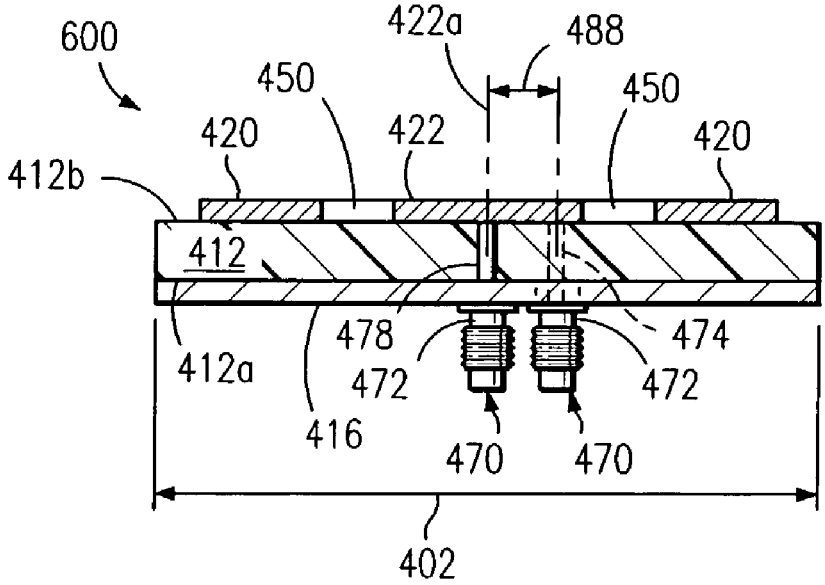
FIG. 7 is an elevation cross-sectional view of the antenna of FIG. 6 taken along the line 7-7 of FIG. 6.

It is understood that the present invention can take many forms and embodiments. The embodiments described with respect to FIGS. 4 and 5 are intended to illustrate rather than to limit the invention. Accordingly, several variations may be made in the foregoing without departing from the spirit or the scope of the invention. For example, additional patches 420 may be provided for narrowing a beam, or fewer patches 420 may be utilized to reduce the physical space required for the antenna 400 of the present invention. An embodiment utilizing fewer patches is exemplified in FIGS. 6 and 7 by an antenna 600. In another example, one of the two SMA probes 470 may be removed (or not attached) for single-mode operation in transmitting and receiving EM beams. The antenna 400 may also be used for receiving and/or transmitting circularly polarized (CP) EM beams. In some instances, it may be preferable to omit the shortening pin 478 from the antenna 400.

FIGS. 8-9

Figure 8:
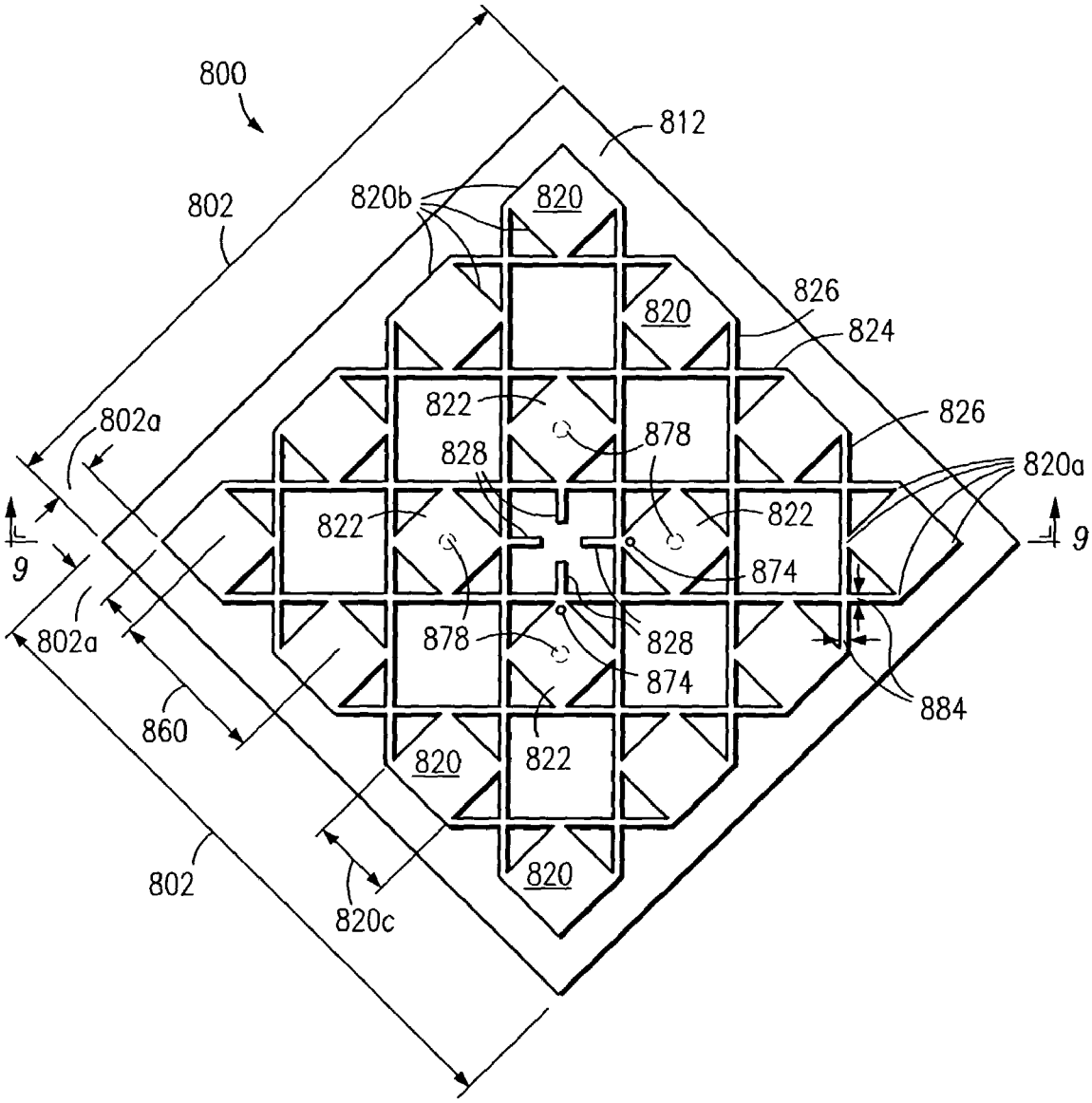
FIG. 8 is a plan view of a planar array antenna.
Figure 9:
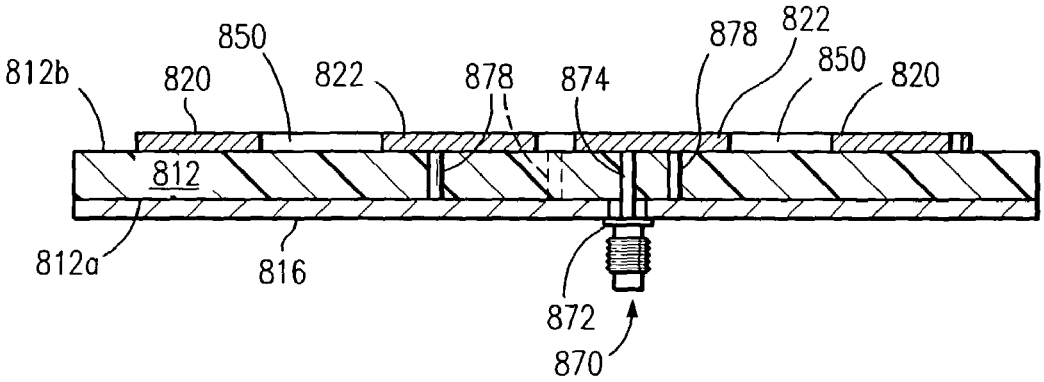
FIG. 9 is an elevation cross-sectional view of the antenna of FIG. 8 taken along the line 9-9 of FIG. 8.

Referring to FIGS. 8 and 9, the reference numeral 800 designates, in general, a planar microstrip array antenna embodying features of the present invention for dual-mode operation, such as transmitting and/or receiving EM beams. The antenna 800 preferably includes a generally square, dielectric layer 812. The width 802 and length 802 of the layer 812 is determined by the number of patches 820 used, discussed below, and, preferably, extends a width and length 802*a* of at least $0.50\lambda_\epsilon$ beyond the outer edges of the patches 820.

As shown most clearly in FIG. 9, the dielectric layer 812 defines a bottom side 812*a* to which a conductive ground plane 816 is bonded, and a top side 812*b* to which an array of conductive radiating patches 820 and four center radiating patches 822 are bonded for forming a resonant cavity within the dielectric layer 812 between the patches 820 and 822, the striplines 824, 826, and the ground plane 816. Referring back to FIG. 8, the patches 820 and 822 are generally square in shape, each having four corners 820*a* and four radiating edges 820*b*, each having a length 820*c* of about $0.50\lambda_\epsilon$. As viewed in FIG. 8, the patches 820 and 822 are electrically interconnected via corners 820*a* to an array of substantially parallel horizontal conductive striplines 824, and an array of substantially parallel vertical conductive striplines 826 bonded to the dielectric layer 812. A tuning stub 828 extends diagonally outwardly from a corner 820*a* of each center patch 822 and toward the center of the antenna 800. The stubs 828 are also bonded to the dielectric layer 812. The patches 820 and 822 are preferably spaced apart by a center-to-center distance 860 of slightly less than $1.0\lambda_\epsilon$. The patches 820 and 822 are preferably arranged in a square array on the top surface 812*b* having an equal even number of rows and columns (viewed at 45° angles to horizontal in FIG. 8) of patches 820 and 822, exemplified in FIG. 8 as a square array having four rows and four columns of patches 820 and 822 for a total of sixteen patches 820 and 822 that constitute the antenna 800. The width 884 (FIG. 8) of each stripline 824 and 826 and the width and length of each stub 828 is preferably determined assuming a characteristic impedance of about 50 to 200 ohms. A shortening pin 878 is preferably disposed in the antenna 800 electrically connecting the ground plane 816 to each center patch 822 to suppress unwanted mode excitations. Additional shortening pins (not shown) may also be disposed in the antenna 800 connecting the ground plane 816 to patches 820 to further suppress unwanted mode excitations. Alternatively, in some instances, it may be preferable to omit one or all shortening pins 878 from the antenna 800.

For optimal performance at a particular frequency, the dimensions of the patches 820 and 822, the striplines 824 and 826, the stubs 828, the apertures 850, and the center-to-center spacing 860 are individually calculated so that a high-order standing wave is generated in the antenna cavity formed within the dielectric 812, and so that fields radiated from the radiating edges 820*b* interfere constructively with one another.

The number of patches 820 and 822 determines not only the overall size, but also the directivity, of the antenna 800. The sidelobe levels of the antenna 800 are determined by the field distribution among the radiating elements 820 and 822. Therefore, antenna characteristics, such as directivity and sidelobe levels, are controlled by the size and the position of each of the patches 820 and 822 and the feeding scheme. To achieve high directivity, the field distribution among the radiating elements 820 and 822 is assumed to be as uniform as possible. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

Preferably, two conventional SMA probes 870 are provided for dual mode operation, such as transmitting or receiving beams. Each SMA probe 870 includes, for delivering EM energy to and/or from the antenna 800, an outer conductor 872 which is electrically connected to the ground plane 816, and an inner (or feed) conductor 874 which is electrically connected to a center patch 822. The two SMA probes 870 are thusly connected to two selected adjacent center patches 822. The probes 870 are positioned along a diagonal of the two selected respective center patches 822 proximate to the striplines 824 and 826 to optimize the impedance matching of the antenna 800, and reduce cross-talking and cross-polarization. While it is preferable that the probes 870 be SMA probes, any suitable coaxial probe and/or connection arrangement may be used to implement the foregoing connections. For example, a conductive adhesive (not shown) may be used to bond and maintain contact between the inner conductor 874 and the center patch 822, and an appropriate seal (not shown) may be provided where the SMA probe 870 passes through the ground plane 816 to hermetically seal the connection. It is understood that the other end of the SMA probe 870, not connected to the antenna 800, is connectable via a cable (not shown) to a signal generator or to a receiver such as a satellite signal decoder used with television signals.

In operation, the antenna 800 may be used for receiving or transmitting linearly polarized (LP) EM beams. To exemplify how the antenna 800 may be used to receive a beam, the antenna 800 may be positioned in a residential home and directed for receiving from a geostationary, or equatorial, satellite a beam carrying a television signal within a predetermined frequency band or channel. The antenna 800 is so directed by orienting the top surface 812*b* toward the source of the beam so that it is generally perpendicular to the direction of the beam. Assuming that the elements of the antenna 800 are correctly sized for receiving the beam, then the beam will pass through the apertures 850, and induce a standing wave which will resonate within the dielectric layer 812. A standing wave induced in the resonant cavity defined within the dielectric layer 812 is communicated through the SMA probes 870 to a receiver, such as a decoder (not shown).

In the antenna 800, the vertical modal excitation becomes orthogonal to that of the horizontal mode so that the cross talk between the two input signals may be minimized. In other words, two orthogonal vertical and horizontal modes can be excited independently.

It is well known that antennas transmit and receive signals reciprocally. It can be appreciated, therefore, that operation of the antenna 800 for transmitting signals is reciprocally identical to that of the antenna for receiving signals. The transmission of signals by the antenna 800 will, therefore, not be further described herein.

It is understood that the present invention can take many forms and embodiments. The embodiments described with respect to FIGS. 8 and 9 are intended to illustrate rather than to limit the invention. Accordingly, several variations may be made in the foregoing without departing from the spirit or the scope of the invention. For example, additional patches 820 may be provided for narrowing a beam, or fewer patches 820 may be utilized to reduce the physical space required for the antenna 800 of the present invention. In another example, one of the two SMA probes 870 may be removed (or not attached) for single-mode operation in transmitting or receiving EM beams. The antenna 800 may also be used for receiving and/or transmitting circularly polarized (CP) EM beams.

FIGS. 10-12

Figure 10:
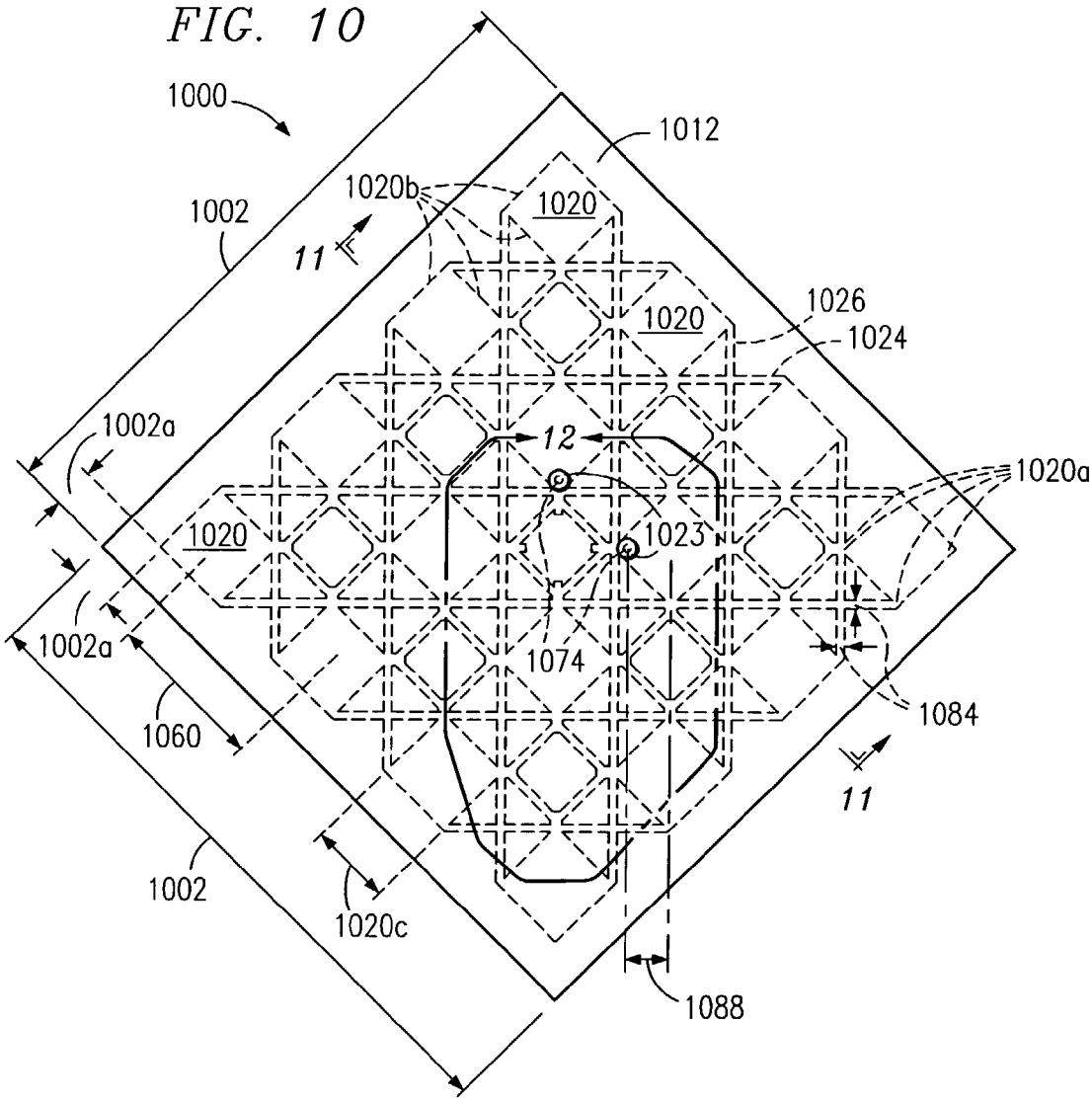
FIG. 10 is a plan view of a planar array antenna.
Figure 11:
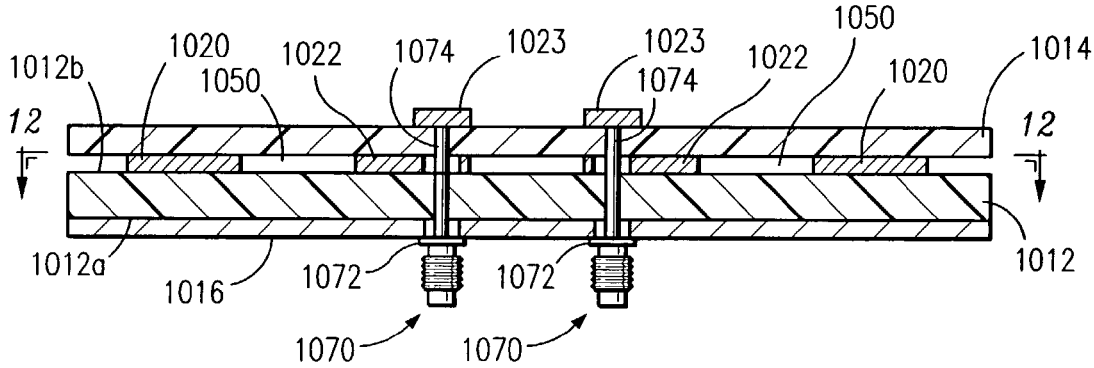
FIG. 11 is an elevation cross-sectional view of the antenna of FIG. 10 taken along the line 11-11 of FIG. 10.
Figure 12:
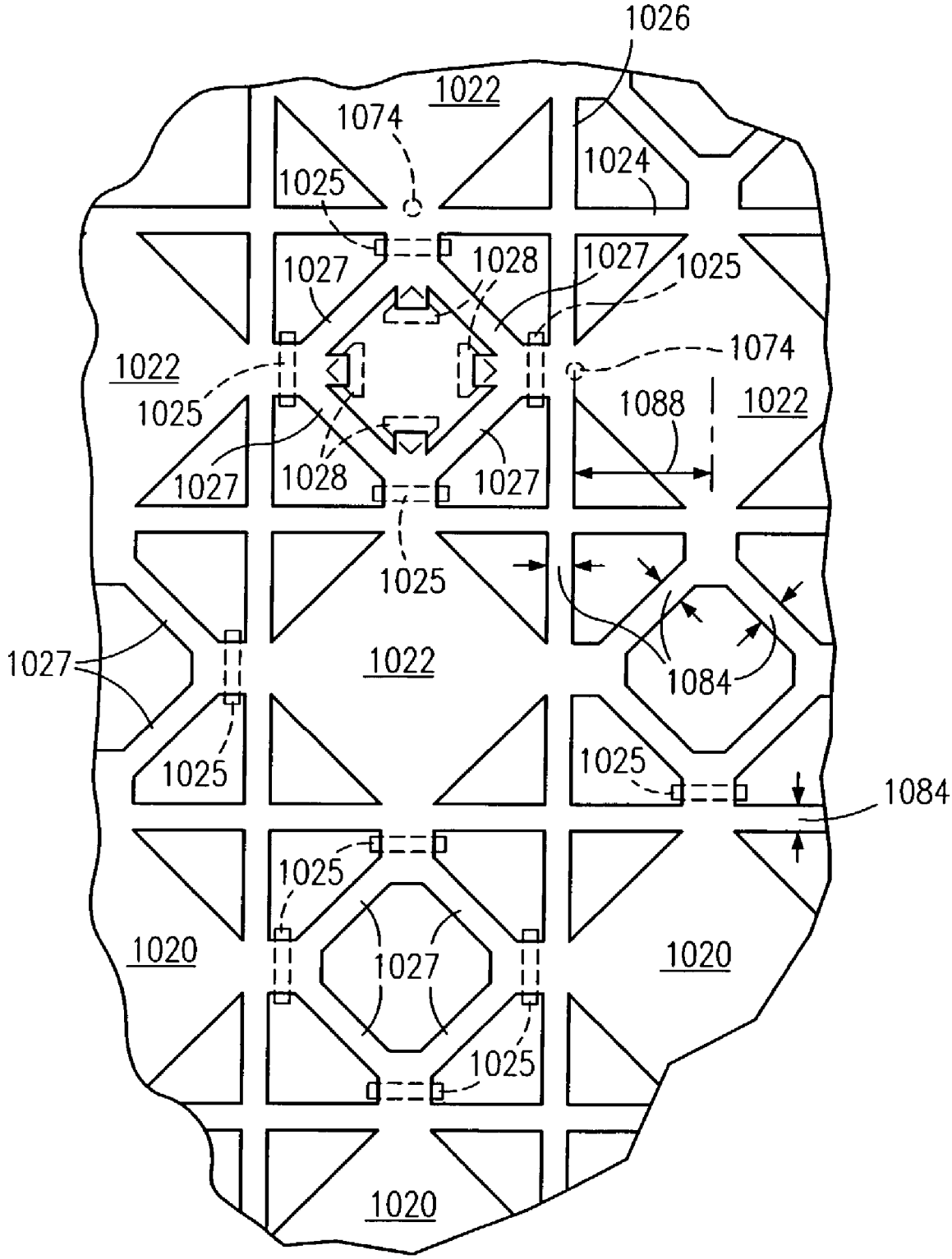
FIG. 12 is an enlarged view of a portion of the antenna of FIG. 11 circumscribed by the line 12 of FIG. 10.

Referring to FIGS. 10-12, the reference numeral 1000 designates, in general, a planar microstrip array antenna embodying features of the present invention for dual-mode operation, such as transmitting and/or receiving EM beams. The antenna 1000 preferably includes generally square, first and second dielectric layers 1012 and 1014. The width 1002 and length 1002 of the layers 1012 and 1014 are determined by the number of patches 1020 and 1022 used, discussed below, and, preferably, extends a width and length 1002*a* of at least $0.50\lambda_\epsilon$ beyond the outer edges of the patches 1020.

As shown most clearly in FIG. 11, the dielectric layer 1012 defines a bottom side 1012*a* to which a conductive ground plane 1016 is bonded, and a top side 1012*b* to which an array of conductive radiating patches 1020 and four center radiating patches 1022 are bonded for forming a resonant cavity within the dielectric layer 1012 between the patches 1020 and 1022, the striplines 1024 and 1026, and the ground plane 1016. The second dielectric 1014 is bonded to the top side 1012*b* of the dielectric 1012, such that the patches 1020 and 1022 are interposed between the dielectrics 1012 and 1014.

As shown most clearly in FIG. 12, the patches 1020 and 1022 are generally square in shape, each having four corners 1020*a* and four radiating edges 1020*b*, each having a length 1020*c* of about $0.50\lambda_\epsilon$. As viewed in FIG. 12, the patches 1020 and 1022 are electrically interconnected via corners 1020*a* to an array of substantially parallel horizontal conductive striplines 1024 and an array of substantially parallel vertical conductive striplines 1026 interposed between the dielectric layers 1012 and 1014. A stub 1025 interposed between the dielectric layers 1012 and 1014 extends across respective striplines 1024 and 1026 from corners 1020*a* of each patch 1020 and 1022. A stripline 1027 interposed between the dielectric layers 1012 and 1014 electrically connects each stub 1025 to two closest stubs 1025. A tuning stub 1028 interposed between the dielectric layers 1012 and 1014 extends outwardly from one stub 1025 of each center patch 1022 and toward the center of the antenna 1000 for impedance matching.

The patches 1020 and 1022 are preferably spaced apart by a center-to-center distance 1060 of slightly less than $1.0\lambda_\epsilon$. The patches 1020 and 1022 are preferably arranged in a square array on the top surface 1012*b* having an equal even number of rows and columns (viewed at 45° angles to horizontal in FIG. 10) of patches 1020 and 1022, exemplified in FIG. 12, as a square array having four rows and four columns of patches 1020 and 1022 for a total of sixteen patches 1020 and 1022 that constitute the antenna 1000. The width 1084 (FIG. 10) of each stripline 1024, 1026 and 1027, and the width and length of each stub 1025 and 1028 is preferably determined assuming a characteristic impedance of about 50 to 200 ohms. A shortening pin (not shown) may optionally be disposed in the antenna 1000 to electrically connect the ground plane 1016 to one or more patches 1020 and/or 1022 to suppress unwanted mode excitations. It should be noted that the use of stubs, such as 1025, in the planar antennas illustrated, provides impedance matching.

For optimal performance at a particular frequency, the dimensions of the patches 1020 and 1022, the striplines 1024, 1026 and 1027, the stubs 1025 and 1028, the apertures 1050, and the center-to-center spacing 1060 are individually calculated so that a high-order standing wave is generated in the antenna cavity formed within the dielectric 1012, and so that fields radiated from the radiating edges 1020*b* interfere constructively with one another. The number of patches 1020 and 1022 determines not only the overall size, but also the directivity, of the antenna 1000. The sidelobe levels of the antenna 1000 are determined by the field distribution among the radiating elements 1020 and 1022. Therefore, antenna characteristics, such as directivity and sidelobe levels, are controlled by the size and the position of each of the patches 1020 and 1022 and the feeding scheme. To achieve high directivity, the field distribution among the radiating elements 1020 and 1022 is assumed to be as uniform as possible. There are electric field null points in the dielectric layers 1012 and 1014 within the patches 1020 and 1022 and the connecting striplines 1024 and 1026. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

Preferably, two conventional SMA probes 1070 are provided for dual-mode operation, such as transmitting and receiving beams. As most clearly shown in FIG. 11, each SMA probe 1070 includes, for delivering EM energy to and/or from the antenna 1000, an outer conductor 1072 which is electrically connected to the ground plane 1016, and an inner (or feed) conductor 1074 which extends through openings formed in the ground plane 1016 and two center patches 1022, and is electrically connected to a patch 1023. The patch 1023 is preferably square, the sides of which have a length of about 2 millimeters (mm) to about 5 mm and, typically, from about 2.5 mm to about 4.5 mm and, preferably, about 3 mm. The two SMA probes 1070 are thus connected to two selected adjacent center patches 1022. The probes 1070 are positioned along a diagonal of the two selected respective center patches 1022 close to the striplines 1024 and 1026 to optimize the impedance matching of the antenna 1000, and reduce cross-talking and cross-polarization. While it is preferable that the probes 1070 be SMA probes, any suitable coaxial probe and/or connection arrangement may be used to implement the foregoing connections. For example, a conductive adhesive (not shown) may be used to bond and maintain contact between the inner conductor 1074 and the selected center patches 1022, and an appropriate seal (not shown) may be provided where the SMA probes 1070 pass through the ground plane 1016 to hermetically seal the connection. It is understood that the other ends of the SMA probes 1070, not connected to the antenna 1000, are connectable via a cable (not shown) to a signal generator or to a receiver, such as a satellite signal decoder used with television signals.

In operation, the antenna 1000 may be used for receiving or transmitting linearly polarized (LP) EM beams. To exemplify how the antenna 1000 may be used to receive a beam, the antenna 1000 may be positioned in a residential home and directed for receiving from a geostationary, or equatorial, satellite a beam carrying a television signal within a predetermined frequency band or channel. The antenna 1000 is so directed by orienting the top surface 1012*b* toward the source of the beam so that it is generally perpendicular to the direction of the beam. Assuming that the elements of the antenna 1000 are correctly sized for receiving the beam, then the beam will pass through the apertures 1050 (FIG. 11) and induce a standing wave that will resonate within the dielectric layer 1012. A standing wave induced in the resonant cavity defined within the dielectric layer 1012 is communicated through the SMA probes 1070 to a receiver, such as a decoder (not shown).

In the antenna 1000, the vertical modal excitation becomes orthogonal to that of the horizontal mode so that the cross talk between the two input signals will be minimized. In other words, two orthogonal vertical and horizontal modes can be excited independently.

It is well known that antennas transmit and receive signals reciprocally. It can be appreciated therefore that operation of the antenna 1000 for transmitting signals is reciprocally identical to that of the antenna for receiving signals. The transmission of signals by the antenna 1000 will, therefore, not be further described herein.

It is understood that the present invention can take many forms and embodiments. The embodiments described with respect to FIGS. 10-12 are intended to illustrate rather than to limit the invention. Accordingly, several variations may be made in the foregoing without departing from the spirit or the scope of the invention. For example, additional patches 1020 may be provided for narrowing a beam, or fewer patches 1020 may be utilized to reduce the physical space required for the antenna 1000 of the present invention. In another example, one of the two SMA probes 1070 may be removed (or not attached) for single-mode operation in transmitting and receiving EM beams. The antenna 1000 may also be used for receiving and/or transmitting circularly polarized (CP) EM beams.

FIGS. 13-15

Figure 13:
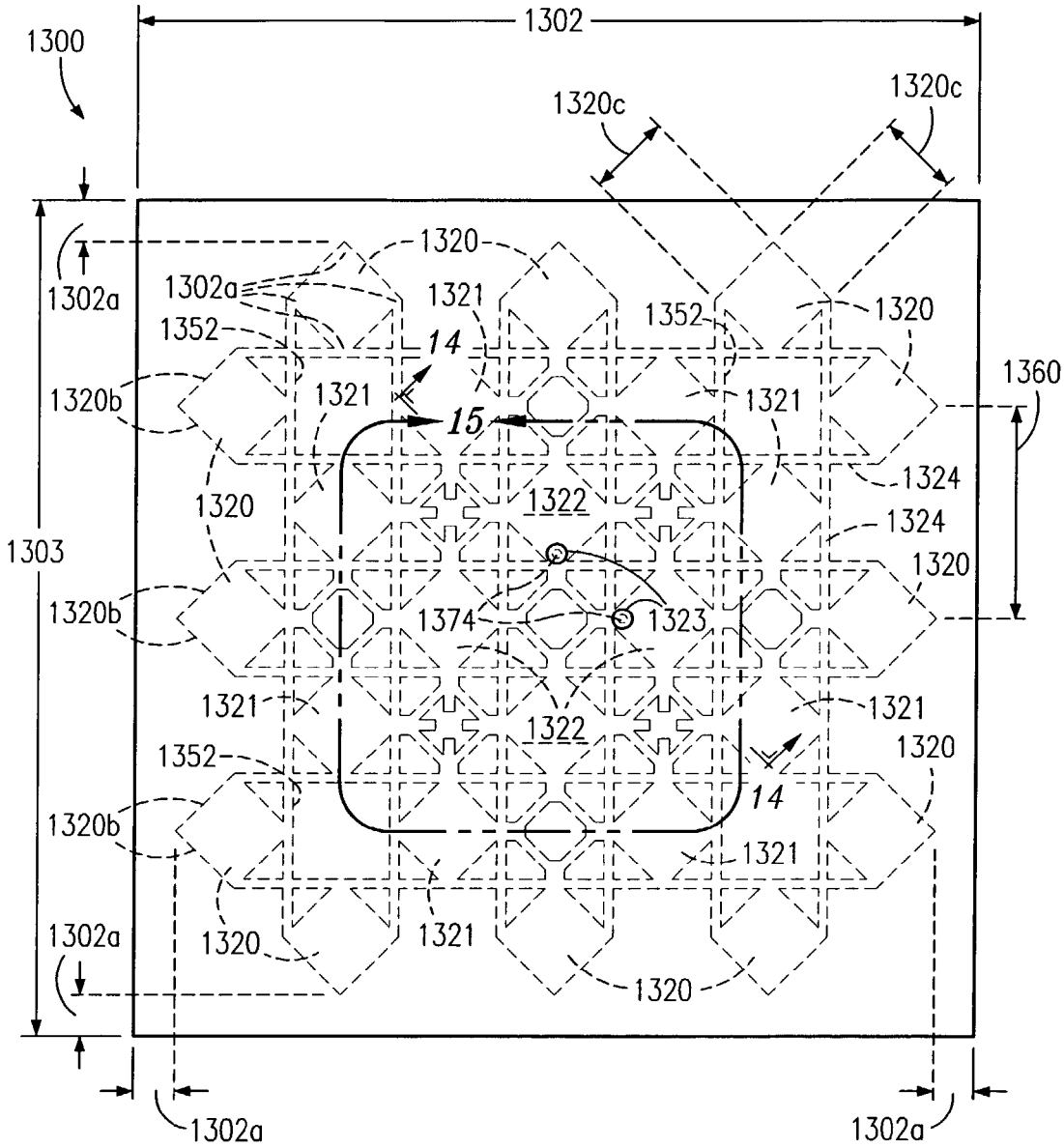
FIG. 13 is a plan view of a planar array antenna.
Figure 14:
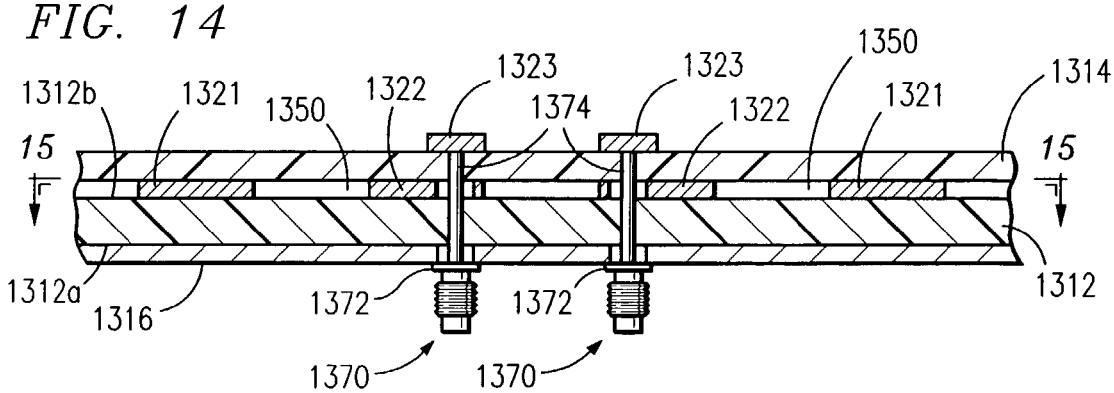
FIG. 14 is an elevation cross-sectional view of the antenna of FIG. 13 taken along the line 14-14 of FIG. 13.
Figure 15:
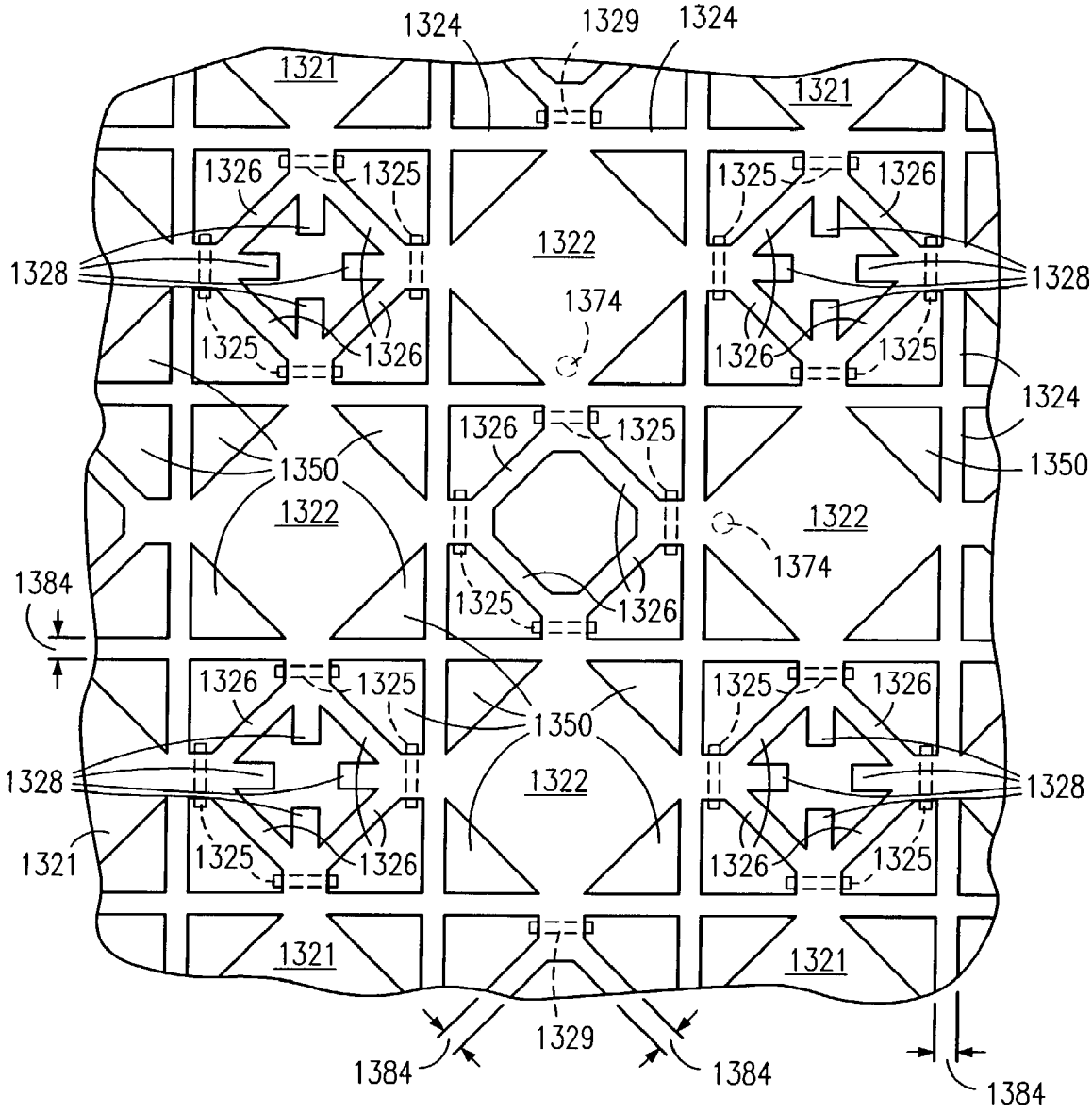
FIG. 15 is an enlarged view of a portion of the antenna of FIG. 13 circumscribed by the line 15 of FIG. 13.

Referring to FIGS. 13-15, the reference numeral 1300 designates, in general, a planar microstrip array antenna embodying features of the present invention for dual-mode operation, such as transmitting and/or receiving EM beams. The antenna 1300 preferably includes generally square, first and second dielectric layers 1312 and 1314. The width 1302 and length 1303 of the layers 1312 and 1314 are determined by the number of patches 1320 and 1322 used, discussed below, and, preferably, extends a width and length 1302*a* of at least $0.50\lambda_\epsilon$ beyond the outer edges of the patches 1320.

As shown most clearly in FIG. 14, the dielectric layer 1312 defines a bottom side 1312*a* to which a conductive ground plane 1316 is bonded, and a top side 1312*b* to which an array of preferably twelve exterior conductive radiating patches 1320 (FIG. 13), eight intermediate radiating patches 1321, and four interior radiating patches 1322 are bonded for forming a resonant cavity within the dielectric layer 1312 between the patches 1320, 1321 and 1322, the striplines 1324 and 1352 and the ground plane 1316. The second dielectric 1314 is bonded to the top side 1312*b* of the dielectric 1312, such that the patches 1320, 1321 and 1322 are interposed between the dielectrics 1312 and 1314.

As shown most clearly in FIG. 15, the patches 1320, 1321 and 1322 are generally square in shape, each having four corners 1320*a* and four radiating edges 1320*b*, each having a length 1320*c* of about $0.50\lambda_\epsilon$. As viewed in FIG. 15, the patches 1320, 1321 and 1322 are electrically interconnected via corners 1320*a* through an array of vertical and horizontal (as viewed in FIGS. 13 and 15) conductive striplines 1324 interposed between the dielectric layers 1312 and 1314. An interpatch area 1352 is defined within each space that is circumscribed by the striplines 1324 and that does not contain a patch 1320, 1321 or 1322. A stub 1325 interposed between the dielectric layers 1312 and 1314 extends across respective striplines 1324 into interpatch areas 1352 from each corner 1320*a* of each patch 1320, 1321 and 1322, that is adjacent to an interpatch area 1352 bounded by at least one interior patch 1322. A stripline 1326 interposed between the dielectric layers 1312 and 1314 electrically connects each stub 1325 to two closest stubs 1325. A tuning stub 1328 interposed between the dielectric layers 1312 and 1314 extends from each stub 1325 of each patch 1321 and 1322 that is adjacent to an interpatch area 1352 that is bounded by two intermediate patches 1321 and two interior patches 1322, for impedance matching.

The patches 1320, 1321 and 1322 are spaced apart by a center-to-center distance 1360 of preferably approximately $1.0\lambda_\epsilon$. The patches 1320, 1321 and 1322 are preferably arranged in a square array on the top surface 1312*b* having an equal even number of rows and columns of patches 1320, 1321 and 1322. The width 1384 (FIG. 13) of each stripline 1324 and 1326, and the width and length of each stub 1325 and 1328, is preferably determined assuming a characteristic impedance of about 50 to 200 ohms. A shortening pin (not shown) may optionally be disposed in the antenna 1300 to electrically connect the ground plane 1316 to one or more patches 1320, 1321 and/or 1322 to suppress unwanted mode excitations.

For optimal performance at a particular frequency, the dimensions of the patches 1320, 1321 and 1322, the striplines 1324 and 1326, the stubs 1325 and 1328, the apertures 1350 and areas 1352, and the center-to-center spacing 1360 are individually calculated so that a high-order standing wave is generated in the antenna cavity formed within the dielectric 1312, and so that fields radiated from the radiating edges 1320*b* interfere constructively with one another. The number of patches 1320, 1321 and 1322 determines not only the overall size, but also the directivity, of the antenna 1300. The sidelobe levels of the antenna 1300 are determined by the field distribution among the radiating elements 1320, 1321 and 1322. Therefore, antenna characteristics, such as directivity and sidelobe levels, are controlled by the position of each of the patches 1320, 1321 and 1322 and the feeding scheme. To achieve high directivity, the field distribution among the radiating elements 1320, 1321 and 1322 is assumed to be as uniform as possible. There are electric field null points within the dielectric layers 1312 between the patches 1320, 1321 and 1322 and the connecting striplines 1324 and 1326 and the ground plane 1316. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

Preferably, two conventional SMA probes 1370 are provided for dual-mode operation, such as transmitting and receiving beams. As most clearly shown in FIG. 14, each SMA probe 1370 includes, for delivering EM energy to and/or from the antenna 1300, an outer conductor 1372 which is electrically connected to the ground plane 1316, and an inner (or feed) conductor 1374 which extends through openings formed in the ground plane 1316 and two interior patches 1322, and is electrically connected to a patch 1323. The patch 1323 is preferably square, the sides of which have a length of about 2 mm to about 5 mm and, typically, from about 2.5 mm to about 4.5 mm and, preferably, about 3 mm. The two SMA probes 1370 are thus connected to two adjacent center patches 1322. The probes 1370 are positioned along a diagonal of the two selected respective center patches 1322 proximate to the striplines 1324 to optimize the impedance matching of the antenna 1300, and reduce cross-talking and cross-polarization. While it is preferable that the probes 1370 be SMA probes, any suitable coaxial probe and/or connection arrangement may be used to implement the foregoing connections. For example, a conductive adhesive (not shown) may be used to bond and maintain contact between the inner conductor 1374 and the selected center patches 1322, and an appropriate seal (not shown) may be provided where the SMA probes 1370 pass through the ground plane 1316 to hermetically seal the connection. It is understood that the other ends of the SMA probes 1370, not connected to the antenna 1300, are connectable via a cable (not shown) to a signal generator or to a receiver, such as a satellite signal decoder used with television signals.

In operation, the antenna 1300 may be used for receiving or transmitting linearly polarized (LP) EM beams. To exemplify how the antenna 1300 may be used to receive a beam, the antenna 1300 may be positioned in a residential home and directed for receiving from a geostationary, or equatorial, satellite a beam carrying a television signal within a predetermined frequency band or channel. The antenna 1300 is so directed by orienting the top surface 1312*b* toward the source of the beam so that it is generally perpendicular to the direction of the beam. Assuming that the elements of the antenna 1300 are correctly sized for receiving the beam, then the beam will pass through the apertures 1350 and areas 1352, and induce a standing wave, which will resonate within the dielectric layer 1312. A standing wave induced in the resonant cavity defined by the dielectric layer 1312 is communicated through the SMA probes 1370 to a receiver, such as a decoder (not shown).

In the antenna 1300, the vertical modal excitation becomes orthogonal to that of the horizontal mode so that the cross talk between the two input signals will be minimized. In other words, two orthogonal vertical and horizontal modes can be excited independently.

It is well known that antennas transmit and receive signals reciprocally. It can be appreciated, therefore, that operation of the antenna 1300 for transmitting signals is reciprocally identical to that of the antenna for receiving signals. The transmission of signals by the antenna 1300 will, therefore, not be further described herein.

It is understood that the present invention can take many forms and embodiments. The embodiments described with respect to FIGS. 13-15 are intended to illustrate rather than to limit the invention. Accordingly, several variations may be made in the foregoing without departing from the spirit or the scope of the invention. For example, additional patches 1320 may be provided for narrowing a beam, or fewer patches 1320 may be utilized to reduce the physical space required for the antenna 1300 of the present invention. In another example, one of the two SMA probes 1370 may be removed (or not attached) for single-mode operation in transmitting and receiving EM beams. The antenna 1300 may also be used for receiving and/or transmitting circularly polarized (CP) EM beams.

FIGS. 16-18

Figure 16:
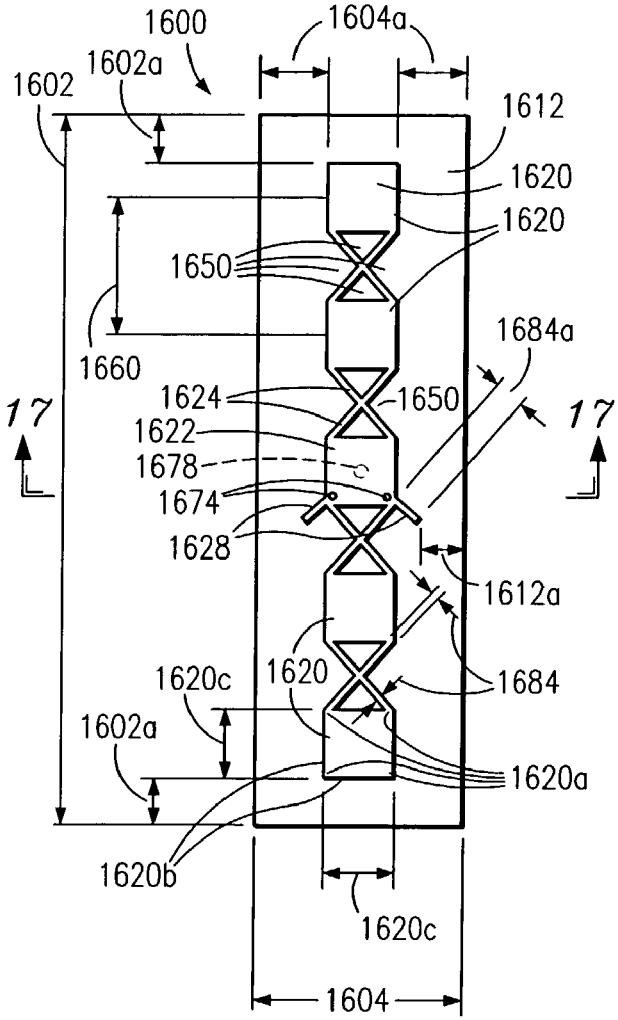
FIG. 16 is a plan view of a planar array antenna.
Figure 18:
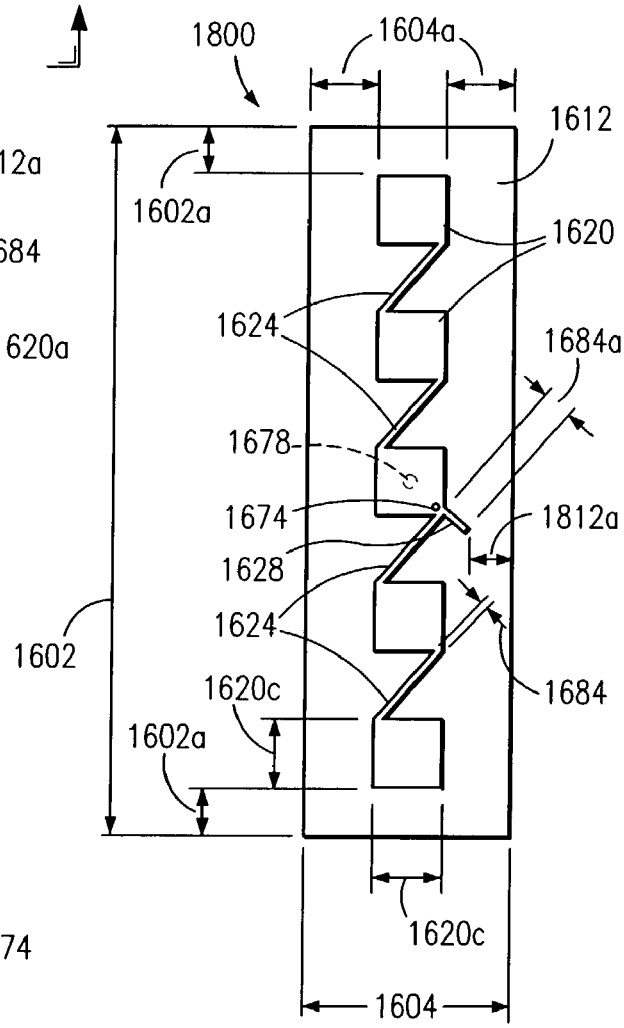
FIG. 18 is a plan view of an alternate embodiment of the antenna of FIG. 16.
Figure 17:
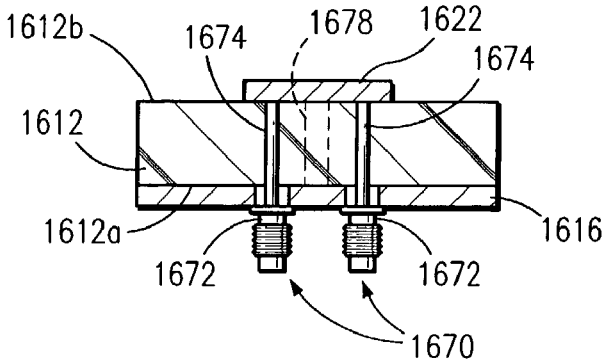
FIG. 17 is an elevation cross-sectional view of the antenna of FIG. 16 taken along the line 17-17 of FIG. 16.

Referring to FIGS. 16-18, the reference numerals 1600 and 1800 designate, in general, a linear microstrip array antenna embodying features of the present invention for dual-mode operation, such as transmitting and receiving EM beams. The linear array antenna 1600 is configured for producing a narrow beam in the direction of the array, but a broad beam in the direction perpendicular to the array. The antenna 1600 preferably includes a generally rectangular-shaped, dielectric layer 1612. The length 1602 of the layer 1612 is determined by the number of patches 1620 used, discussed below, and, preferably, extends a length 1602*a* and width 1604*a* of at least $0.50\lambda_\epsilon$ beyond the outer edges of the patches 1620.

As shown most clearly in FIG. 17, the dielectric layer 1612 defines a bottom side 1612*a* to which a conductive ground plane 1616 is bonded, and a top side 1612*b* to which an array of conductive radiating patches 1620 (FIG. 16) and a center radiating patch 1622 are bonded for forming a resonant cavity within the dielectric layer 1612 between the patches 1620 and 1622, striplines 1620, and the ground plane 1616. (Please note that the ground plane 1616 in FIG. 17 has to cover the entire area of the bottom surface of the dielectric slab.)

Referring back to FIG. 16, the patches 1620 and 1622 are generally square in shape, each having four corners 1620*a*, and four radiating edges 1620*b*, each having a length 1620*c* of about $0.50\lambda_\epsilon$. As viewed in FIG. 16, the patches 1620 and 1622 are electrically interconnected via corners 1620*a* and crossed conductive striplines 1624 bonded to the dielectric layer 1612. Two tuning stubs 1628 extend diagonally outwardly from two corners 1620*a* of the center patch 1622, and are also bonded to the dielectric layer 1612. The patches 1620 and 1622 are preferably spaced apart by a center-to-center distance 1660 of slightly less than $1.0\lambda_\epsilon$. The patches 1620 and 1622 are preferably arranged in a single-column array on the top surface 1612*b*, exemplified in FIG. 16 as having two patches 1620 on each side of a single patch 1622 for a total of five patches 1620 and 1622 that constitute the antenna 1600. The width 1684 (FIG. 16) of each stripline 1624 and the length and width of each stub 1628 are preferably determined assuming a characteristic impedance of about 50 to 200 ohms. A shortening pin 1678 is preferably disposed in the antenna 1600 electrically connecting the ground plane 1616 to the center patch 1622 to suppress unwanted mode excitations. Additional shortening pins (not shown) may also be disposed in the antenna 1600 connecting the ground plane 1616 to patches 1620 to further suppress unwanted mode excitations. Alternatively, in some instances, it may be preferable to omit one or all shortening pins 1678 from the antenna 1600.

For optimal performance at a particular frequency, the dimensions of the patches 1620 and 1622, the striplines 1624, the stubs 1628, the apertures 1650, and the center-to-center spacing 1660 are individually calculated so that a high-order standing wave is generated in the antenna cavity formed within the dielectric 1612, and so that fields radiated from the radiating edges 1620*b* interfere constructively with one another. The number of patches 1620 and 1622 determines not only the overall size, but also the directivity, of the antenna 1600. The sidelobe levels of the antenna 1600 are determined by the field distribution at the radiating elements 1620 and 1622. Therefore, antenna characteristics, such as directivity and sidelobe levels, are controlled by the size and the position of each of the patches 1620 and 1622 and the feeding scheme. To achieve high directivity, the field distribution at the radiating elements 1620 and 1622 is assumed to be as uniform as possible. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

Preferably, two conventional SMA probes 1670 are provided for dual-mode operation, such as transmitting and receiving beams. Each SMA probe 1670 includes, for delivering EM energy to and/or from the antenna 1600, an outer conductor 1672 which is electrically connected to the ground plane 1616, and an inner (or feed) conductor 1674 which is electrically connected to the center patch 1622. The probe 1670 is positioned along a diagonal of the patch 1622 close to the stripline 1650 to optimize the impedance matching of the antenna 1600 and reduce cross-talking and cross-polarization. While it is preferable that the probes 1670 be SMA probes, any suitable coaxial probe and/or connection arrangement may be used to implement the foregoing connections. For example, a conductive adhesive (not shown) may be used to bond and maintain contact between the inner conductor 1674 and the center patch 1622, and an appropriate seal (not shown) may be provided where the SMA probe 1670 passes through the ground plane 1616 to hermetically seal the connection. It is understood that the other ends of the SMA probes 1670, not connected to the antenna 1600, are connectable via a cable (not shown) to a signal generator or to a receiver, such as a satellite signal decoder used with television signals.

In operation, the antenna 1600 may be used for receiving or transmitting linearly polarized (LP) EM beams. The antenna 1600 is so directed by orienting the top surface 1612*b* toward the source of the beam so that it is generally perpendicular to the direction of the beam. Assuming that the elements of the antenna 1600 are correctly sized for receiving the beam, then the beam will pass through the apertures 1650 and induce a standing wave that will resonate within the dielectric layer 1612. A standing wave induced in the resonant cavity defined within the dielectric layer 1612 is communicated through the SMA probe 1670 to a receiver such as a decoder (not shown).

In the antenna 1600, the vertical modal excitation becomes orthogonal to that of the horizontal mode so that the cross talk between the two input signals will be minimized. In other words, two orthogonal vertical and horizontal modes can be excited independently.

It is well known that antennas transmit and receive signals reciprocally. It can be appreciated, therefore, that operation of the antenna 1600 for transmitting signals is reciprocally identical to that of the antenna for receiving signals. The transmission of signals by the antenna 1600 will, therefore, not be further described herein.

It is understood that the present invention can take many forms and embodiments. The embodiments described with respect to FIGS. 16-18 are intended to illustrate rather than to limit the invention. Accordingly, several variations may be made in the foregoing without departing from the spirit or the scope of the invention. For example, additional patches 1620 may be provided for narrowing a beam, or fewer patches 1620 may be utilized to reduce the physical space required for the antenna 1600 of the present invention. The antenna 1600 may also be used for receiving and/or transmitting circularly polarized (CP) EM beams. In a further example, the outer edges of the dielectric layer 1612 may be wrapped with conducting foil, spaced apart from the patches 1620, to thereby form edge conductors and reduce surface-mode excitation and increase the gain of the antenna. In some instances, it may be preferable to omit the shortening pin 1678 from the antenna 1600.

In yet another variation, depicted in FIG. 18, the antenna 1800 may be adapted for single mode operation in transmitting and receiving EM beams by removing (or not attaching) one of the two SMA probes 1670 and by not bonding one stub 1628 and striplines 1624 that are substantially parallel to the remaining stub 1628.

Very-High-Gain Antenna Applications (Such as for Direct Broadcast Satellite)

FIGS. 19-20

Figure 19:
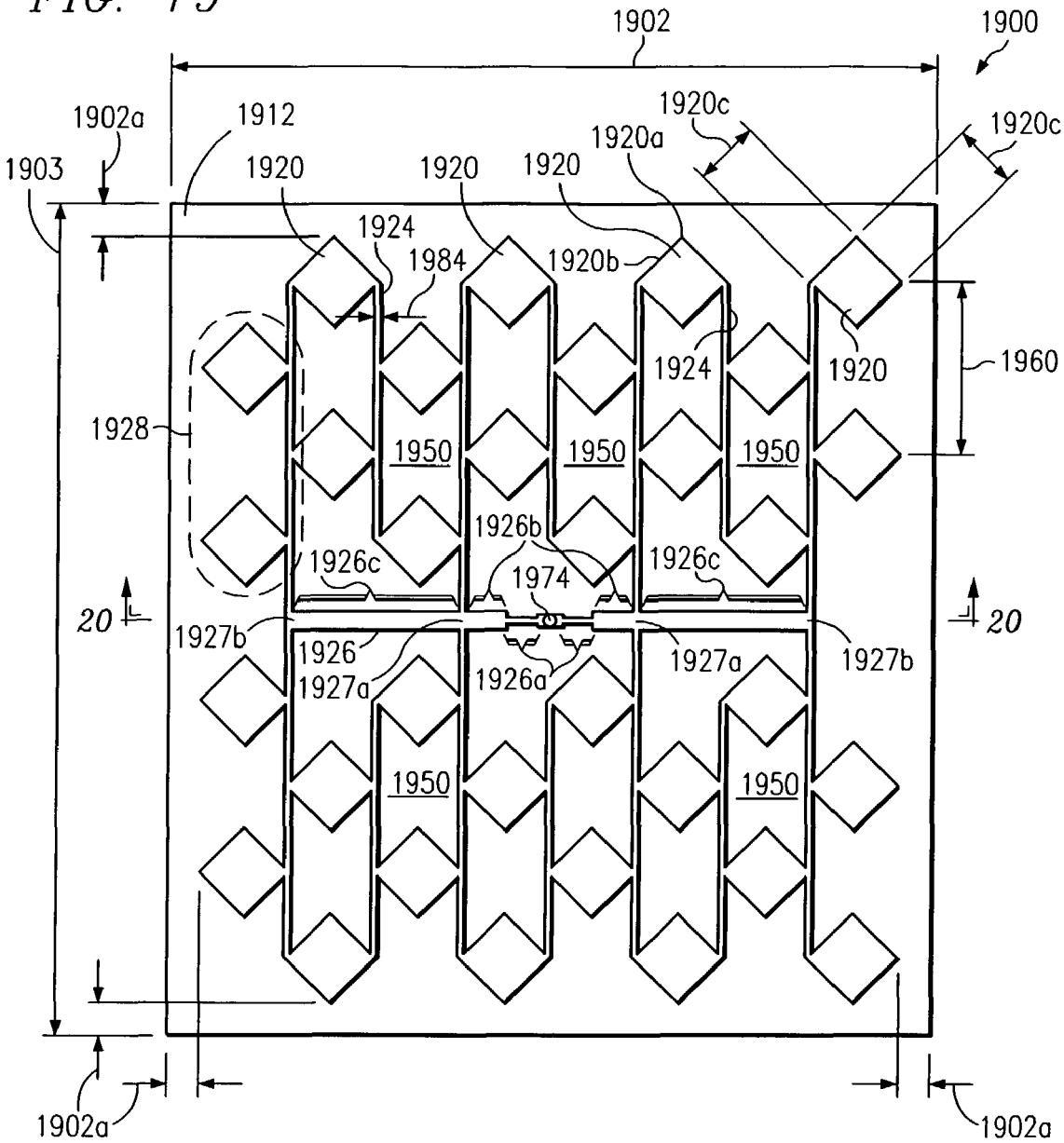
FIG. 19 is a plan view of a planar array antenna.
Figure 20:
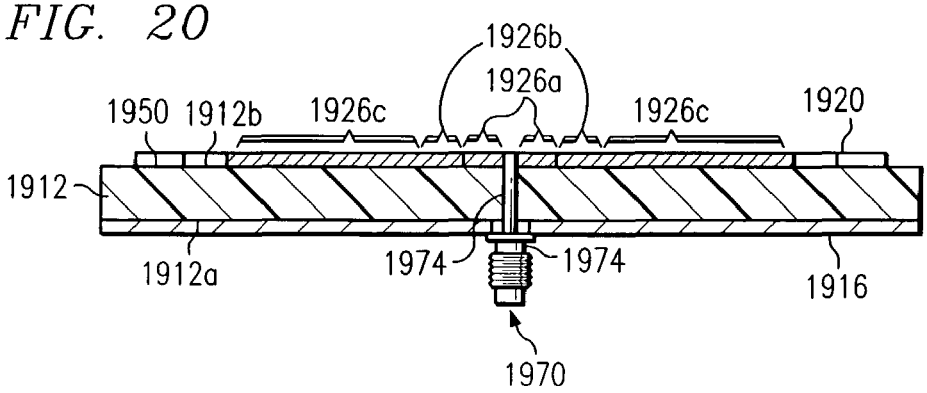
FIG. 20 is an elevation cross-sectional view of the antenna of FIG. 19 taken along the line 20-20 of FIG. 19.

Referring to FIGS. 19 and 20, the reference numeral 1900 designates, in general, a planar microstrip array antenna embodying features of the present invention for single-mode operation, such as transmitting or receiving beams. The antenna 1900 includes a generally square, dielectric layer 1912. The width 1902 and length 1903 of the layer 1912 may be equal or different, and are determined by the number of patches used, as discussed below, and, preferably, extends a width and length 1902*a* of at least $0.50\lambda_\epsilon$ beyond the outer edges of patches 1920.

The dielectric layer 1912 defines a bottom side 1912*a* to which a conductive ground plane 1916 is bonded, and a top side 1912*b* to which an array of conductive radiating patches 1920 are bonded for forming a resonant cavity within the dielectric layer 1912 between the patches 1920, the striplines 1924 and the ground plane 1916. The patches 1920 are generally square in shape, having four corners 1920*a* and four radiating edges 1920*b*, each having a length 1920*c* of about $0.50\lambda_\epsilon$. As viewed in FIG. 19, the patches 1920 are electrically interconnected via either one corner 1920*a* or two opposing corners 1920*a* to an array of parallel vertical conductive striplines 1924, which in turn are electrically interconnected via a horizontal conductive transmission line 1926. The striplines 1924 and transmission line 1926 are bonded to the dielectric layer 1912. The patches 1920 are spaced apart by a vertical (as viewed in FIG. 19) center-to-center distance 1960 of preferably about $1\lambda_\epsilon$. The patches 1920 are preferably arranged in a plurality of vertical (as viewed in FIG. 19) columns on the top surface 1912*b*, exemplified in FIG. 19 as eight vertical (as viewed in FIG. 19) columns 1928 (depicted in dashed outline), offset against one another, above and below the horizontal transmission line 1926, each column comprising two patches 1920, for a total of thirty-two patches 1920 that constitute the antenna 1900.

The width 1984 (FIG. 19) of each stripline 1924 is preferably determined assuming a characteristic impedance of about 50 to 200 ohms. Each transmission line 1926 includes a first portion 1926*a*, a second portion 1926*b* and a third portion 1926*c*. Each first portion 1926*a* is preferably sized to have a characteristic impedance of about 100 ohms when the input impedance is about 50 ohms. The width and length of each second portion 1926*b* is determined by a quarter-wavelength transformer, such that the incoming wave from the feed is substantially transmitted, i.e., that the input impedance at a feed line 1974 is properly matched. The width and length of each third portion 1926*c* of the transmission line 1926 is determined, such that a traveling wave from the feed line 1974 is not reflected at junctions 1927*a* and 1927*b*. Accordingly, the length of each third portion 1926*c* is preferably about $1\lambda_\epsilon$ to ensure that the differences between the phase of the traveling wave at junctions 1927*a* and 1927*b* is as close to 360° as possible. The width of each third portion 1926*c* is preferably sized such that the characteristic impedance is about one half of the characteristic impedance of the striplines 1924.

For optimal performance at a particular frequency, the dimensions of the patches 1920, the striplines 1924 and 1926, the apertures 1950, and the center-to-center spacing 1960 are individually calculated so that a high-order standing wave is generated in the antenna cavity formed within the dielectric 1912, and so that fields radiated from the radiating edges 1920*b* interfere constructively with one another. The number of patches 1920 determines not only the overall size, but also the directivity, of the antenna 1900. The sidelobe levels of the antenna 1900 are determined by the field distribution at the radiating edges 1920*b*. Therefore, antenna characteristics, such as directivity and sidelobe levels, are controlled by the size and the position of each of the patches 1920 and the feeding scheme. To achieve high directivity, the field distribution among the radiating elements 1920 is assumed to be as uniform as possible. There are electric field null points in the dielectric layer 1912. In some instances, one or more shortening pins (not shown) may be disposed in the antenna 1900 electrically connecting together the ground plane, patches, and/or striplines to suppress unwanted mode excitations. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

A conventional SMA probe 1970 (FIG. 20) is provided for single mode operation, such as transmitting or receiving beams. The SMA probe 1970 includes, for delivering EM energy to and/or from the antenna 1900, an outer conductor 1972 which is electrically connected to the ground plane 1916, and an inner (or feed) conductor 1974 which is electrically connected and centrally positioned along the transmission line 1926 between the portions 1926*a* to optimize the impedance matching and proper radiation patterns of the antenna 1900. While it is preferable that the probe 1970 be an SMA probe, any suitable coaxial probe and/or connection arrangement may be used to implement the foregoing connections. For example, a conductive adhesive (not shown) may be used to bond and maintain contact between the inner conductor 1974 and the center patch 1922, and an appropriate seal (not shown) may be provided where the SMA probe 1970 passes through the ground plane 1916 to hermetically seal the connection. It is understood that the other end of the SMA probe 1970, not connected to the antenna 1900, is connectable via a cable (not shown) to a signal generator or to a receiver, such as a satellite signal decoder used with television signals.

In operation, the antenna 1900 may be used for transmitting or receiving linearly polarized (LP) EM beams. In the transmission of an EM beam, an incoming signal from the SMA probe 1970 travels as a traveling wave along the transmission line 1926 through the first portion 1926*a* which acts as a quarter-wavelength transformer to transport the EM power to the two branches 1926*b* and 1926*c* and four striplines 1924 of each branch 1926*b* and 1926*c* with minimal reflection. The EM power is transmitted through the striplines 1924 to the array of patches 1920. The patches 1920 and portions of striplines 1924 then induce a high-order standing wave for proper radiation through the apertures 1950 of the antenna 1900.

It is well known that antennas transmit and receive signals reciprocally. It can be appreciated, therefore, that operation of the antenna 1900 for transmitting signals is reciprocally identical to that of the antenna for receiving signals. Thus, for example, the antenna 1900 may be positioned in a residential home and directed for receiving from a geostationary, or equatorial, satellite a beam carrying a television signal within a predetermined frequency band or channel. The antenna 1900 is so directed by orienting the top surface 1912*b* toward the source of the beam so that it is generally perpendicular to the direction of the beam. Assuming that the elements of the antenna 1900 are correctly sized for receiving the beam, then the beam will pass through the apertures 1950 and induce a high-order standing wave which will resonate within the resonant cavity formed within the dielectric layer 1912, and pass EM power through the striplines 1924 and transmission lines 1926 to the SMA probe 1970. The EM power is then passed from the SMA probe 1970 through a cable (not shown) and delivered to a receiver, such as a decoder (not shown).

It is understood that the present invention can take many forms and embodiments. The embodiments described with respect to FIGS. 19 and 20 are intended to illustrate rather than to limit the invention. Accordingly, several variations may be made in the foregoing without departing from the spirit or the scope of the invention. For example, additional patches 1920 may be provided for narrowing a beam, or fewer patches 1920 may be utilized to reduce the physical space required for the antenna 1900 of the present invention.

FIGS. 21-22

Figure 21:
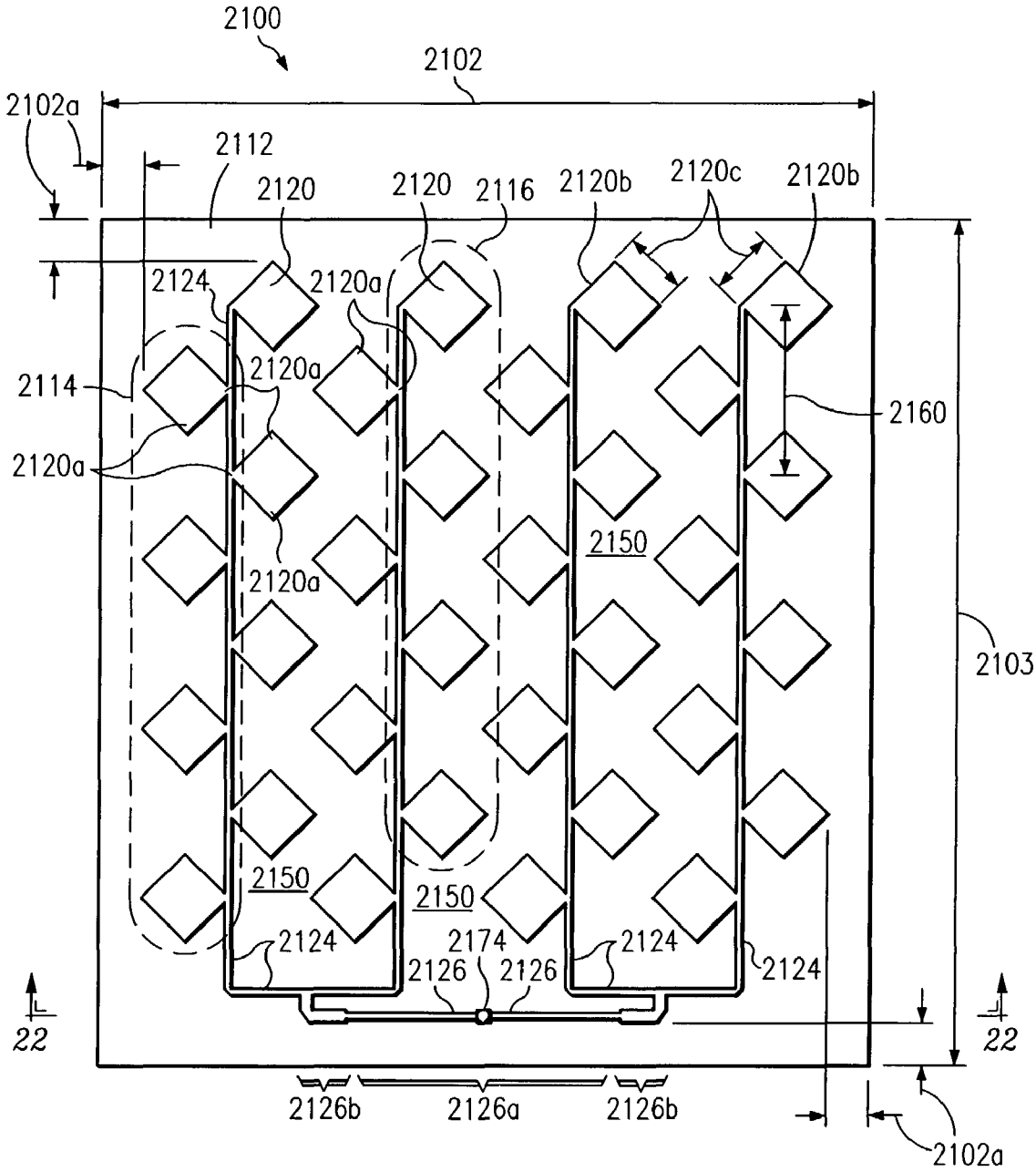
FIG. 21 is a plan view of a planar array antenna.
Figure 22:
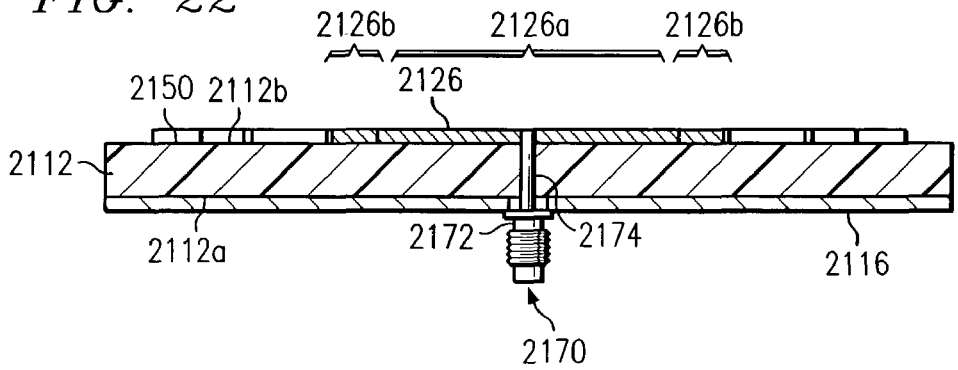
FIG. 22 is an elevation cross-sectional view of the antenna of FIG. 21 taken along the line 22-22 of FIG. 21.

Referring to FIGS. 21 and 22, the reference numeral 2100 designates, in general, a planar microstrip array antenna embodying features of the present invention for single-mode operation, such as transmitting or receiving beams. The antenna 2100 includes a generally square, dielectric layer 2112. The width 2102 and length 2103 (FIG. 21) of the layer 2112 is determined by the number of patches used, as discussed below, and, preferably, extends a width and length 2102*a* of at least $0.50\lambda_\epsilon$ beyond the outer edges of patches 2120 and stripline 2126.

The dielectric layer 2112 defines a bottom side 2112*a* to which a conductive ground plane 2116 is bonded, and a top side 2112*b* to which an array of conductive radiating patches 2120 are bonded for forming a resonant cavity within the dielectric layer 2112 between the patches 2120, the striplines 2124, and the ground plane 2116. The patches 2120 are generally square in shape, having four corners 2120*a* and four radiating edges 2120*b*, each edge having a length 2120*c* of about $0.50\lambda_\epsilon$. The patches 2120 are electrically interconnected via one corner 2120*a* to one of an array of four conductive striplines 2124, which in turn are electrically interconnected via a conductive stripline 2126. The striplines 2124 and transmission line 2126 are bonded to the dielectric layer 2112. The patches 2120 are spaced apart by a vertical (as viewed in FIG. 21) center-to-center distance 2160 of preferably about $1\lambda_\epsilon$. The patches 2120 are preferably arranged in a plurality of eight columns on the top surface 2112*b*, representatively exemplified in FIG. 21 by columns 2114 and 2116, each of which columns comprises four patches 2120, for a total of thirty-two patches 2120 that constitute the antenna 2100. The width of each stripline 2124 is preferably determined assuming a characteristic impedance of about 50 to 200 ohms. Each transmission line 2126 includes a first portion 2126*a* preferably configured to have a characteristic impedance of about 100 ohms for an input impedance of about 50 ohms, with a feed line centrally positioned on the stripline 2126, as discussed below with respect to the SMA probe 2170, to ensure proper radiation. Each transmission line 2126 further includes a second portion 2126*b* preferably configured as a quarter-wavelength transformer to have minimal reflection at the junction with the striplines 2124.

For optimal performance at a particular frequency, the dimensions of the patches 2120, the striplines 2124 and 2126, the apertures 2150, and the center-to-center spacing 2160 are individually calculated so that a high-order standing wave is generated in the antenna cavity formed within the dielectric 2112, and so that fields radiated from the radiating edges 2120*a* interfere constructively with one another. The number of patches 2120 determines not only the overall size, but also the directivity, of the antenna 2100. The sidelobe levels of the antenna 2100 are determined by the field distribution among the radiating elements 2120. Therefore, antenna characteristics, such as directivity and sidelobe levels are controlled by the size and the position of each of the patches 2120 and the feeding scheme. To achieve high directivity, the field distribution among the radiating elements 2120 is assumed to be as uniform as possible. There are electric field null points in the dielectric layer 2112 within the patches 2120 and the connecting striplines 2124. In some instances, one or more shortening pins (not shown) may be disposed in the antenna 2100 electrically connecting together the ground plane, patches and/or striplines to suppress unwanted mode excitations. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

A conventional SMA probe 2170 (FIG. 22) is provided for single mode operation, such as transmitting or receiving beams. Each SMA probe 2170 includes, for delivering EM energy to and/or from the antenna 2100, an outer conductor 2172 which is electrically connected to the ground plane 2116, and an inner (or feed) conductor 2174 which is electrically connected and centrally positioned along the transmission line 2126 between the portions 2126*a* and 2126*b* to optimize the impedance matching of the antenna 2100, and induce centrally-peaked radiation. While it is preferable that the probe 2170 be an SMA probe, any suitable coaxial probe and/or connection arrangement may be used to implement the foregoing connections. For example, a conductive adhesive (not shown) may be used to bond and maintain contact between the inner conductor 2174 and the center stripline 2126, and an appropriate seal (not shown) may be provided where the SMA probe 2170 passes through the ground plane 2116 to hermetically seal the connection. It is understood that the other end of the SMA probe 2170, not connected to the antenna 2100, is connectable via a cable (not shown) to a signal generator or to a receiver, such as a satellite signal decoder used with television signals.

In operation, the antenna 2100 may be used for transmitting or receiving linearly polarized (LP) EM beams. In the transmission of an EM beam, an incoming signal from the SMA probe 2170 travels as a traveling wave along the transmission line 2126 through the first portion 2126*a* and the second portion 2126*b*, which behaves as a quarter-wavelength transformer to transport the EM power to the four striplines 2124 with minimal reflection. The EM power is transmitted through the striplines 2124 to the array of patches 2120. The patches 2120 then induce a high-order standing wave for proper radiation through the apertures 2150 of the antenna 2100.

It is well known that antennas transmit and receive signals reciprocally. It can be appreciated, therefore, that operation of the antenna 2100 for transmitting signals is reciprocally identical to that of the antenna for receiving signals. Thus, for example, the antenna 2100 may be positioned in a residential home and directed for receiving from a geostationary, or equatorial, satellite a beam carrying a television signal within a predetermined frequency band or channel. The antenna 2100 is so directed by orienting the top surface 2112*b* toward the source of the beam so that it is generally perpendicular to the direction of the beam. Assuming that the elements of the antenna 2100 are correctly sized for receiving the beam, then the beam will pass through the apertures 2150 and induce a standing wave that will resonate within the dielectric layer 2112. A standing wave induced in the resonant cavity defined within the dielectric layer 2112 is transmitted through striplines 2124, transmission line 2126, and the SMA probe 2170 and is delivered to a receiver, such as a decoder (not shown).

It is understood that the present invention can take many forms and embodiments. The embodiments described with respect to FIGS. 21 and 22 are intended to illustrate rather than to limit the invention. Accordingly, several variations may be made in the foregoing without departing from the spirit or the scope of the invention. For example, additional patches 2120 may be provided for narrowing a beam, or fewer patches 2120 may be utilized to reduce the physical space required for the antenna 2100 of the present invention.

FIGS. 23-24

Figure 23:
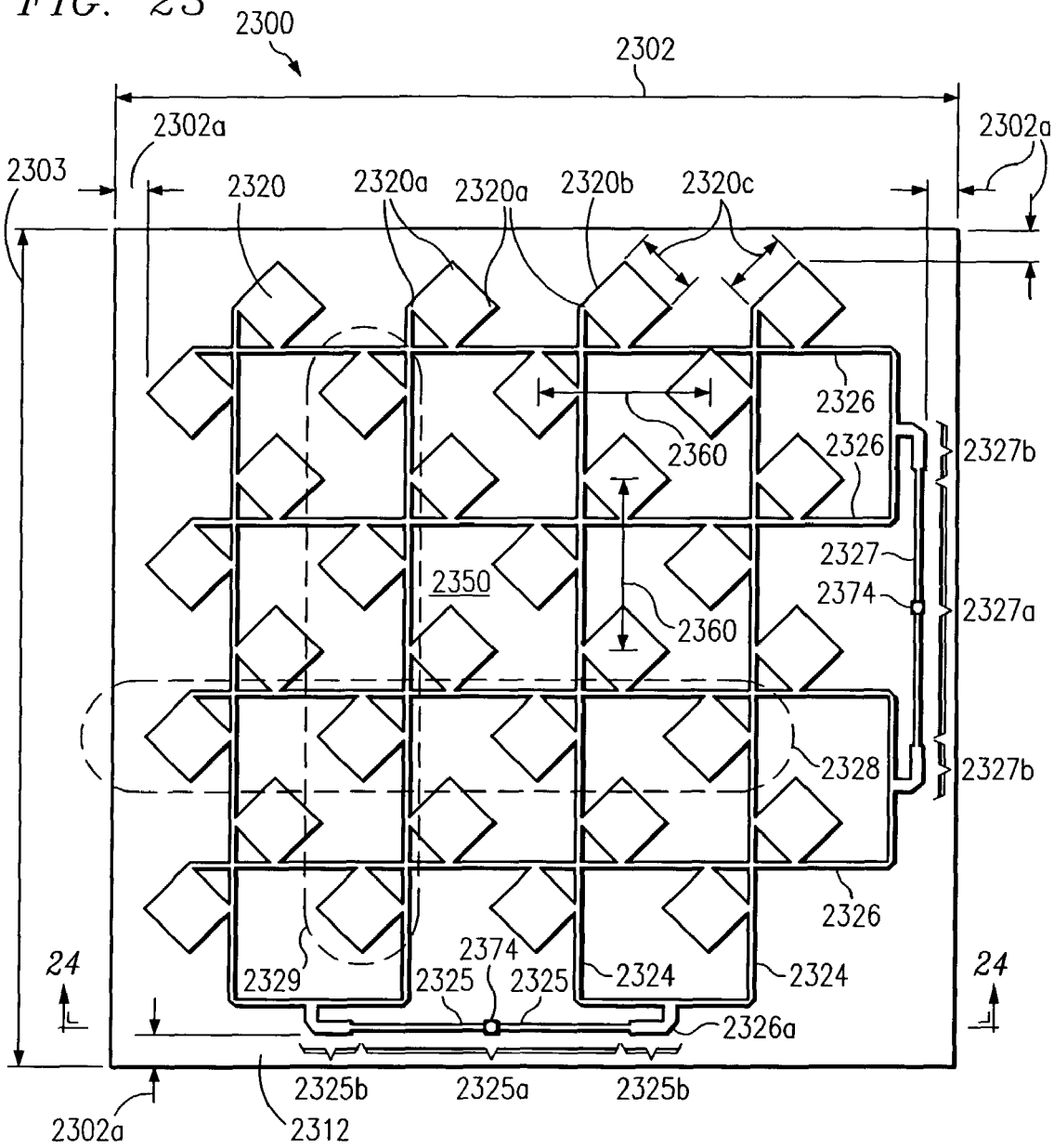
FIG. 23 is a plan view of a planar array antenna.
Figure 24:
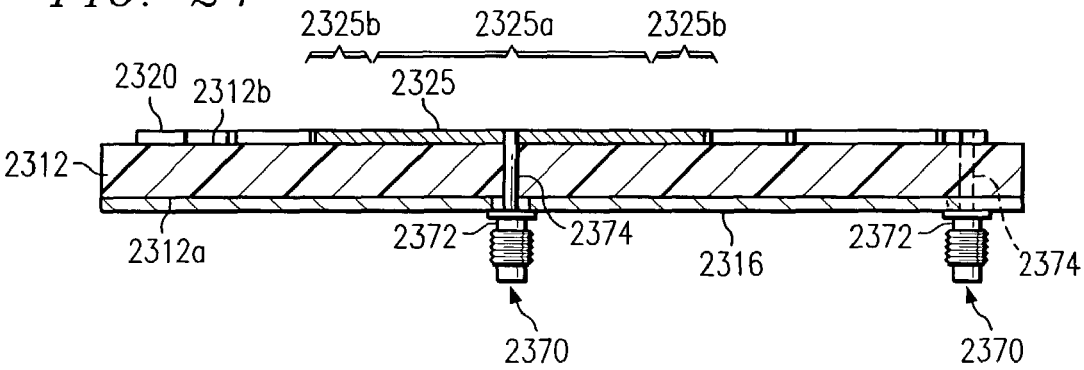
FIG. 24 is an elevation cross-sectional view of the antenna of FIG. 23 taken along the line 24-24 of FIG. 23.

Referring to FIGS. 23 and 24, the reference numeral 2300 designates, in general, a planar microstrip array antenna embodying features of the present invention for dual-mode operation, such as transmitting and receiving beams. The antenna 2300 includes a generally square, dielectric layer 2312. The width 2302 and length 2303 (FIG. 23) of the layer 2312 is determined by the number of patches used, as discussed below, and, preferably, extends a width and length 2302*a* of at least $0.50\lambda_\epsilon$ beyond the outer edges of the patches 2320 and transmission lines 2325 and 2327.

The dielectric layer 2312 defines a bottom side 2312*a* to which a conductive ground plane 2316 is bonded, and a top side 2312*b* to which an array of conductive radiating patches 2320 are bonded for forming a resonant cavity within the dielectric layer 2312 between the patches 2320, the striplines 2324 and 2326, and the ground plane 2316. The patches 2320 are generally square in shape, having four corners 2320*a* and four radiating edges 2320*b*, each edge having a length 2320*c* of about $0.50\lambda_\epsilon$. As viewed in FIG. 23, the patches 2320 are electrically interconnected via two adjacent corners 2320*a*, one of which adjacent corners is electrically connected to one of an array of eight vertical conductive striplines 2324, and the other of which adjacent corners is electrically connected to one of an array of eight horizontal conductive striplines 2326. The vertical striplines 2324 are electrically interconnected via a horizontal conductive transmission line 2325, and the horizontal striplines 2326 are electrically interconnected via a vertical conductive transmission line 2327. The striplines 2324 and 2326 and the transmission lines 2325 and 2327 are bonded to the dielectric layer 2312. The patches 2320 are spaced apart by a center-to-center distance 2360 of preferably about $1\lambda_\epsilon$. The patches 2320 are preferably arranged in a plurality of rows and columns on the top surface 2312*b*, representatively exemplified in FIG. 23 by a row 2328 and a column 2329, wherein each row and column comprises four patches 2320, for a total of thirty-two patches 2320 that constitute the antenna 2300. The width of each stripline 2324 is preferably determined assuming a characteristic impedance of about 50 to 200 ohms. Each transmission line 2325 and 2327 includes a first portion 2326*a* and 2326*a*, preferably configured to have a characteristic impedance of about 100 ohms for an input impedance of about 50 ohms, with a feed line centrally positioned on the stripline 2325, as discussed below with respect to the SMA probe 2370, to ensure proper radiation. Each transmission line 2325 and 2327 further includes a second portion 2325*b* and 2327*b* preferably configured as a quarter-wavelength transformer to have minimal reflection at the junction with the striplines 2324 and 2326.

For optimal performance at a particular frequency, the dimensions of the patches 2320, the striplines 2324 and 2326, the apertures 2350, and the center-to-center spacing 2360 are individually calculated so that a high-order standing wave is generated in the antenna cavity formed within the dielectric 2312, and so that fields radiated from the radiating edges 2320*b* interfere constructively with one another.

The number of patches 2320 determines not only the overall size, but also the directivity, of the antenna 2300. The sidelobe levels of the antenna 2300 are determined by the field distribution among the radiating elements 2320. Therefore, antenna characteristics, such as directivity and sidelobe levels, are controlled by the size and the position of each of the patches 2320 and the feeding scheme. To achieve high directivity, the field distribution among the radiating elements 2320 is assumed to be as uniform as possible. There are electric field null points in the dielectric layer 2312 between the ground plane 2316 on the one hand, and the patches 2320 and striplines 2324 and 2326 on the other hand. In some instances, one or more shortening pins (not shown) may be disposed in the antenna 2300 electrically connecting together the ground plane, patches, and/or striplines to suppress unwanted mode excitations. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

Two conventional SMA probes 2370 (FIG. 24) are provided for dual-mode operation, such as transmitting and receiving beams. Each SMA probe 2370 includes, for delivering EM energy to and/or from the antenna 2300, an outer conductor 2372 which is electrically connected to the ground plane 2316, and an inner (or feed) conductor 2374 which is electrically connected and centrally positioned along each transmission line 2325 and 2327 to optimize the impedance matching of the antenna 2300 and the radiation efficiency. While it is preferable that the probes 2370 be SMA probes, any suitable coaxial probe and/or connection arrangement may be used to implement the foregoing connections. For example, a conductive adhesive (not shown) may be used to bond and maintain contact between each inner conductor 2374 and each transmission line 2325 and 2327, and an appropriate seal (not shown) may be provided where the SMA probe 2370 passes through the ground plane 2316 to hermetically seal the connection. It is understood that the other end of the SMA probe 2370, not connected to the antenna 2300, is connectable via a cable (not shown) to a signal generator or to a receiver, such as a satellite signal decoder used with television signals.

In operation, the antenna 2300 may be used for transmitting and/or receiving linearly polarized (LP) EM beams. In the transmission of an EM beam, exemplified with a signal from the SMA probe 2370 to the transmission line 2325, the incoming signal travels as a traveling wave along the transmission line 2325 through the first portion 2325*a* and the second portion 2325*b*, which behaves as a quarter-wavelength transformer to transport the EM power to the four striplines 2324 with minimal reflection. The EM power is transmitted through the striplines 2324 to the array of patches 2320. The patches 2320 then induce a high-order standing wave for proper radiation through the apertures 2350 of the antenna 2300.

In the antenna 2300, the vertical modal excitation becomes orthogonal to that of the horizontal mode so that the cross talk between the two input signals will be minimized. In other words, two orthogonal vertical and horizontal modes can be excited independently.

It is well known that antennas transmit and receive signals reciprocally. It can be appreciated, therefore, that operation of the antenna 2300 for transmitting signals is reciprocally identical to that of the antenna for receiving signals. Thus, for example, the antenna 2300 may be positioned in a residential home and directed for receiving from a geostationary, or equatorial, satellite a beam carrying a television signal within a predetermined frequency band or channel. The antenna 2300 is so directed by orienting the top surface 2312*b* toward the source of the beam so that it is generally perpendicular to the direction of the beam. Assuming that the elements of the antenna 2300 are correctly sized for receiving the beam, then the beam will pass through the apertures 2350 and induce a standing wave that will resonate within the dielectric layer 2312. A standing wave induced in the resonant cavity defined within the dielectric layer 2312 is transmitted either through the striplines 2324 and transmission line 2325, and/or through the striplines 2326 and transmission line 2327, to an SMA probe 2370 and delivered to a receiver, such as a decoder (not shown). It is well known that antennas transmit and receive signals reciprocally. It can be appreciated, therefore, that operation of the antenna 2300 for transmitting signals is reciprocally identical to that of the antenna for receiving signals. The transmission of signals by the antenna 2300 will, therefore, not be further described herein.

It is understood that the present invention can take many forms and embodiments. The embodiments described with respect to FIGS. 23 and 24 are intended to illustrate rather than to limit the invention. Accordingly, several variations may be made in the foregoing without departing from the spirit or the scope of the invention. For example, additional patches 2320 may be provided for narrowing a beam, or fewer patches 2320 may be utilized to reduce the physical space required for the antenna 2300 of the present invention. With proper modification near the feeding area, dual-mode operation with two orthogonal circular polarizations (CP) can be achieved.

FIGS. 25-26

Figure 25:
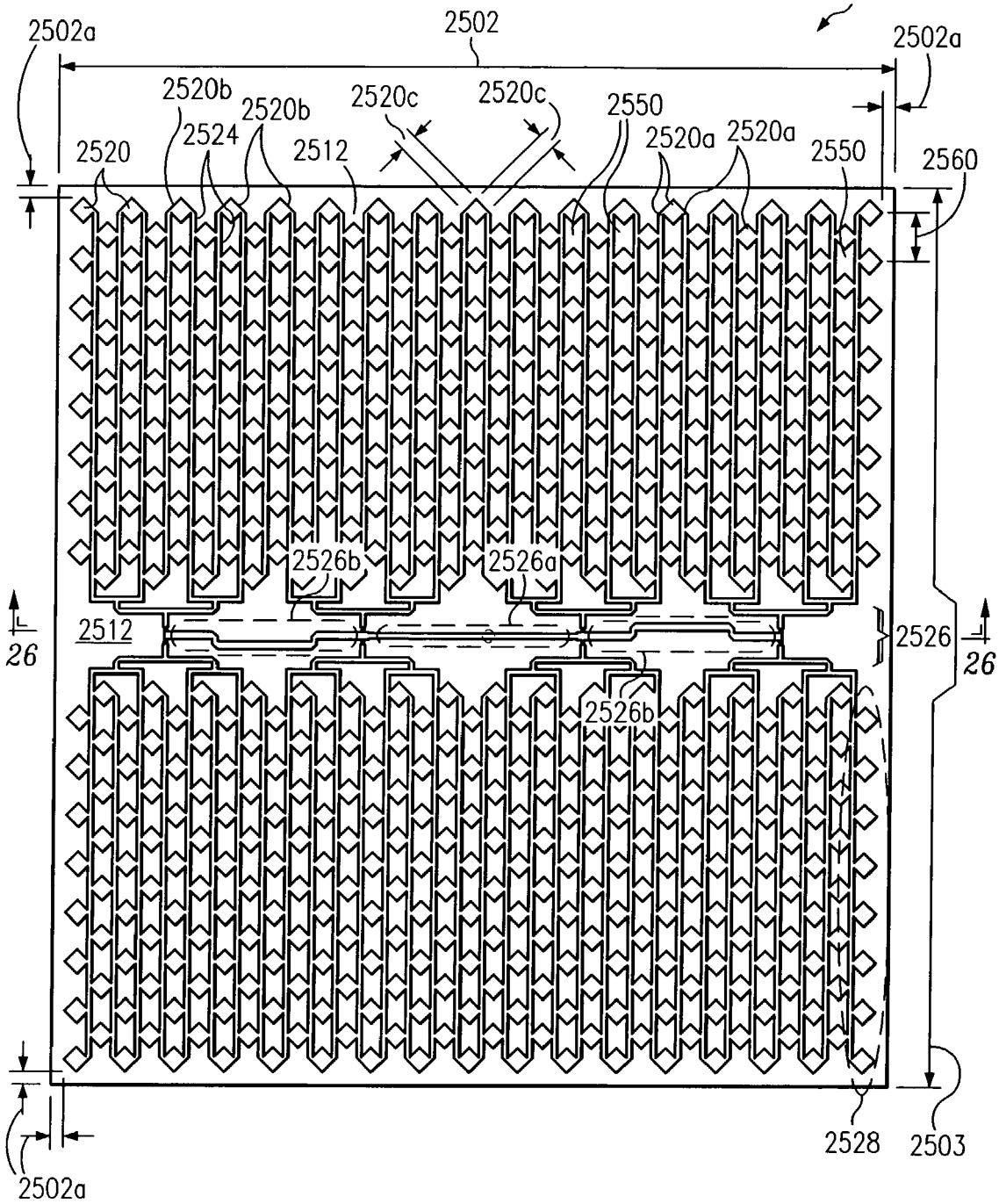
FIG. 25 is a plan view of a planar array antenna.
Figure 26:
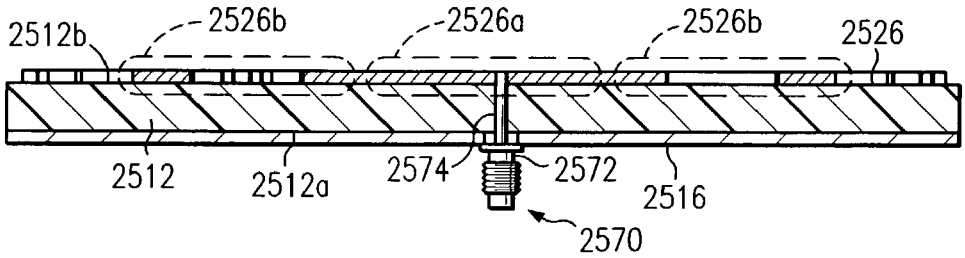
FIG. 26 is an elevation cross-sectional view of the antenna of FIG. 25 taken along the line 26-26 of FIG. 25.

Referring to FIGS. 25 and 26, the reference numeral 2500 designates, in general, a planar microstrip array antenna embodying features of the present invention for single-mode operation, such as transmitting or receiving beams. The antenna 2500 includes a generally square, dielectric layer 2512. The width 2502 and length 2503 of the layer 2512 may be equal or unequal and are determined by the number of patches used, as discussed below, and, preferably, extends a width and length 2502*a* of at least $0.50\lambda_\epsilon$ beyond the outer edges of patches 2520.

The dielectric layer 2512 defines a bottom side 2512*a* to which a conductive ground plane 2516 is bonded, and a top side 2512*b* to which an array of conductive radiating patches 2520 are bonded for forming a resonant cavity within the dielectric layer 2512, between the ground plane 2516 and the patches 2520 and striplines 2524. The patches 2520 are generally square in shape, having four corners 2520*a* and four radiating edges 2520*b*, each having a length 2520*c* of about $0.5\lambda_\epsilon$. As viewed in FIG. 25, the patches 2520 are electrically interconnected via either one corner 2520*a* or two opposing corners 2520*a* to an array of substantially parallel vertical conductive striplines 2524, which in turn are electrically interconnected via a substantially horizontal conductive transmission line 2526, which striplines 2524 and transmission line 2526 are bonded to the dielectric layer 2512. The patches 2520 are spaced apart by a vertical (as viewed in FIG. 25) center-to-center distance 2560 of preferably about $1\lambda_\epsilon$. The patches 2520 are preferably arranged in a plurality of vertical (as viewed in FIG. 25) columns on the top surface 2512*b*, above and below the transmission line 2526, representatively exemplified by a column 2528, depicted in dashed outline. The width of each stripline 2524 is preferably determined assuming a characteristic impedance of about 50 to 200 ohms. The transmission line 2526 includes a first portion 2526*a* preferably configured to have a characteristic impedance of about 100 ohms for an input impedance of about 50 ohms, with a feed line preferably centrally positioned on the transmission line 2526, as discussed below with respect to the SMA probe 2570, to ensure proper radiation. The transmission line 2526 further includes two second portions 2526*b* so configured to have minimal reflection at the junction with the striplines 2524.

For optimal performance at a particular frequency, the dimensions of the patches 2520, the striplines 2524, the transmission line 2526, the apertures 2550, and the center-to-center spacing 2560 are individually calculated so that a high-order standing wave is generated in the antenna cavity formed within the dielectric 2512, and so that fields radiated from the radiating edges 2520*b* interfere constructively with one another. The number of patches 2520 determines not only the overall size, but also the directivity, of the antenna 2500. The sidelobe levels of the antenna 2500 are determined by the field distribution among the radiating elements 2520. Therefore, antenna characteristics, such as directivity and sidelobe levels, are controlled by the size and the position of each of the patches 2520 and the feeding scheme. To achieve high directivity, the field distribution at the radiating elements 2520 is assumed to be as uniform as possible. There are electric field null points in the dielectric layer 2512 proximal to the patches 2520 and striplines 2524. In some instances, one or more shortening pins (not shown) may be disposed in the antenna 2500 electrically connecting together the ground plane, patches, and/or striplines to suppress unwanted mode excitations. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

A conventional SMA probe 2570 (FIG. 26) is provided for single-mode operation, such as transmitting or receiving beams. Each SMA probe 2570 includes, for delivering EM energy to or from the antenna 2500, an outer conductor 2572 which is electrically connected to the ground plane 2516, and an inner (or feed) conductor 2574 which is electrically connected and centrally positioned along the transmission line 2526 to optimize the impedance matching of the antenna 2500, and the antenna aperture efficiency. While it is preferable that the probe 2570 be an SMA probe, any suitable coaxial probe and/or connection arrangement may be used to implement the foregoing connections. For example, a conductive adhesive (not shown) may be used to bond and maintain contact between the inner conductor 2574 and the center stripline 2526*a*, and an appropriate seal (not shown) may be provided where the SMA probe 2570 passes through the ground plane 2516 to hermetically seal the connection. It is understood that the other end of the SMA probe 2570, not connected to the antenna 2500, is connectable via a cable (not shown) to a signal generator or to a receiver, such as a satellite signal decoder used with television signals.

In operation, the antenna 2500 may be used for transmitting or receiving linearly polarized (LP) EM beams. In the transmission of an EM beam, exemplified using a signal from the SMA probe 2570 to the transmission line 2526, the incoming signal travels as a traveling wave along the transmission line 2526 through the first portion 2526*a* to transport the EM power to the two branches 2526*b* and, subsequently, striplines 2524 with minimal reflection. The EM power is transmitted through the striplines 2524 to the array of patches 2520. The patches 2520 then induce a high-order standing wave for proper radiation through the apertures 2550 of the antenna 2500.

It is well known that antennas transmit and receive signals reciprocally. It can be appreciated, therefore, that operation of the antenna 2500 for transmitting signals is reciprocally identical to that of the antenna for receiving signals. Thus, for example, the antenna 2500 may be positioned in a residential home and directed for receiving from a geostationary, or equatorial, satellite a beam carrying a television signal within a predetermined frequency band or channel. The antenna 2500 is so directed by orienting the top surface 2512*b* toward the source of the beam so that it is generally perpendicular to the direction of the beam. Assuming that the elements of the antenna 2500 are correctly sized for receiving the beam, then the beam will pass through the apertures 2550 and induce a standing wave that will resonate within the resonant cavity of the array of patches 2520 in the dielectric layer 2512. A standing wave induced in the resonant cavity defined in the dielectric layer 2512 leaks the EM power through the transmission line network comprising the striplines 2524 and 2526 to the SMA probe 2570, and is delivered to a receiver, such as a decoder (not shown). It is well known that antennas transmit and receive signals reciprocally. It can be appreciated, therefore, that operation of the antenna 2500 for transmitting signals is reciprocally identical to that of the antenna for receiving signals. The transmission of signals by the antenna 2500 will, therefore, not be further described herein.

It is understood that the present invention can take many forms and embodiments. The embodiments described with respect to FIGS. 25 and 26 are intended to illustrate rather than to limit the invention. Accordingly, several variations may be made in the foregoing without departing from the spirit or the scope of the invention. For example, additional patches 2520 may be provided for narrowing a beam, or fewer patches 2520 may be utilized to reduce the physical space required for the antenna 2500 of the present invention.

FIGS. 27-28

Figure 27:
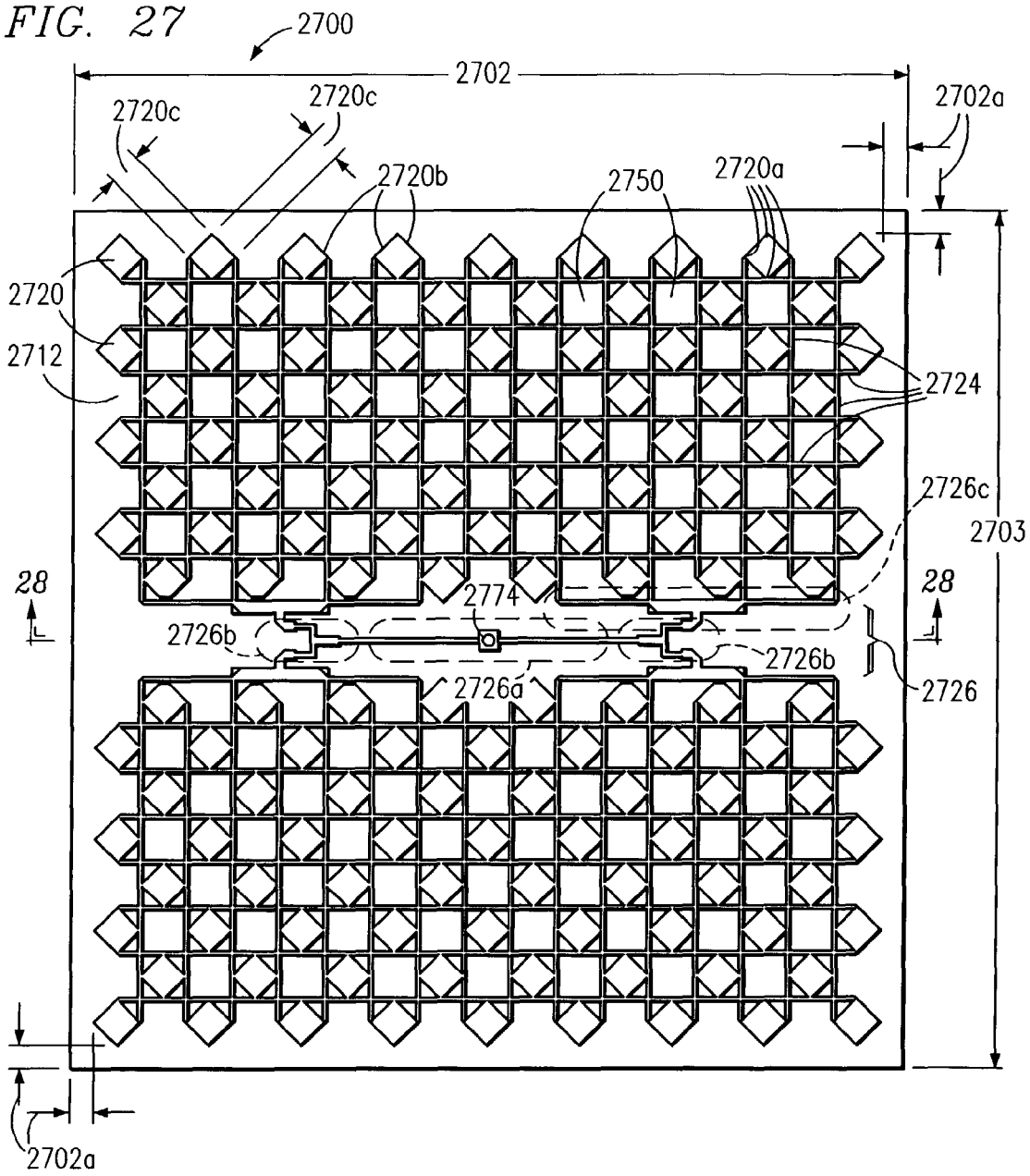
FIG. 27 is a plan view of a planar array antenna.
Figure 28:
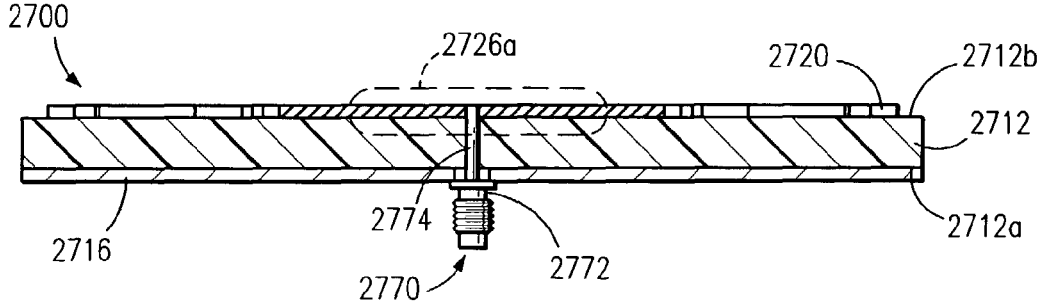
FIG. 28 is an elevation cross-sectional view of the antenna of FIG. 27 taken along the line 28-28 of FIG. 27.

Referring to FIGS. 27 and 28, the reference numeral 2700 designates, in general, a planar microstrip array antenna embodying features of the present invention for single-mode operation, such as transmitting or receiving beams. The antenna 2700 includes a generally square, dielectric layer 2712. The width 2702 and length 2703 of the layer 2712 may be equal or unequal, and are determined by the number of patches used, discussed below, and, preferably, extends a width and length 2702*a* of at least $0.50\lambda_\epsilon$ beyond the outer edges of patches 2720.

Referring to FIG. 28, the dielectric layer 2712 defines a bottom side 2712*a* to which a conductive ground plane 2716 is bonded and a top side 2712*b* to which an array of conductive radiating patches 2720 (FIG. 27) are bonded for forming a resonant cavity within the dielectric layer 2712, between the ground plane and the patches 2720 and striplines 2724.

Referring back to FIG. 27, the patches 2720 are generally square in shape, having four corners 2720*a* and four radiating edges 2720*b*, each having a length 2720*c* of about $0.5\lambda_\epsilon$. As viewed in FIG. 27, the patches 2720 are electrically interconnected via two, three or four corners 2720*a* to an array of substantially horizontal and vertical conductive striplines 2724, which in turn are electrically interconnected via a substantially horizontal conductive transmission line 2726. The striplines 2724 and transmission line 2726 are bonded to the dielectric layer 2712. The width of each stripline 2724 is preferably determined assuming a characteristic impedance of about 50 to 200 ohms. The transmission line 2726 includes a first portion 2726*a* preferably configured to have a characteristic impedance of about 100 ohms for an input impedance of about 50 ohms, with a feed line 2774 centrally positioned on the transmission line 2726, as discussed below with respect to the SMA probe 2770, to ensure proper radiation. The transmission line 2726 further includes two second portions 2726*b* preferably configured as quarter-wavelength transformers to have minimal reflection. Then the signal from 2726*b* travels through further quarter-wavelength transformers, such that the power through the vertical transmission lines 2724 are equally distributed among one another.

For optimal performance at a particular frequency, the dimensions of the patches 2720, the striplines 2724 and transmission line 2726, the apertures 2750, and the center-to-center spacing 2760 are individually calculated so that a high-order standing wave is generated in the antenna cavity formed within the dielectric 2712, and so that fields radiated from the radiating edges 2720*b* interfere constructively with one another.

The number of patches 2720 determines not only the overall size, but also the directivity, of the antenna 2700. The sidelobe levels of the antenna 2700 are determined by the field distribution at the radiating edges 2720*b*. Therefore, antenna characteristics, such as directivity and sidelobe levels, are controlled by the size and the position of each of the patches 2720 and the feeding scheme. To achieve high directivity, the field distribution among the radiating elements 2720 is assumed to be as uniform as possible. There are electric field null points in the dielectric layer 2712 proximal to the patches 2720 and striplines 2724. In some instances, one or more shortening pins (not shown) may be disposed in the antenna 2700 electrically connecting together the ground plane, patches, and/or striplines to suppress unwanted mode excitations. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

A conventional SMA probe 2770 (FIG. 28) is provided for single-mode operation, such as transmitting or receiving beams. The SMA probe 2770 includes, for delivering EM energy to or from the antenna 2700, an outer conductor 2772 which is electrically connected to the ground plane 2716, and an inner (or feed) conductor 2774 which is electrically connected and centrally positioned along the transmission line 2726 for proper radiation. While it is preferable that the probe 2770 be an SMA probe, any suitable coaxial probe and/or connection arrangement may be used to implement the foregoing connections. For example, a conductive adhesive (not shown) may be used to bond and maintain contact between the inner conductor 2774 and the center stripline 2726*a*, and an appropriate seal (not shown) may be provided where the SMA probe 2770 passes through the ground plane 2716 to hermetically seal the connection. It is understood that the other end of the SMA probe 2770, not connected to the antenna 2700, is connectable via a cable (not shown) to a signal generator or to a receiver, such as a satellite signal decoder used with television signals.

In operation, the antenna 2700 may be used for transmitting or receiving linearly polarized (LP) EM beams. In the transmission of an EM beam, exemplified using a signal from the SMA probe 2770 to the transmission line 2726, the incoming signal travels as a traveling wave along the transmission line 2726 through the first portions 2726*a*, the second portions 2726*b*, which behave as a quarter-wavelength transformer, and then through further quarter-wavelength transformers and power dividers to transport the EM power ultimately to striplines 2724 with minimal reflection and relatively uniform power distribution among the vertical striplines 2724. The EM power is transmitted through the striplines 2724 to the array of patches 2720. The patches 2720 then induce a high-order standing wave for proper radiation through the radiating edges 2720*b* of each patch 2720 of the antenna 2700.

It is well known that antennas transmit and receive signals reciprocally. It can be appreciated, therefore, that operation of the antenna 2700 for transmitting signals is reciprocally identical to that of the antenna for receiving signals. Thus, for example, the antenna 2700 may be positioned in a residential home and directed for receiving from a geostationary, or equatorial, satellite a beam carrying a television signal within a predetermined frequency band or channel. The antenna 2700 is so directed by orienting the top surface 2712*b* toward the source of the beam so that it is generally perpendicular to the direction of the beam. Assuming that the elements of the antenna 2700 are correctly sized for receiving the beam, then the beam will pass through the apertures 2750 and induce a standing wave that will resonate within the resonant cavity of the array of patches 2720 in the dielectric layer 2712. A standing wave induced in the resonant cavity defined in the dielectric layer 2712 leaks EM power through the transmission line network comprising the striplines 2724 and 2726 to the SMA probe 2770, and is delivered to a receiver, such as a decoder (not shown). It is well known that antennas transmit and receive signals reciprocally. It can be appreciated, therefore, that operation of the antenna 2700 for transmitting signals is reciprocally identical to that of the antenna for receiving signals. The transmission of signals by the antenna 2700 will, therefore, not be further described herein.

It is understood that the present invention can take many forms and embodiments. The embodiments described with respect to FIGS. 27 and 28 are intended to illustrate rather than to limit the invention. Accordingly, several variations may be made in the foregoing without departing from the spirit or the scope of the invention. For example, additional patches 2720 may be provided for narrowing a beam, or fewer patches 2720 may be utilized to reduce the physical space required for the antenna 2700 of the present invention.

FIGS. 29-31

Figure 29A:
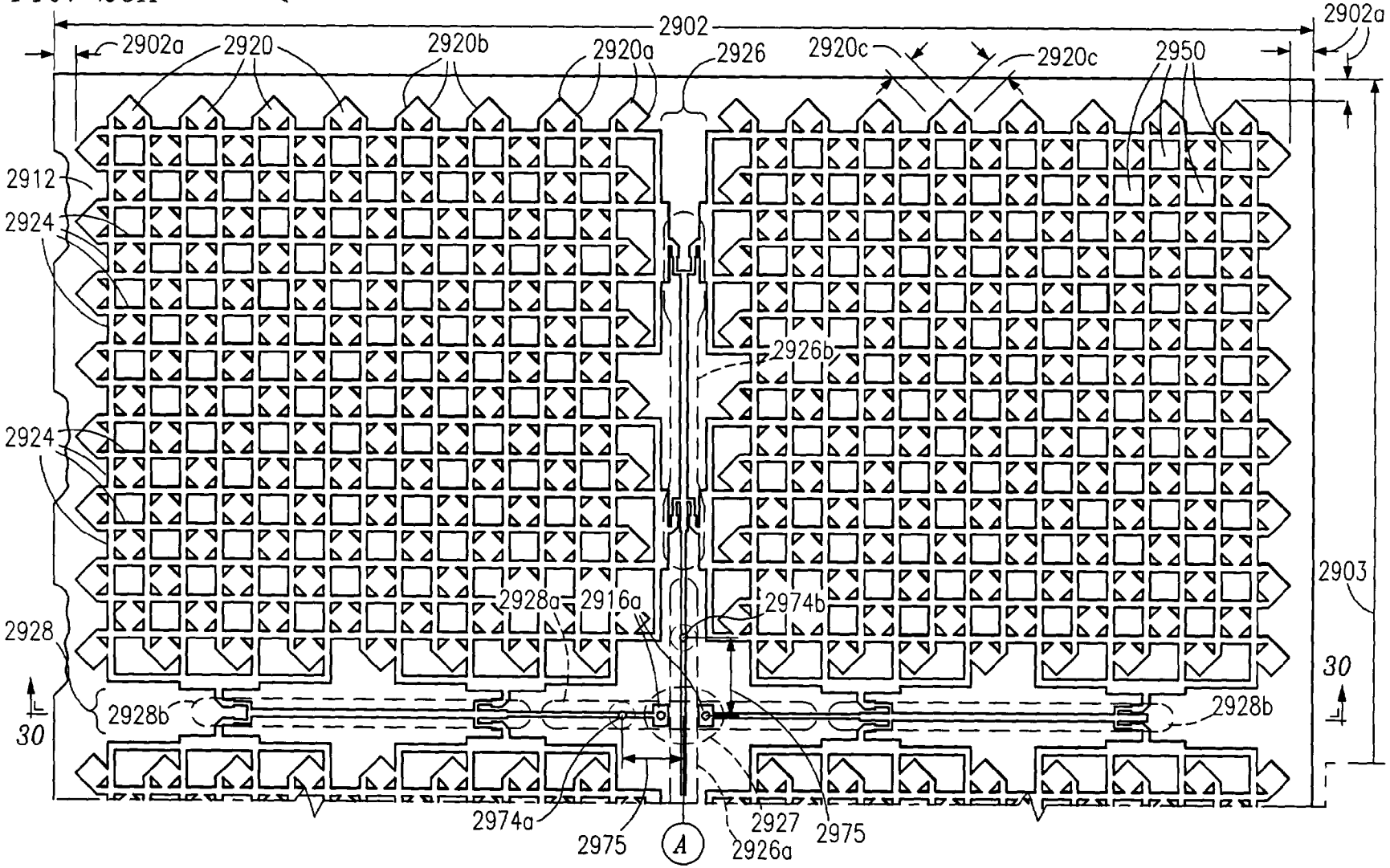
FIGS. 29A and 29B are a plan view of a planar array antenna.
Figure 29B:
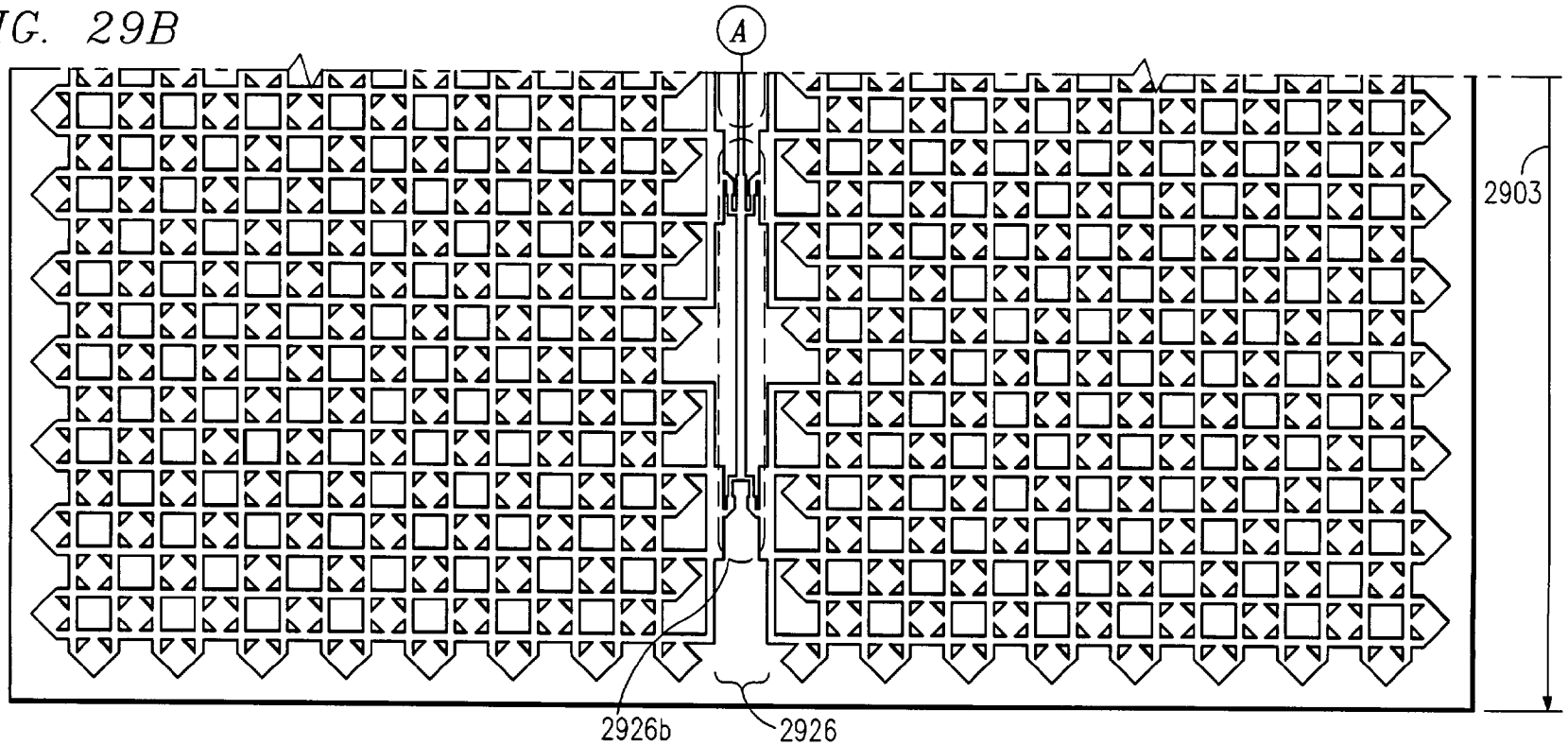
Figure 30:
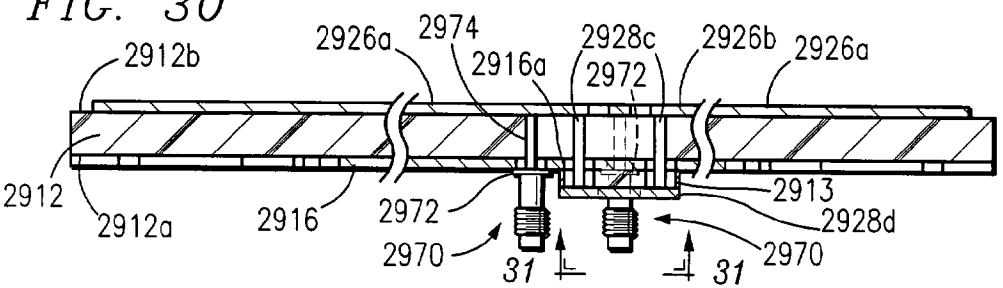
FIG. 30 is an elevation cross-sectional view of the antenna of FIGS. 29A and 29B taken along the line 30-30 of FIGS. 29A and 29B.

Referring to FIGS. 29A and 29B (hereinafter "FIG. 29") and FIG. 30, the reference numeral 2900 designates, in general, a planar microstrip array antenna embodying features of the present invention for dual-mode operation, such as transmitting or receiving beams. The antenna 2900 includes a generally square, dielectric layer 2912. The width 2902 and length 2903 of the layer 2912 may be equal or unequal, and are determined by the number of patches used, discussed below, and, preferably, extends a width and length 2902*a* of at least $0.50\lambda_\epsilon$ beyond the outer edges of patches 2920.

Referring to FIG. 30, the dielectric layer 2912 defines a bottom side 2912*a* to which a conductive ground plane 2916 is bonded, and a top side 2912*b* to which an array of conductive radiating patches 2920 (FIG. 29) are bonded for forming a resonant cavity within the dielectric layer 2912, between the ground plane 2916 and the patches 2920 and striplines 2924.

Referring back to FIG. 29, the patches 2920 are generally square in shape, having four corners 2920*a* and four radiating edges 2920*b*, each having a length 2920*c* of about $0.5\lambda_\epsilon$. As viewed in FIG. 29, the patches 2920 are electrically interconnected via two, three or four corners 2920*a* to an array of substantially horizontal and vertical conductive striplines 2924, which are bonded to the dielectric layer 2912. The striplines 2924 are in turn electrically interconnected via a substantially horizontal conductive transmission line 2926 and a substantially vertical conductive transmission line 2928. The transmission lines 2926 and 2928 are bonded to the dielectric layer 2912, and the intersection of the transmission lines 2926 and 2928 is denoted in FIG. 29 by dashed outline 2927, described further below with respect to FIG. 30. The width of each stripline 2924 is preferably determined assuming a characteristic impedance of about 50 to 200 ohms. The transmission lines 2926 and 2928 include first portions 2926*a* and 2928*a*, respectively, preferably configured to have a characteristic impedance of about 100 ohms for an input impedance of about 50 ohms, with a feed line 2974 positioned on each of the transmission lines 2926 and 2928, as discussed below with respect to the SMA probe 2970, to ensure proper radiation. Each of the transmission lines 2926 and 2928 further includes two second portions 2926*b* and 2928*b*, respectively, preferably configured as quarter-wavelength transformers to have minimal reflection.

Figure 31:
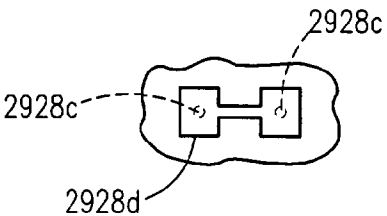
FIG. 31 is a bottom view of a microstrip of the antenna of FIG. 30.

FIG. 30 depicts one preferred configuration wherein the transmission lines 2926 and 2928 may intersect at the dashed outline 2927 without electrical contact. Accordingly, as viewed in FIG. 30, the transmission line 2928 includes a bridge comprising two vias 2928*c* by which it passes under the transmission line 2926, wherein the two vias 2928*c* pass through openings in the ground plane 2916 without electrically contacting the ground plane 2916, and which in turn are electrically connected by a microstrip 2928*d* (FIG. 31) which is electrically insulated from the ground plane 2916 via a dielectric 2913. In an alternative embodiment, the non-conductive intersection of the transmission lines 2926 and 2928 may be achieved by using a directional coupler, described below with respect to FIGS. 31 and 32.

For optimal performance at a particular frequency, the dimensions of the patches 2920, the transmission lines 2924 and 2926, the apertures 2950, and the center-to-center spacing 2960 are individually calculated so that a high-order standing wave is generated in the antenna cavity formed within the dielectric 2912, and so that fields radiated from the radiating edges 2920*b* interfere constructively with one another.

The number of patches 2920 determines not only the overall size, but also the directivity, of the antenna 2900. The sidelobe levels of the antenna 2900 are determined by the field distribution among the radiating elements 2920. Therefore, antenna characteristics, such as directivity and sidelobe levels, are controlled by the size and the position of each of the patches 2920 and the feeding scheme. To achieve high directivity, the field distribution among the radiating elements 2920 is assumed to be as uniform as possible. There are electric field null points in the dielectric layer 2912 proximal to the patches 2920 and striplines 2924. In some instances, one or more shortening pins (not shown) may be disposed in the antenna 2900 electrically connecting together the ground plane, patches, and/or striplines to suppress unwanted mode excitations. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

Two conventional SMA probes 2970 (FIG. 30) are provided for dual-mode operation, such as transmitting and receiving beams. Each SMA probe 2970 includes, for delivering EM energy to or from the antenna 2900, an outer conductor 2972 which is electrically connected to the ground plane 2916, and an inner (or feed line) conductor 2974 which is electrically connected and positioned along the transmission lines 2926 and 2928 to optimize the impedance matching of the antenna 2900. Preferably, the feed lines 2974 are spaced a distance 2975 of about a quarter-wavelength plus multiple of $\lambda_\epsilon$ off-center from where the transmission lines 2926 and 2928 intersect, as indicated within dashed outline 2927 (FIG. 29). While it is preferable that the probes 2970 be SMA probes, any suitable coaxial probe and/or connection arrangement may be used to implement the foregoing connections. For example, a conductive adhesive (not shown) may be used to bond and maintain contact between the feed line 2974 and the center stripline 2926*a*, and an appropriate seal (not shown) may be provided where the SMA probe 2970 passes through the ground plane 2916 to hermetically seal the connection. It is understood that the other end of the SMA probe 2970, not connected to the antenna 2900, is connectable via a cable (not shown) to a signal generator or to a receiver such as a satellite signal decoder used with television signals.

In operation, the antenna 2900 may be used for transmitting and/or receiving linearly polarized (LP) EM beams. In the transmission of an EM beam, exemplified using signals from the SMA probes 2970 to the transmission lines 2926 and 2928, the incoming signal travels as a traveling wave along the transmission lines 2926 and 2928 through the first portions 2926*a* and 2928*a*, respectively, to transport the EM power to the two branches 2926*b* and 2928*b* and subsequently striplines 2924 with minimal reflection. The EM power is transmitted through the striplines 2924 to the array of patches 2920. The patches 2920 and portions of the striplines 2924 then induce a high-order standing wave for proper radiation through the apertures 2950 of the antenna 2900.

In the antenna 2900, the vertical modal excitation becomes orthogonal to that of the horizontal mode so that the cross talk between the two input signals will be minimized. In other words, two orthogonal vertical and horizontal modes can be excited independently.

It is well known that antennas transmit and receive signals reciprocally. It can be appreciated, therefore, that operation of the antenna 2900 for transmitting signals is reciprocally identical to that of the antenna for receiving signals. Thus, for example, the antenna 2900 may be positioned in a residential home and directed for receiving from a geostationary, or equatorial, satellite a beam carrying a television signal within a predetermined frequency band or channel. The antenna 2900 is so directed by orienting the top surface 2912*b* toward the source of the beam so that it is generally perpendicular to the direction of the beam. Assuming that the elements of the antenna 2900 are correctly sized for receiving the beam, then the beam will pass through the apertures 2950 and induce a standing wave that will resonate within the resonant cavity in the dielectric layer 2912 between the array of patches 2920 and the striplines 2924 and the ground plane 2916. A standing wave induced in the resonant cavity defined in the dielectric layer 2912 is transmitted through the transmission line network comprising the striplines 2924 and 2926 to the SMA probes 2970 and is delivered to a receiver, such as a decoder (not shown). It is well known that antennas transmit and receive signals reciprocally. It can be appreciated, therefore, that operation of the antenna 2900 for transmitting signals is reciprocally identical to that of the antenna for receiving signals. The transmission of signals by the antenna 2900 will, therefore, not be further described herein.

It is understood that the present invention can take many forms and embodiments. The embodiments described with respect to FIGS. 29 and 30 are intended to illustrate rather than to limit the invention. Accordingly, several variations may be made in the foregoing without departing from the spirit or the scope of the invention. For example, additional patches 2920 may be provided for narrowing a beam, or fewer patches 2920 may be utilized to reduce the physical space required for the antenna 2900 of the present invention. With proper modification near the feeding area, dual-mode operation with two orthogonal circular polarizations (CP) can be achieved.

FIGS. 32-33

Figure 32:
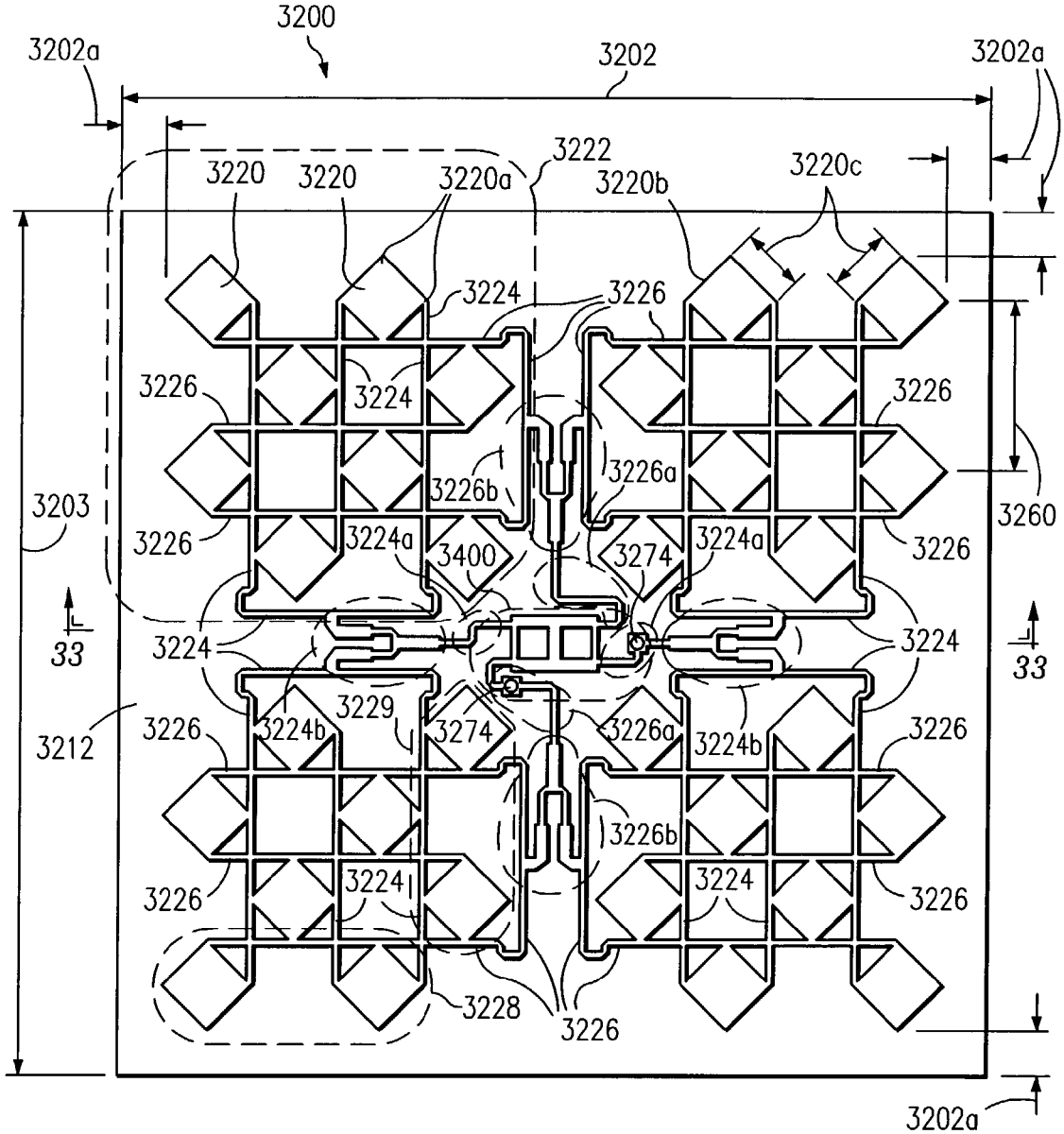
FIG. 32 is a plan view of a planar array antenna.
Figure 33:
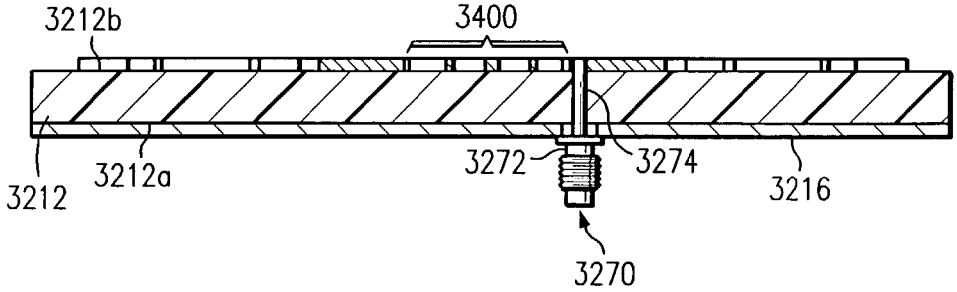
FIG. 33 is an elevation cross-sectional view of the antenna of FIG. 32 taken along the line 33-33 of FIG. 32.

Referring to FIGS. 32 and 33, the reference numeral 3200 designates, in general, a planar microstrip array antenna embodying features of the present invention for dual-mode operation, such as transmitting and receiving beams. The antenna 3200 includes a generally square, dielectric layer 3212. The width 3202 and length 3203 (FIG. 32) of the layer 3212 may be equal or different, and are determined by the number of patches used, as discussed below, and, preferably, extends a width and length 3202*a* of at least $0.50\lambda_\epsilon$ beyond the outer edges of patches 3220.

Referring to FIG. 33, the dielectric layer 3212 defines a bottom side 3212*a* to which a conductive ground plane 3216 is bonded, and a top side 3212*b* to which an array of conductive radiating patches 3220 are bonded for forming a resonant cavity within the dielectric layer 3212, between the patches 3220, the striplines 3224 and 3226, and the ground plane 3216. Referring to FIG. 32, the patches 3220 are generally square in shape, having four corners 3220*a* and four radiating edges 3220*b*, each having a length 3220*c* of about $0.5\lambda_\epsilon$. As viewed in FIG. 32, the patches 3220 are electrically interconnected via corners 3220*a* to an array of substantially vertical conductive striplines 3224 and horizontal conductive striplines 3226. The striplines 3224 and 3226 are electrically interconnected via respective transmission lines 3224*a*, 3224*b*, 3226*a*, and 3226*b* to a directional coupling 3400, described in further detail below with respect to FIG. 34, for communicating EM energy with a probe, described in further detail with respect to the SMA probes 3270. The striplines 3224, 3226, and transmission lines 3224*a*, 3224*b*, 3226*a*, and 3226*b* are bonded to the dielectric layer 3212. The patches 3220 are spaced apart by a center-to-center distance 3260 of preferably about $1\lambda_\epsilon$. The patches 3220 are preferably arranged in four sub-arrays and, within each sub-array, into a plurality of rows and columns on the top surface 3212*b*, representatively exemplified in dashed outlines by a sub-array 3222 having rows 3228 and columns 3229 offset from each other. The width of each stripline 3224 and 3226 is preferably determined assuming a characteristic impedance of about 50 to 200 ohms. The transmission lines 3224*a* and 3226*a* are preferably configured to have a characteristic impedance of about 100 ohms for an input impedance of about 50 ohms, with a feed line positioned on the striplines 3224 and 3226, as discussed below with respect to the SMA probes 3270, to ensure a proper phase for each stripline and patch so that an optimum gain results. The transmission lines 3224*b* and 3226*b* are preferably configured as two quarter-wavelength transformers in series to have minimal reflection.

For optimal performance at a particular frequency, the dimensions of the patches 3220, the striplines 3224, 3226, and the apertures 3250, the center-to-center spacing 3260, and the coupler 3100 are individually calculated so that a high-order standing wave is generated in the antenna cavity formed by the dielectric 3212, and so that fields radiated from the radiating edges 3220*b* interfere constructively with one another.

The number of patches 3220 determines not only the overall size, but also the directivity, of the antenna 3200. The sidelobe levels of the antenna 3200 are determined by the field distribution among the radiating elements 3220. Therefore, antenna characteristics, such as directivity and sidelobe levels, are controlled by the size and the position of each of the patches 3220 and the feeding scheme. To achieve high directivity, the field distribution among the radiating elements 3220 is assumed to be as uniform as possible. There are electric field null points in the dielectric layer 3212 within the patches 3220 and striplines 3224 and 3226. In some instances, one or more shortening pins (not shown) may be disposed in the antenna 3200 electrically connecting together the ground plane, patches, and/or striplines to suppress unwanted mode excitations. The foregoing calculations and analysis utilize techniques, such as the cavity model, discussed, for example, by Lee and Hsieh, and the moment method, discussed, for example, in the software Ensemble™ available from Anasoft Corp., and will, therefore, not be discussed in further detail herein.

Two conventional SMA probes 3270 (only one of which is shown in FIG. 33) are provided for dual-mode operation, such as transmitting and receiving beams. Each SMA probe 3270 includes, for delivering EM energy to and/or from the antenna 3200, an outer conductor 3272 which is electrically connected to the ground plane 3216, and an inner (or feed) conductor 3274 which is electrically connected to and positioned along a respective transmission line 3224*a* or 3226*a* to ensure a proper phase for each stripline and patch so that an optimum gain results. While it is preferable that the probes 3270 be SMA probes, any suitable coaxial probe and/or connection arrangement may be used to implement the foregoing connections. For example, a conductive adhesive (not shown) may be used to bond and maintain contact between an inner conductor 3274 and the transmission line 3224*a*, and an appropriate seal (not shown) may be provided where the SMA probe 3270 passes through the ground plane 3216 to hermetically seal the connection. It is understood that the other end of the SMA probes 3270, not connected to the antenna 3200, are connectable via a cable (not shown) to a signal generator or to a receiver, such as a satellite signal decoder used with television signals.

In operation, the antenna 3200 may be used for transmitting and receiving linearly polarized (LP) EM beams. In the transmission of an EM beam, exemplified using a signal from the SMA probe 3270 with feed line to the transmission line 3224*a*, the incoming signal travels as a traveling wave along the transmission line 3224*a* through the coupler 3400 to the opposing transmission line 3224*a*. The transmission line 3224*a* transports the EM power of the signal to the two branch transmission lines 3224*b* and, subsequently, striplines 3224 of each branch transmission line 3224*b* with minimal reflection. The EM power is transmitted through the striplines 3224 to the array of patches 3220. The patches 3220 and portions of the striplines 3224 then induce a high-order standing wave for proper radiation through the apertures 3250 of the antenna 3200.

In the transmission of an EM beam, exemplified using a signal from the SMA probe 3270 with feed line to the transmission line 3226*a*, the incoming signal travels as a traveling wave along the transmission line 3226*a* through the coupler 3400 to the opposing transmission line 3226*a*. The transmission line 3226*a* transports the EM power of the signal to the two branch transmission lines 3226*b* and, subsequently, striplines 3226 of each branch transmission line 3226*b* with minimal reflection. The EM power is transmitted through the striplines 3226 to the array of patches 3220. The patches 3220 then induce a high-order standing wave for proper radiation through the apertures 3250 of the antenna 3200.

In the antenna 3200, the vertical modal excitation becomes orthogonal to that of the horizontal mode so that the cross-talk between the two input signals will be minimized. In other words, two orthogonal vertical and horizontal modes can be excited independently.

It is well known that antennas transmit and receive signals reciprocally. It can be appreciated, therefore, that operation of the antenna 3200 for transmitting signals is reciprocally identical to that of the antenna for receiving signals. Thus, for example, the antenna 3200 may be positioned in a residential home and directed for receiving from a geostationary, or equatorial, satellite a beam carrying a television signal within a predetermined frequency band or channel. The antenna 3200 is so directed by orienting the top surface 3212*b* toward the source of the beam so that it is generally perpendicular to the direction of the beam. Assuming that the elements of the antenna 3200 are correctly sized for receiving the beam, then the beam will pass through the apertures 3250 and induce a standing wave that will resonate within the dielectric layer 3212. A standing wave induced in the resonant cavity defined within the dielectric layer 3212 leaks electromagnetic power through the striplines 3224 and 3226 and coupler 3400 to the appropriate SMA probe 3270 and delivered to a receiver, such as a decoder (not shown).

It is understood that the present invention can take many forms and embodiments. The embodiments described with respect to FIGS. 32 and 33 are intended to illustrate rather than to limit the invention. Accordingly, several variations may be made in the foregoing without departing from the spirit or the scope of the invention. For example, additional patches 3220 may be provided for narrowing a beam, or fewer patches 3220 may be utilized to reduce the physical space required for the antenna 3200 of the present invention. With proper modification near the feeding area, dual-mode operation with two orthogonal circular polarizations (CP) can be achieved.

FIGS. 34-35

Figure 34:
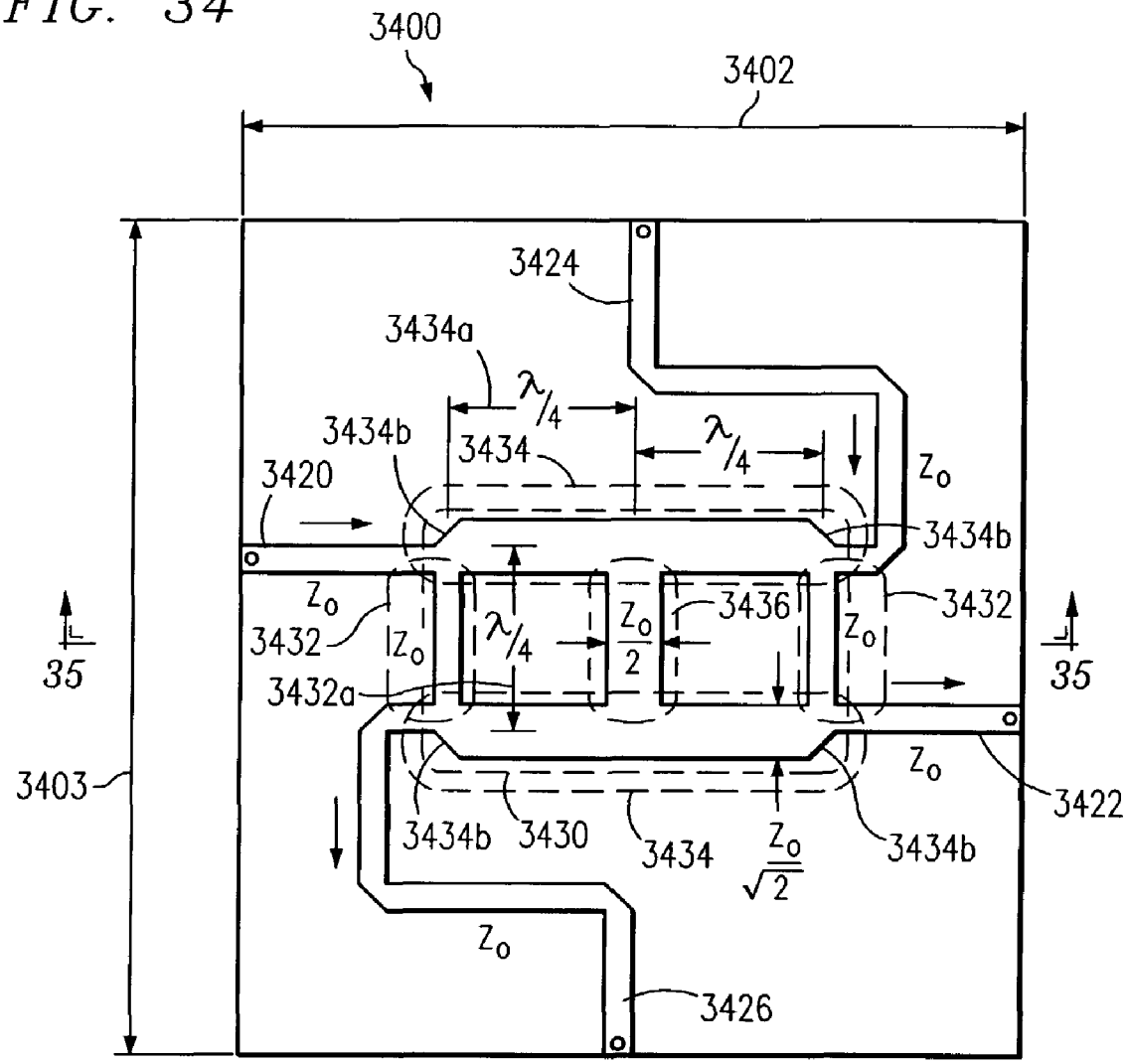
FIG. 34 is a plan view of a planar microstrip directional coupler embodying features of the present invention for coupling two EM energy sources to two EM energy destinations.

Referring to FIG. 34, the reference numeral 3400 designates, in general, a planar microstrip directional coupler embodying features of the present invention for coupling two EM energy sources to two EM energy destinations, so that EM energy may be communicated to/from the two sources from/to the two destinations without interference. As described above with respect to FIGS. 32-33, the coupler 3400 is preferably integrated into a microstrip antenna, such as the antenna 2900 and the antenna 3200. However, the coupler 3400 may also function as a standalone coupler, as shown in FIG. 34, and, for the sake of simplicity, will be so described herein. Accordingly, the coupler 3400 includes a generally square, dielectric layer 3412. The dielectric layer 3412 has a width 3402 and length 3403 which may be equal or unequal.

Figure 35:
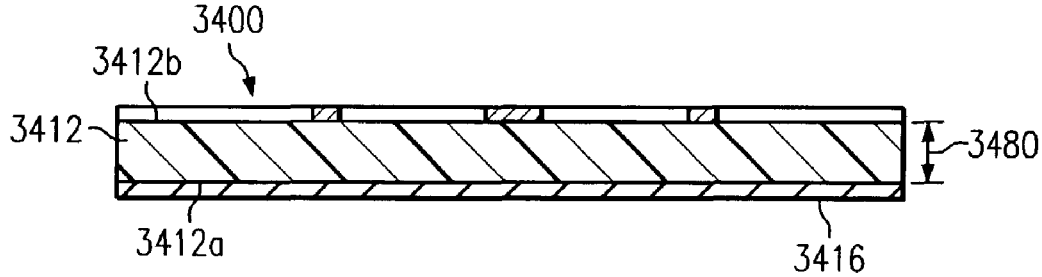
FIG. 35 is an elevation cross-sectional view of the coupler of FIG. 34 taken along the line 35-35 of FIG. 34.

Referring to FIG. 35, the dielectric layer 3412 defines a bottom side 3412*a* to which a conductive ground plane 3416 may optionally be bonded and a top side 3412*b* to which an array of conductive striplines are bonded for forming the directional coupler. The striplines include first striplines 3420 and 3422, between which EM energy is transferred, and second striplines 3424 and 3426, between which EM energy is transferred. The width of each stripline 4124 is preferably determined assuming a characteristic impedance $Z_0$ of about 50 to 200 ohms.

The striplines 3420, 3422, 3424, and 3426 are connected to a substantially rectangular bridge 3430 having, as viewed in FIG. 34, two end portions 3432, top and bottom portions 3434, and a mid-section portion 3432. Preferably, the width of each end portion 3432 is determined assuming a characteristic impedance $Z_0$ of about 50 to 200 ohms, and the length 3432*a* of each end portion 3432 is about $0.25\lambda_\epsilon$. Preferably, the width of each top and bottom portion 3434 is determined assuming a characteristic impedance $Z_0$/(square root of 2) of about 35 to 141 ohms, and the length 3434*a* of each half of each end portion 3432 is about $0.25\lambda_\epsilon$. Each top and bottom portion 3434 is further characterized by an end 3434*b* chamfered at an angle of about 45°, relative to the top and bottom portions. Preferably, the width of the mid-section portion 3436 is determined assuming a characteristic impedance $Z_0/2$ of about 25 to 100 ohms.

In operation, when coupler 3400 is used in conjunction with the antenna array of FIG. 29, a line, such as the line 2928*a* depicted in FIG. 29, is connected to each first stripline 3420 and 3422, and a line, such as the line 2926*a* depicted by FIG. 29, is connected to each first stripline 3424 and 3426. EM energy on the stripline 2928*a* is passed from the stripline 3420 to the stripline 3422 (or from the stripline 3422 to the stripline 3420) with substantially negligible loss to the striplines 3424 and 3426. Similarly, EM energy on the stripline 2926*a* passes from the stripline 3424 to the stripline 3426 (or from the stripline 3426 to the stripline 3424) with substantially negligible loss to the striplines 3420 and 3422.

It is understood, too, that any of the aforementioned antennas, configured for operation at one frequency, may be reconfigured for operation at substantially any other desired frequency without significantly altering characteristics, such as the radiation pattern and efficiency of the antenna at the one frequency, by generally scaling each dimension of the antenna in direct proportion to the ratio of the desired frequency to the one frequency, provided that the dielectric constant of the dielectric layers remains substantially the same at the desired frequency as at the one frequency.

Although illustrative embodiments of the invention have been shown and described, a wide range of modification, change, and substitution is contemplated in the foregoing disclosure and, in some instances, some features of the present invention may be employed without a corresponding use of the other features. Accordingly, it is appropriate that the appended claims be construed broadly and in a manner consistent with the scope of the invention, and with the understanding that the reference numerals provided parenthetically are provided by way of example for the convenience and efficiency of examination, and are not to be construed as limiting any claim in any way.

What is claimed is:

1. An antenna (100-3300), comprising:

a dielectric layer defining a first side and a second side;

one or more conductive ground plane elements disposed on the first side of the dielectric layer;

a two-dimensional array of spaced-apart, radiating patches disposed on the second side of the dielectric layer;

one or more microstrips disposed on the second side of the dielectric layer and connected directly to at least one corner of each of a plurality of immediately adjacent patches, such that each of the patches is directly coupled electrically to immediately adjacent patches in each of the two dimensions, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator.

2. The antenna (100-3300) of claim 1, wherein the patches and microstrips are sized and positioned so that, responsive to electromagnetic energy, a high-order standing wave is induced in the antenna.

3. The antenna (100-3300) of claim 1 wherein the antenna is planar.

4. The antenna (100-1800) of claim 1, further comprising at least one feeding means electrically connected to the one or more ground plane elements and at least one patch for feeding electromagnetic energy to and/or extracting electromagnetic energy from the antenna.

5. The antenna (100-1800) of claim 1, further comprising at least one feeding means having a first conducting element electrically connected to the one or more ground plane elements and a second conducting element electrically connected to at least one patch for feeding electromagnetic energy to and/or extracting electromagnetic energy from the antenna.

6. The antenna (100-1800) of claim 1, further comprising at least one of a probe, an SMA probe, an aperture-coupled line, and a microstrip electrically connected to the one or more ground plane elements and at least one patch for feeding electromagnetic energy to and/or extracting electromagnetic energy from the antenna.

7. The antenna (100-1800) of claim 1, further comprising at least two feeding means, each of which comprise one of a probe, an SMA probe, an aperture-coupled line, and a microstrip, each of which feeding means are orthogonally electrically connected to the one or more ground plane elements and at least one patch for feeding electromagnetic energy to and/or extracting electromagnetic energy from the antenna.

8. The antenna (100-1300) of claim 1, wherein the patches are arranged in a square array of equal rows and columns.

9. The antenna (100) of claim 1, further comprising at least one tuning stub disposed on the second side of the dielectric layer and extending substantially perpendicularly from at least one of said at least one microstrips.

10. The antenna (1900-3300) of claim 1, further comprising the at least one feeding means electrically connected to the ground plane elements and through at least one transmission line and at least one microstrip to at least one patch for feeding electromagnetic energy to and/or extracting electromagnetic energy from the antenna.

11. The antenna (1900-3300) of claim 1, further comprising the at least one feeding means having a first conducting element electrically connected to the ground plane elements and a second conducting element electrically connected through at least one transmission line and at least one microstrip to at least one patch for feeding electromagnetic energy to and/or extracting electromagnetic energy from the antenna.

12. The antenna (1900-3300) of claim 1, further comprising at least one of a probe, an SMA probe, an aperture-coupled line, and a microstrip electrically connected to the one or more ground plane elements and through at least one transmission line and at least one microstrip to at least one patch for feeding electromagnetic energy to and/or extracting electromagnetic energy from the antenna.

13. The antenna (2300, 2900, 3200) of claim 1, further comprising at least two feeding means, each of which comprise one of a probe, an SMA probe, an aperture-coupled line, and a microstrip, each of which feeding means are orthogonally electrically connected to the one or more ground plane elements and through at least one transmission line and at least one microstrip to at least one patch for feeding electromagnetic energy to and/or extracting electromagnetic energy from the antenna.

14. The antenna (1900, 2100, 2500) of claim 1, further comprising at least one feeding means electrically connected to the one or more ground plane elements and through a transmission line connected to a plurality of microstrips connected to at least one corner of at least one patch for feeding electromagnetic energy to and/or extracting electromagnetic energy from the antenna.

15. The antenna (1900, 2500) of claim 1, further comprising at least one feeding means electrically connected to the one or more ground plane elements and through a transmission line connected to a plurality of microstrips connected to at least one corner of at least one patch for feeding electromagnetic energy to and/or extracting electromagnetic energy from the antenna, and wherein the transmission line is centrally disposed on the second side of the dielectric layer.

16. The antenna (2100) of claim 1, further comprising at least one feeding means electrically connected to the one or more ground plane elements and through a transmission line connected to a plurality of microstrips connected to at least one corner of at least one patch for feeding electromagnetic energy to and/or extracting electromagnetic energy from the antenna, and wherein the transmission line is disposed on the second side of the dielectric layer outside the array of patches.

17. The antenna (100-3300) of claim 1, wherein the one or more microstrips are substantially uninterrupted by the plurality of patches.

18. The antenna (100-3300) of claim 1, wherein the standing wave formed in the at least one resonant cavity is two-dimensional.

19. The antenna (100-3300) of claim 1, wherein the one or more microstrips are substantially uninterrupted by the plurality of patches, and wherein the standing wave formed in the at least one resonant cavity is two-dimensional.

20. The antenna (100-3300) of claim 1, wherein the two-dimensional array comprises four or more radiating patches.

21. An antenna (100-3300), comprising:

a dielectric layer defining a first side and a second side;

one or more conductive ground plane elements disposed on the first side of the dielectric layer;

a plurality of spaced-apart, radiating patches disposed on the second side of the dielectric layer;

one or more microstrips disposed on the second side of the dielectric layer and electrically connected to at least one corner of each patch such that the one or more microstrips are substantially uninterrupted by the plurality of patches, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator;

wherein the patches include at least four patches, and each patch includes first and second diametrically opposed corners and third and fourth diametrically opposed corners, and wherein the microstrips are apportioned between a first group of parallel microstrips and a second group of parallel microstrips, the microstrips in the first group of microstrips being oriented substantially perpendicular to the microstrips in the second group of microstrips, and wherein the first group of microstrips electrically interconnects together at least one of the first and second diametrically opposed corners of each of at least two of the at least four patches, and wherein the second group of microstrips electrically interconnects together at least one of the third and fourth diametrically opposed corners of each of at least two of the at least four patches.

22. An antenna (100-3300), comprising:

a dielectric layer defining a first side and a second side;

one or more conductive ground plane elements disposed on the first side of the dielectric layer;

a plurality of spaced-apart, radiating patches disposed on the second side of the dielectric layer;

one or more microstrips disposed on the second side of the dielectric layer and electrically connected to at least one corner of each patch such that the one or more microstrips are substantially uninterrupted by the plurality of patches, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator;

wherein the patches include at least four patches, and each patch includes first and second diametrically opposed corners and third and fourth diametrically opposed corners, and wherein the microstrips are apportioned between a first group of parallel microstrips and a second group of parallel microstrips, the microstrips in the first group of microstrips being oriented substantially perpendicular to the microstrips in the second group of microstrips, and wherein the first group of microstrips electrically interconnects together at least one of the first and second diametrically opposed corners of each of at least two of the at least four patches, and wherein the second group of microstrips electrically interconnects together at least one of the third and fourth diametrically opposed corners of each of at least two of the at least four patches, and wherein the antenna further comprises one tuning stub extending outwardly from each corner of a patch.

23. An antenna (100-3300), comprising:

a dielectric layer defining a first side and a second side;

one or more conductive ground plane elements disposed on the first side of the dielectric layer;

a plurality of spaced-apart, radiating patches disposed on the second side of the dielectric layer;

one or more microstrips disposed on the second side of the dielectric layer and electrically connected to at least one corner of each patch such that the one or more microstrips are substantially uninterrupted by the plurality of patches, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator;

wherein the patches include at least four patches, and each patch includes first and second diametrically opposed corners and third and fourth diametrically opposed corners, and wherein the microstrips are apportioned between a first group of parallel microstrips and a second group of parallel microstrips, the microstrips in the first group of microstrips being oriented substantially perpendicular to the microstrips in the second group of microstrips, and wherein the first group of microstrips electrically interconnects together at least one of the first and second diametrically opposed corners of each of at least two of the at least four patches, and wherein the second group of microstrips electrically interconnects together at least one of the third and fourth diametrically opposed corners of each of at least two of the at least four patches, and wherein the antenna further comprises one tuning stub extending outwardly from one corner of each of four patches toward a common point.

24. An antenna (100-3300), comprising:

a dielectric layer defining a first side and a second side;

one or more conductive ground plane elements disposed on the first side of the dielectric layer;

a plurality of spaced-apart, radiating patches disposed on the second side of the dielectric layer;

one or more microstrips disposed on the second side of the dielectric layer and electrically connected to at least one corner of each patch such that the one or more microstrips are substantially uninterrupted by the plurality of patches, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator;

wherein the patches include at least four patches, and each patch includes first and second diametrically opposed corners and third and fourth diametrically opposed corners, and wherein the microstrips are apportioned between a first group of parallel microstrips, a second group of parallel microstrips, and a third group of microstrips, the microstrips in the first group of microstrips being oriented substantially perpendicular to the microstrips in the second group of microstrips, the microstrips in the third group of microstrips being oriented at substantially 45° to the microstrips in the first and second groups of microstrips, and wherein the first group of microstrips electrically interconnects together at least one of the first and second diametrically opposed corners of each of at least two of the at least four patches, and wherein the second group of microstrips electrically interconnects together at least one of the third and fourth diametrically opposed corners of each of at least two of the at least four patches, and wherein, for at least one group of four patches, the antenna further comprises one tuning stub extending outwardly toward a common point from one corner of each of the four patches constituting the at least one group of patches, and one microstrip from the third group of microstrips interconnects each tuning stub with each of two closest tuning stubs.

25. An antenna (100-3300), comprising:

a dielectric layer defining a first side and a second side;

one or more conductive ground plane elements disposed on the first side of the dielectric layer;

a plurality of spaced-apart, radiating patches disposed on the second side of the dielectric layer;

one or more microstrips disposed on the second side of the dielectric layer and electrically connected to at least one corner of each patch such that the one or more microstrips are substantially uninterrupted by the plurality of patches, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator;

wherein the patches include at least four patches, and each patch includes first and second diametrically opposed corners and third and fourth diametrically opposed corners, and wherein the microstrips are apportioned between a first group of parallel microstrips, a second group of parallel microstrips, and a third group of microstrips, the microstrips in the first group of microstrips being oriented substantially perpendicular to the microstrips in the second group of microstrips, the microstrips in the third group of microstrips being oriented at substantially 45° to the microstrips in the first and second groups of microstrips; and wherein the first group of microstrips electrically interconnects together at least one of the first and second diametrically opposed corners of each of at least two of the at least four patches, and wherein the second group of microstrips electrically interconnects together at least one of the third and fourth diametrically opposed corners of each of at least two of the at least four patches; and wherein, for at least one first group of four patches, the antenna further comprises one short stub extending outwardly toward a common point from one corner of each of the four patches constituting the at least one group of patches, and one microstrip from the third group of microstrips interconnects each short stub with each of two closest short stubs; and wherein, for at least one second group of four patches, the antenna further comprises one tuning stub extending outwardly toward a common point from one corner of each of the four patches constituting the at least one group of patches, and one microstrip from the third group of microstrips interconnects each tuning stub with each of two closest tuning stubs, each tuning stub extending beyond the interconnection point of the respective microstrips and tuning stubs.

26. An antenna (100-3300), comprising:

a dielectric layer defining a first side and a second side;

one or more conductive ground plane elements disposed on the first side of the dielectric layer;

a plurality of spaced-apart, radiating patches disposed on the second side of the dielectric layer;

one or more microstrips disposed on the second side of the dielectric layer and electrically connected to at least one corner of each patch such that the one or more microstrips are substantially uninterrupted by the plurality of patches, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator;

wherein the antenna is a linear array antenna defining a first side and a second side, and wherein the antenna includes at least three patches, each of which define first corners proximate to the first side, and second corners proximate to the second side; and wherein, between two adjacent patches, the microstrips electrically interconnect a first corner of each patch with a second corner of the adjacent patch and those two microstrips are crisscrossed; and wherein the antenna further comprises at least one tuning stub extending outwardly from at least one corner of one patch, which corner is also connected to a microstrip.

27. An antenna (100-3300), comprising:

a dielectric layer defining a first side and a second side;

one or more conductive ground plane elements disposed on the first side of the dielectric layer;

a plurality of spaced-apart, radiating patches disposed on the second side of the dielectric layer;

one or more microstrips disposed on the second side of the dielectric layer and electrically connected to at least one corner of each patch such that the one or more microstrips are substantially uninterrupted by the plurality of patches, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator;

a first feeding means electrically connected to the one or more ground plane elements and through a first transmission line connected to a plurality of substantially parallel first microstrips to at least one corner of at least one patch for feeding electromagnetic energy to and/or extracting electromagnetic energy from the antenna, wherein the first transmission line is substantially perpendicular to the first microstrips and positioned outside the plurality of patches; and a second feeding means electrically connected to the one or more ground plane elements and through a second transmission line connected to a plurality of substantially parallel second microstrips to at least one corner of at least one patch for feeding electromagnetic energy to and/or extracting electromagnetic energy from the antenna, wherein the second transmission line is substantially perpendicular to the second microstrips and positioned outside the plurality of patches, and wherein the first microstrips are substantially perpendicular to the second microstrips.

28. An antenna (100-3300), comprising:

a dielectric layer defining a first side and a second side;

one or more conductive ground plane elements disposed on the first side of the dielectric layer;

a plurality of spaced-apart, radiating patches disposed on the second side of the dielectric layer;

one or more microstrips disposed on the second side of the dielectric layer and electrically connected to at least one corner of each patch such that the one or more microstrips are substantially uninterrupted by the plurality of patches, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator;

at least one feeding means electrically connected to the one or more ground plane elements and through a transmission line connected to a plurality of substantially parallel first microstrips connected to at least one first corner of each of at least one patch for feeding electromagnetic energy to and/or extracting electromagnetic energy from the antenna, and wherein the transmission line is generally centrally disposed on the second side of the dielectric layer within the plurality of patches; and a plurality of substantially parallel second microstrips connected to at least one second corner of each of at least one patch, wherein the first microstrips are substantially perpendicular to the second microstrips, and the first corners are diametrically opposed to the second corners.

29. An antenna (100-3300), comprising:

a dielectric layer defining a first side and a second side;

one or more conductive ground plane elements disposed on the first side of the dielectric layer;

a plurality of spaced-apart, radiating patches disposed on the second side of the dielectric layer;

one or more microstrips disposed on the second side of the dielectric layer and electrically connected to at least one corner of each patch such that the one or more microstrips are substantially uninterrupted by the plurality of patches, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator;

a first feeding means electrically connected to the one or more ground plane elements and through a first transmission line connected to a plurality of substantially parallel first microstrips to at least one corner of at least one patch for feeding electromagnetic energy to and/or extracting electromagnetic energy from the antenna, wherein the first transmission line is substantially perpendicular to the first microstrips and generally centrally disposed on the second side of the dielectric layer within the plurality of patches; and a second feeding means electrically connected to the ground plane and through a second transmission line connected to a plurality of substantially parallel second microstrips to at least one corner of at least one patch for feeding electromagnetic energy to and/or extracting electromagnetic energy from the antenna, wherein the second transmission line is substantially perpendicular to the second micro strips and generally centrally disposed on the second side of the dielectric layer within the plurality of patches, wherein the first microstrips are substantially perpendicular to the second microstrips, and wherein the second transmission line further comprises a bridge configured generally at the intersection of the first and second transmission lines, the bridge comprising vias extending from the second transmission line on each side of the first transmission line through apertures formed in the dielectric, the one or more ground plane elements, and a second dielectric to a microstrip disposed on the second dielectric for the transmission of electromagnetic energy across the second transmission line.

30. An antenna (100-3300), comprising:

a dielectric layer defining a first side and a second side;

one or more conductive ground plane elements disposed on the first side of the dielectric layer;

a plurality of spaced-apart, radiating patches disposed on the second side of the dielectric layer;

one or more microstrips disposed on the second side of the dielectric layer and electrically connected to at least one corner of each patch such that the one or more microstrips are substantially uninterrupted by the plurality of patches, wherein the one or more microstrips, the one or more ground plane elements, and the plurality of patches are at least configured to form at least one resonant cavity and wherein a standing wave is formed in the at least one resonant cavity whereby at least one node of the standing wave exists along at least a portion of the one or more microstrips and wherein the dielectric layer, the one or more ground plane elements, the plurality of patches and the one or more microstrips act collectively as a resonator;

a first feeding means electrically connected to the one or more ground plane elements and through first and second portions of a first transmission line connected to a plurality of substantially parallel first microstrips to at least one corner of at least one patch for feeding electromagnetic energy to and/or extracting electromagnetic energy from the antenna, wherein the first transmission line is substantially perpendicular to the first microstrips and generally centrally disposed on the second side of the dielectric layer within the plurality of patches;

a second feeding means electrically connected to the one or more ground plane elements and through first and second portions of a second transmission line connected to a plurality of substantially parallel second microstrips to at least one corner of at least one patch for feeding electromagnetic energy to and/or extracting electromagnetic energy from the antenna, wherein the second transmission line is substantially perpendicular to the second microstrips and generally centrally disposed on the second side of the dielectric layer within the array of patches, wherein the first microstrips are substantially perpendicular to the second microstrips; and a directional coupler configured for providing electrical continuity between the first and second portions of the first transmission line, and for providing electrical continuity between the first and second portions of the second transmission line, such that transmission of electromagnetic energy between the first and second transmission lines is substantially inhibited, the coupler comprising:

a first microstrip longitudinal section defining a first end connected to the first portion of the first transmission line, a second end connected to the first portion of the second transmission line;

a second microstrip longitudinal section defining a first end connected to the second portion of the first transmission line, a second end connected to the second portion of the second transmission line;

a first microstrip end connection section connected between the first end of the first longitudinal section and the first end of the second longitudinal section;

a second microstrip end connection section connected between the second end of the first longitudinal section and the second end of the second longitudinal section; and an intermediate microstrip connection section connected between the mid-section of the first longitudinal section and the mid-section of the second longitudinal section, wherein the first, second, and intermediate connection sections are sized so that the centerlines of the first and second longitudinal sections are spaced apart by about a quarter-wavelength, and so that the centerlines of the first and intermediate connection sections are spaced apart by about a quarter-wavelength, and so that the centerlines of the second and intermediate connection sections are spaced apart by about a quaffer-wavelength, and wherein the widths of the first and second longitudinal sections and the intermediate sections are determined assuming an impedance of X, and the widths of the first and second end connection sections are determined assuming an impedance of about 2X, wherein X is about 25 to 100 ohms.

31. A planar microstrip directional coupler configured for providing electrical continuity between first and second portions of a first transmission line, and for providing electrical continuity between first and second portions of a second transmission line, such that transmission of electromagnetic energy between the first and second transmission lines is substantially inhibited, the coupler comprising:

a first microstrip longitudinal section defining a first end connected to the first portion of the first transmission line, a second end connected to the first portion of the second transmission line;

a second microstrip longitudinal section defining a first end connected to the second portion of the first transmission line, a second end connected to the second portion of the second transmission line;

a first microstrip end connection section connected between the first end of the first longitudinal section and the first end of the second longitudinal section;

a second microstrip end connection section connected between the second end of the first longitudinal section and the second end of the second longitudinal section; and an intermediate microstrip connection section connected between the midpoint of the first longitudinal section and the midpoint of the second longitudinal section, wherein the first, second, and intermediate connection sections are sized so that the centerlines of the first and second longitudinal sections are spaced apart by about a quarter-wavelength, and so that the centerlines of the first and intermediate connection sections are spaced apart by about a quarter-wavelength, and so that the centerlines of the second and intermediate connection sections are spaced apart by about a quarter-wavelength, and wherein the widths of the first and second longitudinal sections and the intermediate sections are determined assuming an impedance of X, and the widths of the first and second end connection sections are determined assuming an impedance of about 2X, wherein X is about 25 to 100 ohms.

32. The coupler of claim 31, wherein each of the first and second ends of the first and second longitudinal sections are chamfered at an angle of about 45°.

33. A microstrip array antenna, comprising:

a single layer of dielectric material;

one or more ground plane elements contiguous a first side of said dielectric material;

a two-dimensional array of patches contiguous a second side of said dielectric material opposite said first side;

a feed terminal; and a plurality of microstrip conductors directly connecting each of the patches electrically to immediately adjacent patches in each of the two dimensions, whereby said feed terminal is physically connected to each of said plurality of patches, at least one cavity formed between the patches such that the plurality of microstrip conductors are substantially uninterrupted by the plurality of patches, the microstrip conductors and the ground plane elements being configured such that at least one standing wave is formed in the at least one cavity whereby some nodes of the standing wave exist at each of said microstrip conductors wherein the dielectric material, the plurality of patches, the plurality of microstrip conductors, and the one or more ground plane elements act collectively as a resonator.

34. The antenna of claim 33, wherein the two-dimensional array comprises at least four or more patches.

35. A method of designing a microstrip array antenna, comprising the steps of:

attaching at least one ground plane element to a first side of a planar dielectric; and configuring a two-dimensional array of radiating patches, a feed terminal connected to associated conductive material that directly connects each of the patches electrically to immediately adjacent radiating patches in each of the two dimensions, on a second side of said planar dielectric, opposite said first side, to insure that a two-dimensional standing wave having a plurality of nodes is formed in at least one cavity between the patches, the associated conductive material and the ground plane element wherein at least some nodes of the standing wave are coincident with the position of said associated conductive material wherein the dielectric, the ground plane element, the patches and the conductive material act collectively as a resonator.

36. The method of claim 35, wherein the associated conductive material is configured as microstrips.

37. The method of claim 35, wherein the associated conductive material connects the feed terminal to each of the radiating patches such that the plurality of microstrip conductors are substantially uninterrupted by the plurality of patches.

38. The method of claim 35, wherein the two-dimensional array comprises four or more radiating patches.

39. A method of designing a microstrip array antenna, comprising the steps of:

attaching at least one ground plane element to a first side of a planar dielectric; and configuring a two-dimensional array of radiating patches, a feed terminal and associated conductive material that connect the feed terminal to each of the radiating patches such that the plurality of microstrip conductors are substantially uninterrupted by the plurality of patches and directly couple each of the patches electrically to immediately adjacent patches in each of the two dimensions, on a second side of said planar dielectric, opposite said first side, to insure that a two-dimensional standing wave having a plurality of nodes is formed in at least one cavity between the patches, the associated conductive material and the ground plane element to provide a predetermined distribution of electromagnetic power over the radiating patches wherein the dielectric, the ground plane element, the patches, and the conductive material act collectively as a resonator.

40. The method of claim 39, wherein the associated conductive material is configured as microstrips and the predetermined distribution is substantially uniform.

41. The method of claim 39, wherein the associated conductive material is configured as microstrips and the predetermined distribution is tapered to minimize sidelobe energy distribution.

42. A method of distributing EM energy between first and second energy sources and their respective energy sinks where the first and second energy sources are physically connected to their respective energy sinks via first and second sets of intersecting conductors in the same plane but having different angular orientations, comprising the steps of:

providing a resonant cavity contiguous the plane of said intersecting conductors, wherein said energy sinks comprise a two-dimensional array of radiating patches, each patch being directly coupled electrically to immediately adjacent patches in each of the two dimensions; and generating first and second standing waves of first and second angular orientations from said first and second EM sources whereby nodes of said first and second standing waves occur at the intersections of at least some of said first and second sets of intersecting conductors such that excitations of a mode of the first standing wave and a mode of the second standing wave are substantially independent with each other.

43. The method of claim 2, wherein the intersecting conductors are microstrips.

44. An antenna, comprising:

a ground plane element;

a surface area including radiating array elements forming a two-dimensional array, a signal source terminal and associated conductive material directly interconnecting each of the elements electrically to immediately adjacent ones of said radiating array elements in each of the two dimensions and said signal source terminal such that the conductive material is substantially uninterrupted by the radiating array elements; and at least one resonant signal cavity between said ground plane element and said surface area configured to create, upon the application of EM power to said antenna, a standing wave the nodes of which exist at both the radiating array element and the associated conductive material wherein the surface area and the ground plane element act collectively as a resonator.

45. The apparatus of claim 44, wherein the radiating array elements are patches of conductive material and the associated conductive material comprises microstrip elements.

46. A microstrip planar array antenna, comprising:

a number of radiating array elements including patches in a planar, two-dimensional array, the patches being of substantially identical size;

a feed terminal in said planar array;

at least one ground plane element;

a plurality of associated conductive material elements, in said planar array, whereby said feed terminal is physically connected to each of said number of substantially identical size patches such that the conductive material elements are substantially uninterrupted by the plurality of patches and whereby said patches and said conductive material elements directly connect each of the patches electrically to immediately adjacent patches in each of the two dimensions in the two-dimensional array; and at least one resonant cavity contiguous said planar array configured such that standing waves formed in the at least one cavity have nodes at cross points of two vertical and horizontal microstrips wherein the at least one ground plane element, the plurality of radiating array elements and the plurality of conductive elements act collectively as a resonator.

47. The apparatus of claim 46, wherein:

the radiating array elements are radiating patches and are substantially identical size for maximum directivity; and the associated conductive material elements are microstrips.

48. A microstrip single planar array antenna that can be used, without modification, for circular and linear polarized beam signals, comprising:

a plurality of radiating patches in a two-dimensional planar array;

first and second substantially independent feed terminals in said two-dimensional planar array;

first and second sets of microstrip conductors, in said two-dimensional planar array, directly coupling each patch electrically to immediately adjacent patches in each of the two dimensions, whereby each of said feed terminals is physically connected to each of said plurality of substantially identical size patches with said first and second sets of microstrip conductors being oriented in different angular directions such that they form a plurality of criss-cross intersections; and at least one resonant cavity contiguous said planar array configured such that standing waves formed in the cavity have nodes coincident with a majority of said microstrip criss-cross intersections and said radiating patches.

49. The apparatus of claim 48, wherein the radiating patches are substantially identical size for maximum directivity.

50. The antenna of claim 49, wherein the patches are square.

51. A method of increasing the transmission efficiency of a microstrip array antenna including a two-dimensional array of radiating patches and a signal source terminal in a given plane juxtaposed a resonant cavity, wherein the signal source terminal comprises at least two substantially independent feed terminals, comprising the steps of:

electrically connecting the source terminal to each of the radiating patches with a plurality of conductive microstrips directly coupling each of the patches electrically to immediately adjacent patches in each of the two dimensions of the two-dimensional array, and crossing each other at one or more cross points; and configuring the antenna elements whereby at least two orthogonal standing waves occurring in said resonant cavity each have at least one node at the at least one cross point of the plurality of said conductive strips in a modal excitation manner whereby the cross-talk levels are minimized.

52. An antenna (100-3300), comprising:

a dielectric layer defining a first side and a second side;

at least one conductive ground plane element disposed on the first side of the dielectric layer;

a two-dimensional array of spaced-apart, radiating patches disposed on the second side of the dielectric layer; and at least one interconnecting element disposed on the second side of the dielectric layer and electrically interconnecting at least one corner of each patch of said plurality of patches such that at least one interconnecting element is substantially uninterrupted by the plurality of patches and such that each of the patches is directly connected electrically to immediately adjacent patches of said two-dimensional array in each of the two dimensions, wherein the interconnecting element, the at least one ground plane element and the array are at least configured to form at least one resonant cavity and wherein a two-dimensional standing wave is formed in the at least one resonant cavity whereby at least one node of the standing wave exists along at least a portion of the interconnecting element wherein the dielectric layer, the at least one ground plane element, the plurality of patches and the interconnecting element act collectively as a resonator.

53. The antenna of claim 52, wherein the at least one interconnecting element and said patches defines one surface of a leaky cavity operationally including a standing wave.

54. The antenna of claim 52, wherein the at least one interconnecting element operates to guide the power flow of standing waves formed in cavity the boundaries of which are delineated by said dielectric layer.

55. The antenna of claim 52, wherein the at least one interconnecting element operates in conjunction with said patches to define antenna bandwidth.

56. The antenna of claim 52, wherein the at least one interconnecting element operates in conjunction with said patches to define a standing wave resonant frequency of a cavity formed within the boundaries of the dielectric layer.

57. An antenna, comprising:

a substantially planar, two-dimensional array of radiating elements, wherein the radiating elements of the two-dimensional array are substantially equally spaced in each dimension and the two dimensions of the array extend in first and second substantially orthogonal directions;

a first channel being generally linear and configured to guide one or both of a traveling wave and a standing wave;

a first radiating element of the array of radiating elements;

a second radiating element of the array of radiating elements immediately adjacent the first radiating element and spaced from the first radiating element in the first direction;

a third radiating element of the array of radiating elements immediately adjacent the first radiating element and spaced from the first radiating element in the second direction;

wherein the first radiating element is directly connected by the first channel to the second radiating element, without intervening junctions with other channels directly connected to any other radiating element of the array;

wherein the first radiating element is directly connected by the first channel to the third radiating element, without intervening junctions with other channels directly connected to any other radiating element of the array; and wherein the second radiating element is connected by the first channel to the third radiating element at a first point on the first radiating element.

58. The antenna of claim 57, wherein the two-dimensional array of radiating elements comprises four or more radiating elements.

59. The antenna of claim 57, wherein the radiating elements each comprise a patch.

60. The antenna of claim 57, wherein the radiating elements are substantially identically shaped.

61. The antenna of claim 57, wherein the first channel comprises a plurality of conductors connecting each immediately adjacent radiating element of the two-dimensional array and substantially uninterrupted by the radiating elements.

62. The antenna of claim 61, wherein the first channel further comprises a plurality of microstrip conductors.

63. The antenna of claim 57, wherein each radiating element of the planar, two-dimensional array comprises a corner, wherein the first channel directly connects each immediately adjacent radiating element at the corner of the radiating element, and wherein the first point of the first radiating element comprises a corner of the first radiating element.

64. The antenna of claim 63, wherein the first channel comprises a microstrip.

65. The antenna of claim 64, wherein the microstrip connects three or more immediately adjacent radiating elements of the two-dimensional array and the microstrip is substantially uninterrupted by the corners of the radiating elements.

66. The antenna of claim 65, wherein the portion of the microstrip connected to three or more immediately adjacent radiating elements is substantially straight.

67. The antenna of claim 57, further comprising a sheet of dielectric material having a first and a second oppositely facing surfaces, the first surface underlying the planar array of radiating elements and the second surface overlying one or more ground elements.

68. The antenna of claim 57, wherein the first channel of each radiating element is substantially linear.

* * * * *